US010665993B2

(12) United States Patent
O'Young et al.

(10) Patent No.: US 10,665,993 B2
(45) Date of Patent: May 26, 2020

(54) COMMUNICATION CONNECTORS

(71) Applicant: Panduit Corp., Tinley Park, IL (US)

(72) Inventors: Jason O'Young, Tinley Park, IL (US); Satish I. Patel, Roselle, IL (US); Joshua A. Valenti, Ferndale, MI (US); Paul W. Wachtel, Arlington Heights, IL (US); Robert E. Fransen, Orland Park, IL (US); Andrew Ciezak, Georgetown, TX (US); Michael B. Verbeek, Crown Point, IN (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 16/433,366

(22) Filed: Jun. 6, 2019

(65) Prior Publication Data

US 2019/0288455 A1 Sep. 19, 2019

Related U.S. Application Data

(63) Continuation of application No. 16/102,289, filed on Aug. 13, 2018, now abandoned, which is a (Continued)

(51) Int. Cl.
*H01R 13/6461* (2011.01)
*H01R 13/62* (2006.01)
(Continued)

(52) U.S. Cl.
CPC ..... *H01R 13/6461* (2013.01); *H01R 12/62* (2013.01); *H01R 13/639* (2013.01); *H01R 13/6581* (2013.01); *H01R 13/6582* (2013.01); *H01R 24/64* (2013.01); *H01R 13/6272* (2013.01); *H01R 13/6466* (2013.01); *H01R 13/6469* (2013.01); *H01R 2107/00* (2013.01)

(58) Field of Classification Search
CPC .. H01R 12/62; H01R 13/6461; H01R 13/639; H01R 13/6581; H01R 13/6582; H01R 13/6272; H01R 13/6466; H01R 13/6469; H01R 24/64
USPC ..... 439/676, 67, 77, 329, 607.28
See application file for complete search history.

(56) References Cited

U.S. PATENT DOCUMENTS 2,928,324 A 3/1960 Hardenberg
4,811,165 A * 3/1989 Currier ..... H05K 1/189 361/716

(Continued)

FOREIGN PATENT DOCUMENTS

EP 1022819 A2 7/2000
JP 2001068227 A 3/2001

*Primary Examiner* — Edwin A. Leon
*Assistant Examiner* — Milagros Jeancharles
(74) *Attorney, Agent, or Firm* — Christopher S. Clancy; James H. Williams; Peter S. Lee

(57) ABSTRACT

Embodiments of the present invention relate to the field of telecommunication, and more specifically, to communication connectors such as, for example, shielded plug and jack connectors. In an embodiment, the present invention is a communication jack that includes a housing and a front sled assembly having a plurality of plug interface contacts (PICs), the front sled assembly being moveable along a horizontal plane of the communication jack between a first position and a second position, the first position being different from the second position.

6 Claims, 71 Drawing Sheets

Related U.S. Application Data continuation of application No. 15/157,940, filed on May 18, 2016, now Pat. No. 10,050,383.

(60) Provisional application No. 62/163,512, filed on May 19, 2015.

(51) Int. Cl.

| | |
|---|---|
| ***H01R 13/6581*** | (2011.01) |
| ***H01R 12/62*** | (2011.01) |
| ***H01R 13/639*** | (2006.01) |
| ***H01R 13/6582*** | (2011.01) |
| ***H01R 24/64*** | (2011.01) |
| *H01R 13/627* | (2006.01) |
| *H01R 13/6466* | (2011.01) |
| *H01R 13/6469* | (2011.01) |
| *H01R 107/00* | (2006.01) |

(56) References Cited

U.S. PATENT DOCUMENTS 5,035,652 A 7/1991 Shibano
5,056,568 A 10/1991 DiGianfilippo et al.
5,599,206 A 2/1997 Slack et al.
6,027,366 A * 2/2000 Mori ..... H01R 12/7076 439/495
6,056,568 A 5/2000 Arnett
6,302,704 B1 * 10/2001 Belanger, Jr. ..... H01R 12/78 29/844
6,537,083 B1 * 3/2003 Yatskov ..... H01R 12/52 439/310
6,666,719 B1 12/2003 Kuroi et al.
7,052,328 B2 5/2006 Ciezak et al.
7,179,131 B2 2/2007 Caveney et al.
7,281,957 B2 * 10/2007 Caveney ..... H01R 13/6658 439/676
RE41,699 E 9/2010 Itano et al.
7,824,219 B2 11/2010 Wang
7,824,231 B2 11/2010 Marti et al.
7,850,492 B1 * 12/2010 Straka ..... H01R 13/6625 439/676
8,641,452 B2 * 2/2014 Patel ..... H01R 13/6466 439/620.23
8,650,750 B2 * 2/2014 Engels ..... H01R 4/2433 29/857
8,790,139 B2 7/2014 Fitzpatrick
8,961,239 B2 * 2/2015 Moffitt ..... H01R 13/6461 439/676
9,106,021 B2 8/2015 Patel et al.
9,413,121 B2 8/2016 Poulsen et al.
2001/0042636 A1 * 11/2001 Biron ..... H05K 1/148 174/254
2006/0014410 A1 1/2006 Caveney
2006/0134984 A1 6/2006 Korsunsky et al.
2007/0015417 A1 * 1/2007 Caveney ..... H01R 13/6658 439/676
2008/0020652 A1 1/2008 Caveney et al.
2008/0045090 A1 2/2008 Caveney
2008/0111822 A1 5/2008 Horowitz et al.
2008/0132123 A1 * 6/2008 Milette ..... H01R 13/6466 439/676
2008/0194150 A1 8/2008 Genesius et al.
2009/0104821 A1 * 4/2009 Marti ..... H01R 13/6466 439/676
2009/0298338 A1 12/2009 Zhang et al.
2010/0197162 A1 8/2010 Straka et al.
2011/0111645 A1 5/2011 Caveney et al.
2013/0090011 A1 4/2013 Bolouri-Saransar et al.
2013/0109225 A1 5/2013 Liu
2014/0273570 A1 9/2014 Fransen et al.
2015/0056824 A1 2/2015 Bolouri-Saransar et al.
2016/0111822 A1 * 4/2016 Patel ..... H01R 13/6461 439/620.21
2016/0344139 A1 * 11/2016 O'Young ..... H01R 13/6461

* cited by examiner

Top Layer

Bottom Layer

COMMUNICATION CONNECTORS

CROSS-REFERENCE TO RELATED APPLICATIONS

This application is a continuation of U.S. patent application Ser. No. 16/102,289, filed Aug. 13, 2018; which is a continuation of U.S. patent application Ser. No. 15/157,940, filed May 18, 2016, which issued as U.S. patent Ser. No. 10/050,383 on Aug. 14, 2018, and claims the benefit of U.S. Provisional Patent Application No. 62/163,512 filed on May 19, 2015, which is incorporated herein by reference in its entirety.

FIELD OF INVENTION

Embodiments of the present invention relate to the field of telecommunication, and more specifically, to communication connectors such as, for example, shielded plug and jack connectors.

BACKGROUND

Communication cables and connectors form an essential part of the telecommunication infrastructure which allows for fast, efficient, and reliable data transfer. Being the points where continuity of a communication cable is interrupted, connectors and connector junctions can be especially susceptible to electromagnetic phenomenon that can cause signal degradation and corruption of the data being transferred.

One example of such phenomenon is the presence of near end crosstalk (NEXT) that is typically generated within a communication plug and a subsequent need to sufficiently cancel said NEXT in a communication jack. While at lower operating frequencies substantial cancellation of NEXT may be achieved with relative ease, an increase in the operational frequencies bring about added concerns which must be accounted for in the NEXT cancellation circuitry. Another phenomenon that may cause signal degradation is alien crosstalk (either near-end (ANEXT) or far-end (AFEXT)). Alien crosstalk generally refers to the electromagnetic interaction between neighboring communication channels, such as neighboring cables or connectors. This can be especially problematic in environments such as data centers where patch panels include a plurality of connectors that are in close proximity to each other.

Given the aforementioned concerns and an ever-increasing demand for low-cost, robust, high-speed, and/or industry compliant connection means, there exists a need for alternate designs of communication connectors.

SUMMARY

Accordingly, at least some embodiments of the present invention are directed towards apparatuses, methods, and/or systems which utilize communication connectors designed to at least partially address at least some of the aforementioned concerns.

In an embodiment, the present invention is a communication jack configured to receive a communication plug having a plurality of plug contacts. The jack includes a housing having an aperture configured to receive the communication plug and a front sled assembly positioned at least partially within the housing, the front sled assembly including a plurality of plug interface contacts (PICs), each of the plug contacts interfacing one of the PICs when the communication plug is received with the communication jack, a point of contact between each respective plug contact and PIC remaining the same when the communication plug is in an over-travel state and when the communication plug is in a mated state.

In another embodiment, the present invention is a communication jack that includes a housing and a front sled assembly positioned at least partially within the housing and having a plurality of PICs, the front sled assembly being moveable along a horizontal plane of the communication jack between a first position and a second position, the first position being different from the second position.

In yet another embodiment, the present invention is a shielded communication jack. The jack comprises a jack housing having substantially rectangular shape with a front portion, a rear portion, and four sides, the front portion having an aperture adapter for receiving a communication plug. The jack also comprises a jack shield positioned at least partially over the jack housing, the jack shield having a plurality of grounding tabs, at least one of the grounding tabs extending from a first edge of the aperture into the aperture towards the rear portion, at least one of the grounding tabs extending from a second edge of the aperture into the aperture towards the rear portion, the first edge being substantially perpendicular to the second edge.

In a variation of this embodiment, at least one of the grounding tabs extends from a third edge of the aperture into the aperture towards the rear portion, the third edge being substantially perpendicular to the first edge, the third edge further being substantially parallel to the second edge.

In still yet another embodiment, the present invention is a communication jack. The jack includes a housing having an aperture configured to receive the communication plug. The jack also includes a front sled assembly positioned at least partially within the housing, the front sled assembly including a first printed circuit board (PCB) having a first side and a second side, and a plurality of PICs secured within the first PCB. The jack also includes a plurality of cable contacts. The jack also includes a second PCB having a first portion, a second portion, and a center portion between the first portion and the second portion. The jack is configured such that the first portion of the second PCB is connected to the first side of the first PCB, the second portion of the second PCB is connected to the second side of the first PCB, and the cable contacts are connected to the center portion of the second PCB.

These and other features, aspects, and advantages of the present invention will become better understood with reference to the following drawings, description, and any claims that may follow.

DETAILED DESCRIPTION

Figure 1:
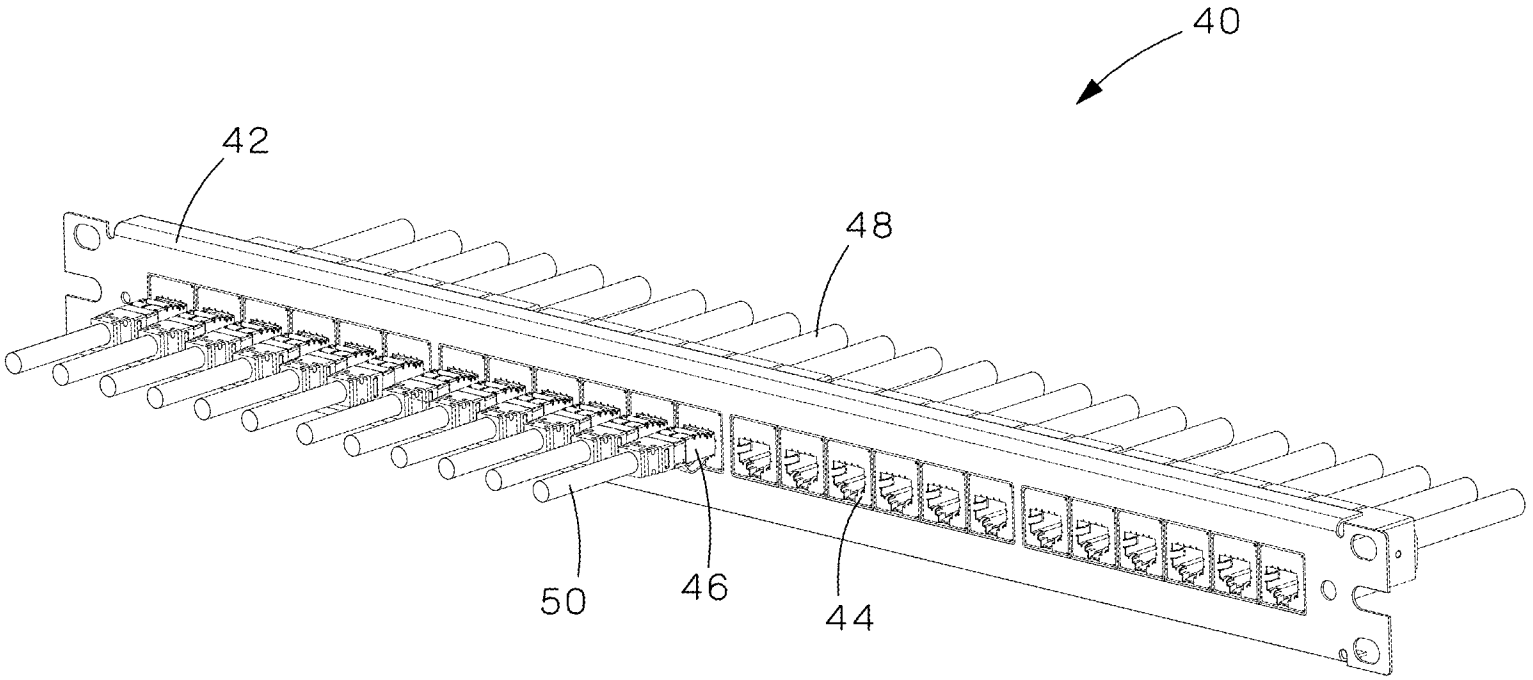
FIG. 1 illustrates an embodiment of a system according to an embodiment of the present invention.

FIG. 1 illustrates a communication system 40 according to an embodiment of the present invention which includes patch panel 42 with jacks 44 and corresponding plug assemblies 46. Respective cables 48 are terminated to jacks 44, and respective cables 50 are terminated to plug assemblies 46. Once a plug assembly 46 mates with a jack 44 data can flow in both directions through these connectors. Although communication system 40 is illustrated as a patch panel in FIG. 1, alternatively it can include other active or passive equipment. Examples of passive equipment can be, but are not limited to, modular patch panels, punch-down patch panels, coupler patch panels, wall jacks, etc. Examples of active equipment can be, but are not limited to, Ethernet switches, routers, servers, physical layer management systems, and power-over-Ethernet equipment as can be found in data centers and/or telecommunications rooms; security devices (cameras and other sensors, etc.) and door access equipment; and telephones, computers, fax machines, printers and other peripherals as can be found in workstation areas. Communication system 40 can further include cabinets, racks, cable management and overhead routing systems, and other such equipment.

Figure 2:
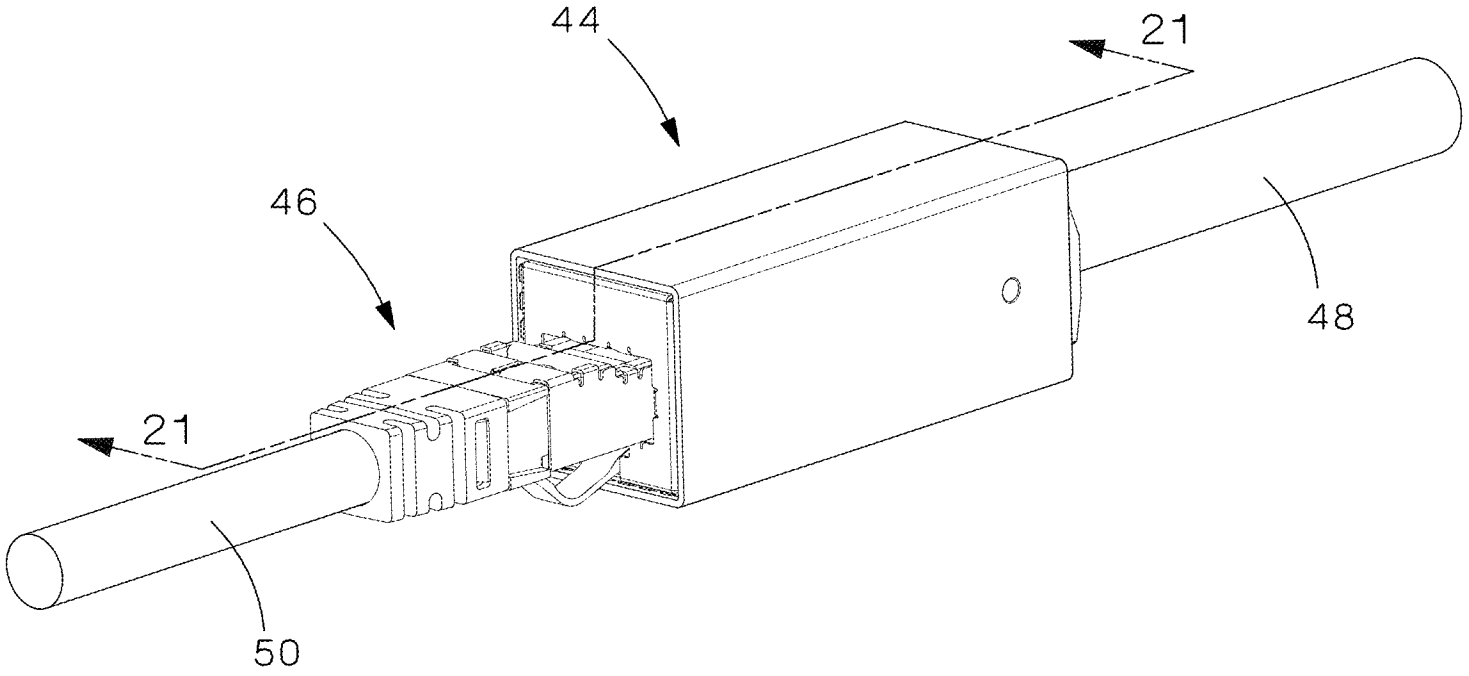
FIG. 2 illustrates a plug/jack combination in a mated state according to an embodiment of the present invention.
Figure 3:
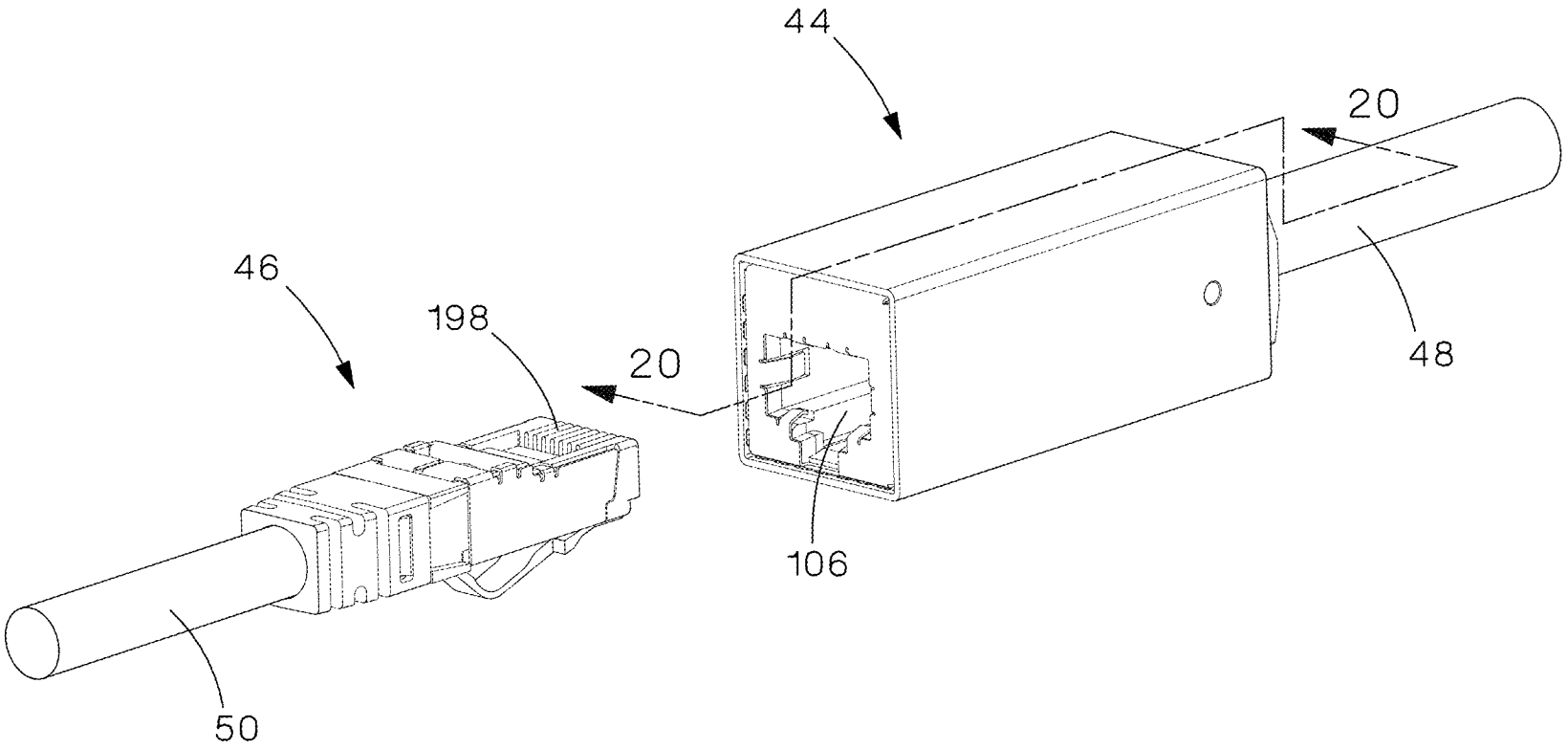
FIG. 3 illustrates the plug/jack combination of FIG. 2 in an unmated state.
Figure 4:
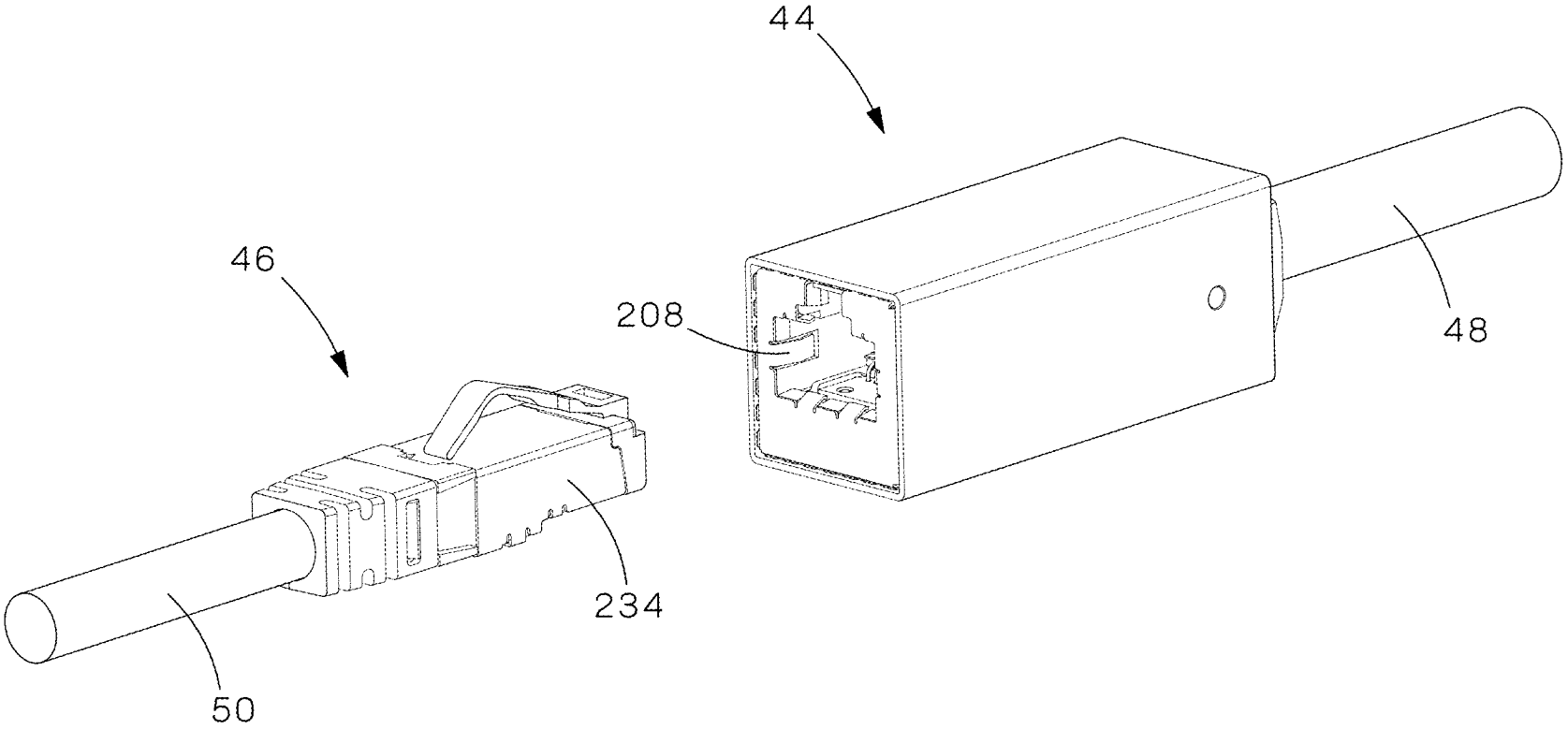
FIG. 4 illustrates the plug/jack combination of FIG. 3 rotated 180 degrees about a central cable axis relative to the view shown in FIG. 3.

With the patch panel 42 removed, FIG. 2 illustrates the network jack 44 and the RJ45 plug assembly 46 in a mated configuration, and FIGS. 3-4 illustrate the network jack 44 and the RJ45 plug assembly 46 in an unmated configuration with FIG. 4 being rotated 180° about the central axis of cable 48 relative to FIG. 3.

Figure 5:
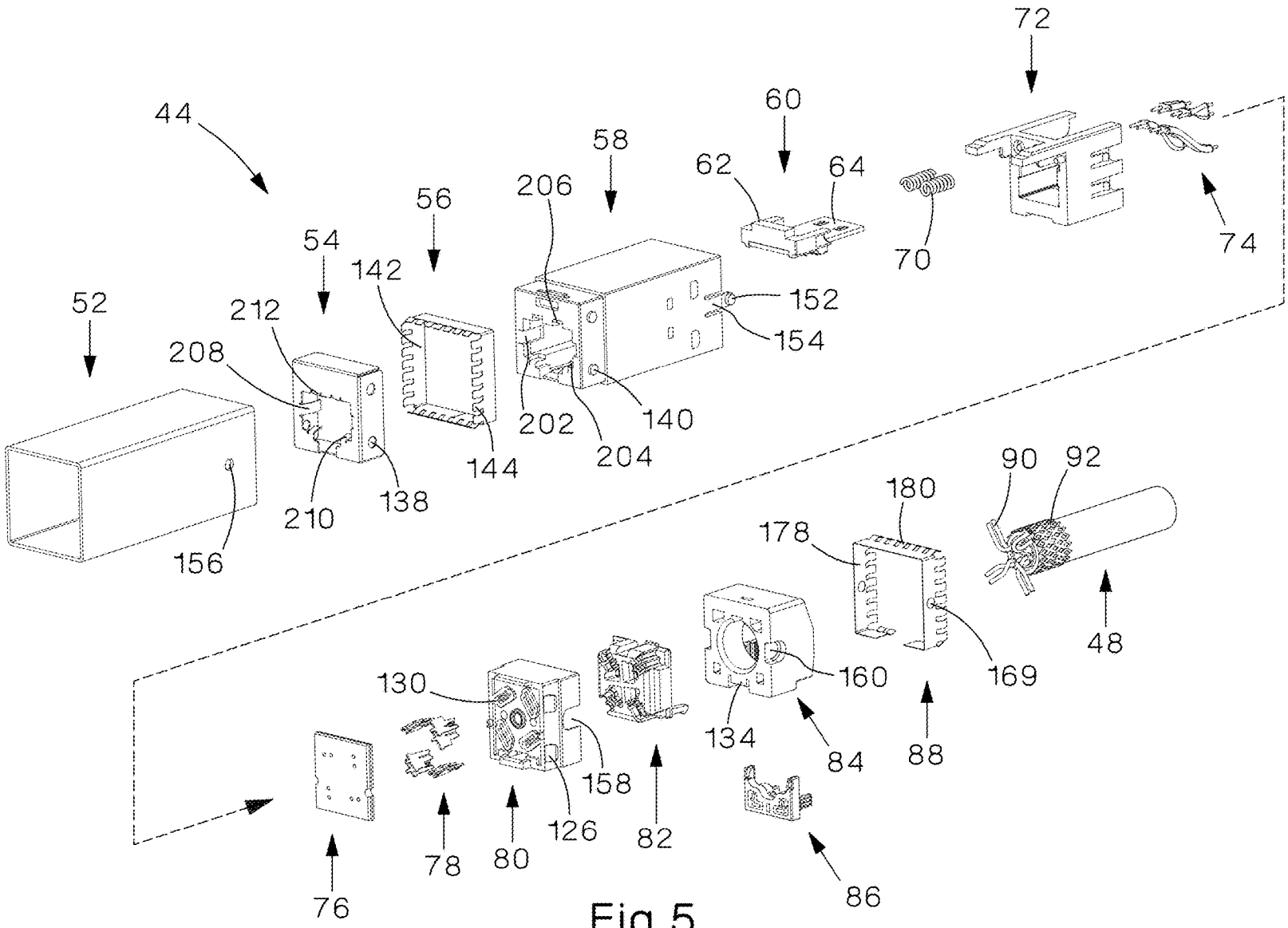
FIG. 5 illustrates an exploded front perspective view of the jack of FIG. 2.
Figure 6:
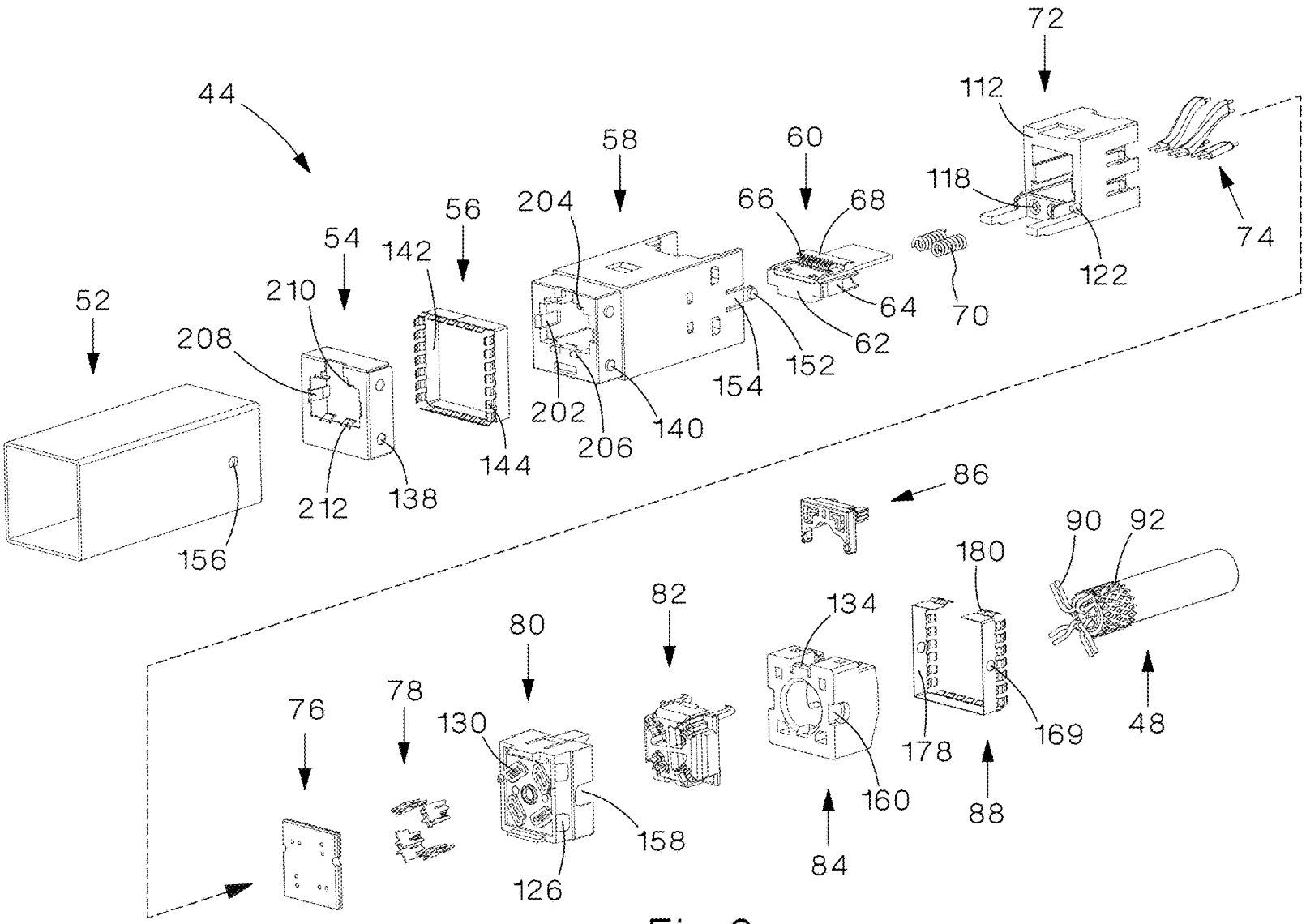
FIG. 6 illustrates an exploded front perspective view of the jack of FIG. 2 rotated 180 degrees about the jack's longitudinal axis.
Figure 7:
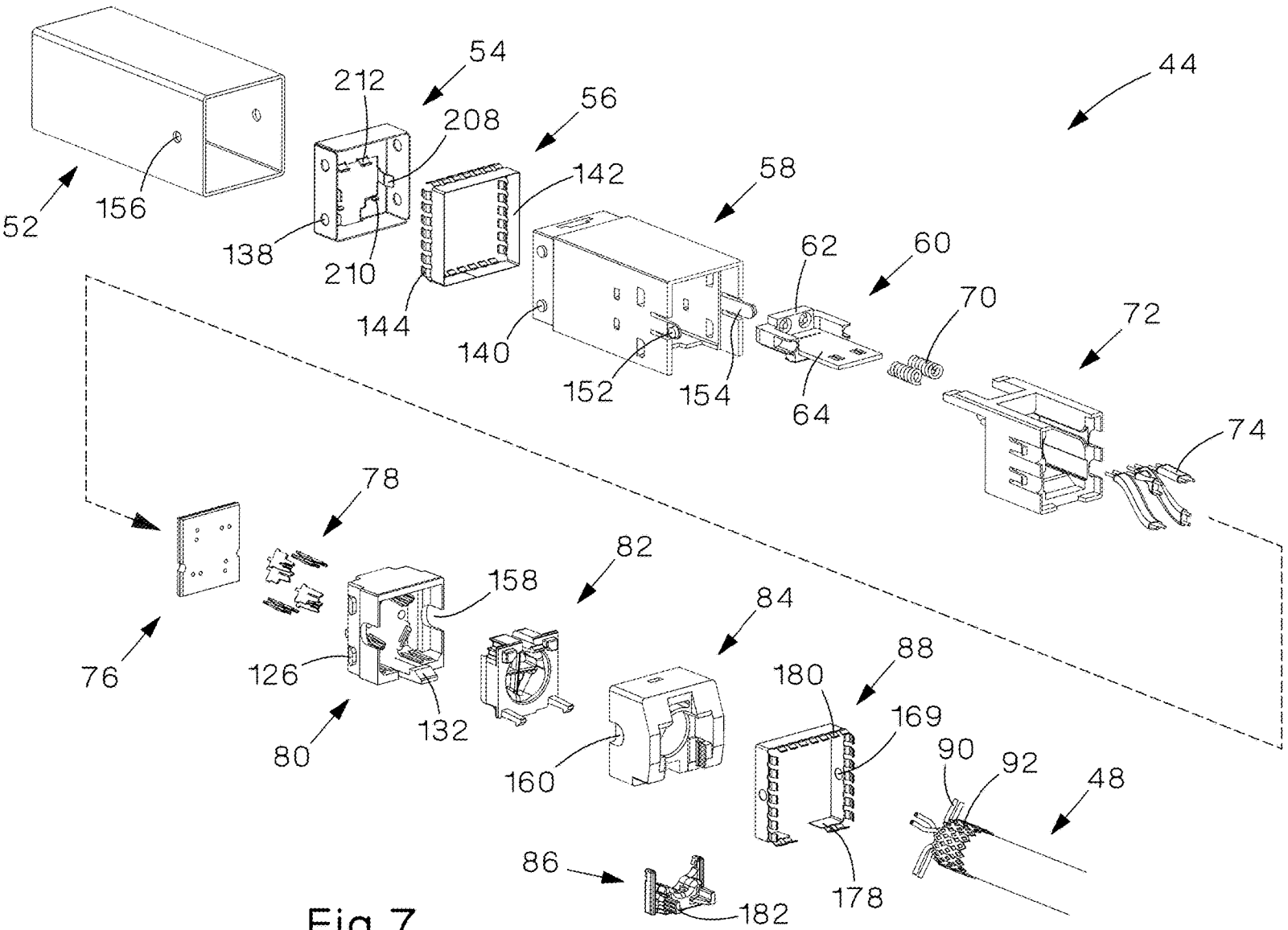
FIG. 7 illustrates an exploded rear perspective view of the jack of FIG. 2.

As shown in the exploded view of the jack 44 in FIGS. 5-7, the jack includes conductive shell 52, jack shield nose 54, front EMI (electromagnetic interference) gasket 56, jack housing 58, sled assembly 60 (with sled support 62, horizontal PCB (printed circuit board) 64, PICs (plug interface contacts) 66, and flexible PCB 68), springs 70, slide support 72, flexible conductive members 74, vertical PCB 76, IDCs (insulation displacement contacts) 78, rear sled 80, wire containment cap 82, conductive rear cap 84, conductive strain relief clip 86, and rear EMI gasket 88. Jack 44 can be terminated to cable 48 which includes conductors 90 and braid 92.

Figure 8:
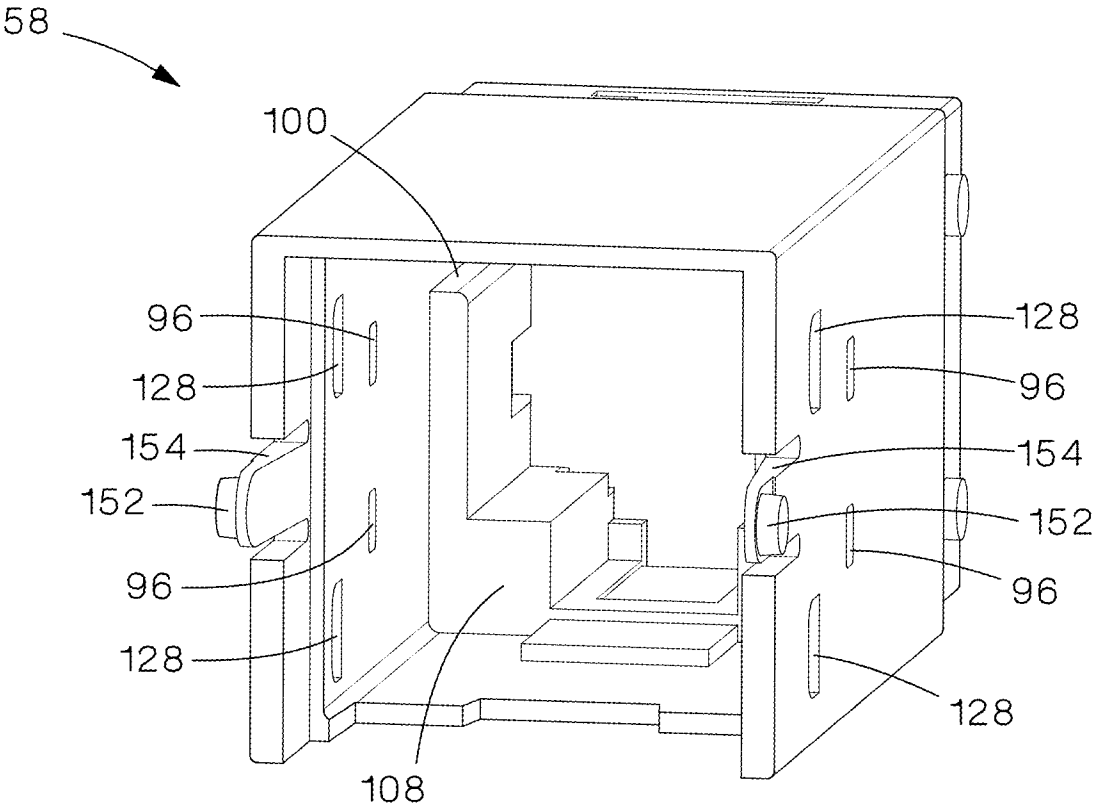
FIG. 8 illustrates a rear perspective view of a jack housing of the jack of FIG. 2.
Figure 9:
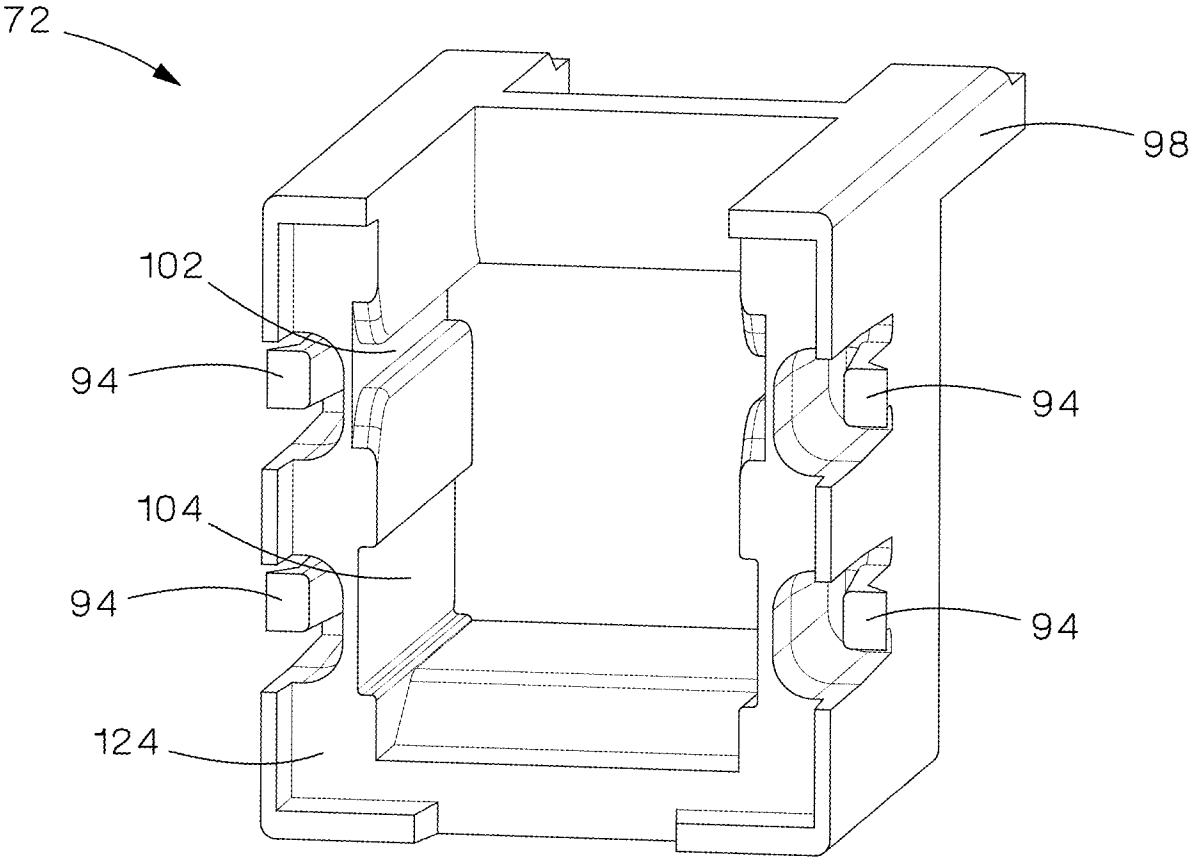
FIG. 9 illustrates a rear perspective view of a slide support of the jack of FIG. 2.

FIG. 8 shows a rear isometric view of the jack housing 58 and FIG. 9 shows an isometric view of the slide support 72. In the assembly of network jack 44, the slide support 72 together with the sled assembly 60 and springs 70 are inserted through the rear of the jack housing 58. As the leading arms 98 of slide support 72 fit into slots 100 on jack housing 58, flexible latches 94 of slide support 72 secure to pockets 96. As a result, sled assembly 60 becomes trapped in between the front of the jack housing 58 and slide support 72. However, it remains free to slide during operation in the direction of the central axis of cable 48 (i.e., in the longitudinal direction of the jack 44). This is done by having rails 102 on slide support 72 act as guides for sled assembly 60, ensuring that travel direction is limited to the direction of the central axis of the jack 44.

Figure 10:
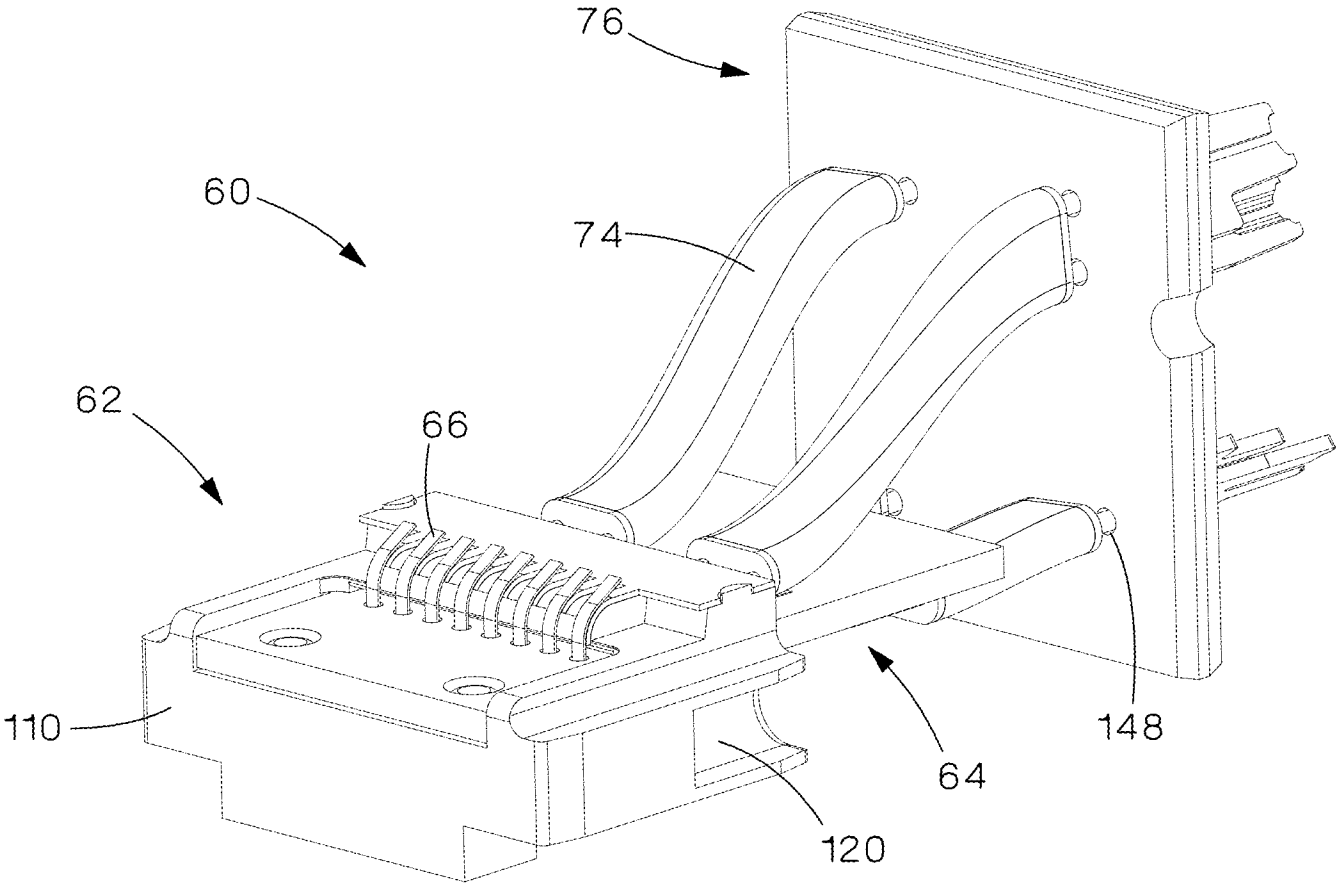
FIG. 10 illustrates a front perspective view of a sled assembly of the jack of FIG. 2.
Figure 11:
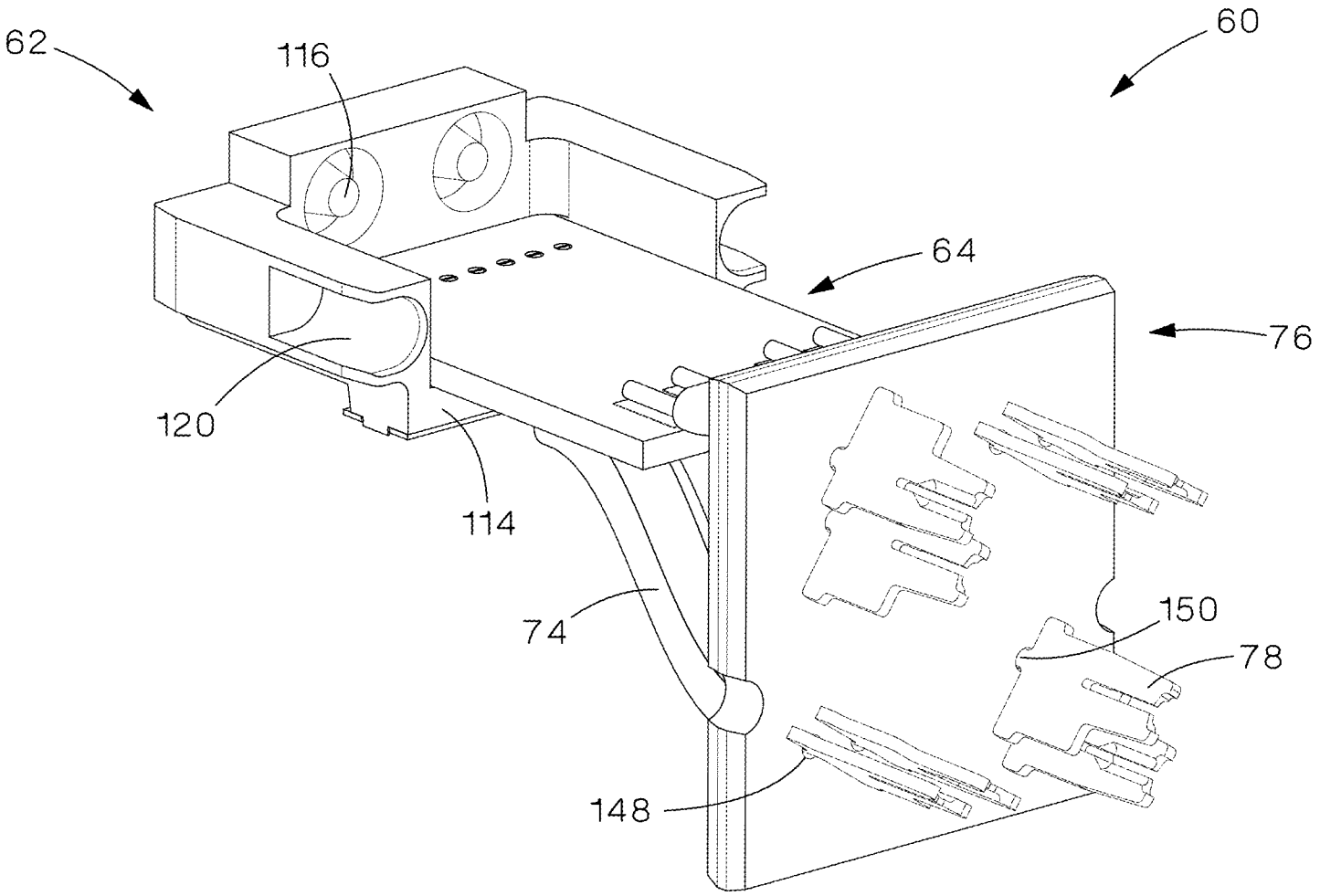
FIG. 11 illustrates a rear perspective view of the sled assembly of FIG. 10 rotated 180 degrees about the assembly's central longitudinal axis.

FIGS. 10 and 11 illustrate front and rear isometric views of the sled assembly 60 connected to the vertical PCB 76 via flexible conductive members 74 in greater detail. In an unmated state, sled assembly 60 is biased towards plug opening 106 positioned at the front of network jack 44 (see FIG. 3). When network jack 44 does not have the plug assembly 46 connected thereto, stop face 108 inside jack housing 58 (see FIG. 8) restricts the maximum forward movement of the sled assembly 60 by making contact with front face 110 on sled support 62. When the plug assembly 46 is connected to the jack 44, the sled assembly is pushed towards the rear of the jack, with slide face 112 (see FIG. 6) on the slide support 72 restricting the maximum rearward movement by making contact with rear face 114 on sled support 62. This configuration also permits plug over-travel, allowing the plug to fully and effectively latch onto the jack. The biasing of the sled support 62 is achieved by way of springs 70 which are secured between spring pockets 116 of sled support 62 and spring posts 118 (see FIG. 6) of slide support 72. Springs 70 may also be installed to spring pockets 120 of sled support 62 and spring posts 122 of slide support 72 (secondary springs 70 not shown). Springs 70 may be installed in either or both locations to vary the total amount of insertion force and resultant normal force seen on PICs 66 during operation.

Because the horizontal PCB 64 of the sled assembly 60 is slidable relative to the vertical PCB 76 that is constrained between ledge 124 of the rear of slide support 72 and the rear sled 80, an electrical link between the two PCBs is provided by way of flexible conductive members 74. Flexible conductive members 74 are connected to horizontal PCB 64 through solder pads 146 (see FIGS. 18 and 19) and to vertical PCB 76 by via holes 148. Flexible conductive members 74 in turn could have been adapted to be connected through other known methods including, but not limited to, using IDCs on both PCB 64 and PCB 76, and interconnecting cable conductors. Flexible conductive members 74 are shown as twinaxial cabling, but other non-limiting flexible conductive members may be used, including twisted pair cabling, ribbon cabling, singular wires, and/or flexible metal strips. Because flexible conductive members 74 exhibit at least some deformation upon the movement of the horizontal PCB 64, clearance slots 104 are provided on slide support 72 to allow for free motion of flexible conductive members 74 when plug assembly 46 mates with a network jack 44.

To fully constrain the vertical PCB 76 between slide support 72 and rear sled 80, the rear sled is inserted into the jack housing 58 through the rear portion thereof and secured thereto via rigid latches 126 which engage pockets 128. Rear sled 80 includes a plurality of IDC slots 130 which are aligned with a plurality of IDCs 78 that are connected to vertical PCB 76. As shown in FIG. 11, IDCs 78 includes solder posts 150 that align with via holes 148 on vertical PCB 76. In other embodiments, IDCs 78 may be connected to PCB 76 through other known methods including, but not limited to, compliant pins. Rear sled 80 also includes relief slots 158 which provide room for flexible members 154 on the jack housing 58 to flex during further assembly of the jack.

At the front of the jack 44, jack shield nose 54 is secured to the front of the jack housing 58 via posts 140 and corresponding receiving holes 138. Jack shield nose 54 includes grounding tabs/flanges 208, 210, and 212 which can be pushed into grounding tab recesses 202, 204, and 206 in the jack housing 58 upon mating with a corresponding plug. A front EMI gasket 56 may be secured to shield nose 54 through adhesive surfaces 142, which surrounds the inner perimeter of front EMI gasket 56. Adhesive surfaces 142 may be conductive and the grounding path may include flanges 144, allowing electricity to flow between the shield nose 54 and conductive shell 52.

The conductive shield 52 can be metal, metallic, or otherwise conductive, and can have a tubular form which avoids length-wise seams. This configuration may provide electrical and/or structural benefits over connectors with stamped or formed shields. The shield 52 is fitted over the jack housing 58 such that the front and rear EMI gaskets 56, 88 establish electrical contact therewith, and posts 152 on flexible members 154 align with and engage apertures 156 securing shield 52 relative to housing 58. Relief slots 158 provide room for flexible members 154 to flex towards the interior of the jack housing 58 during the shield installation process.

Figure 12:
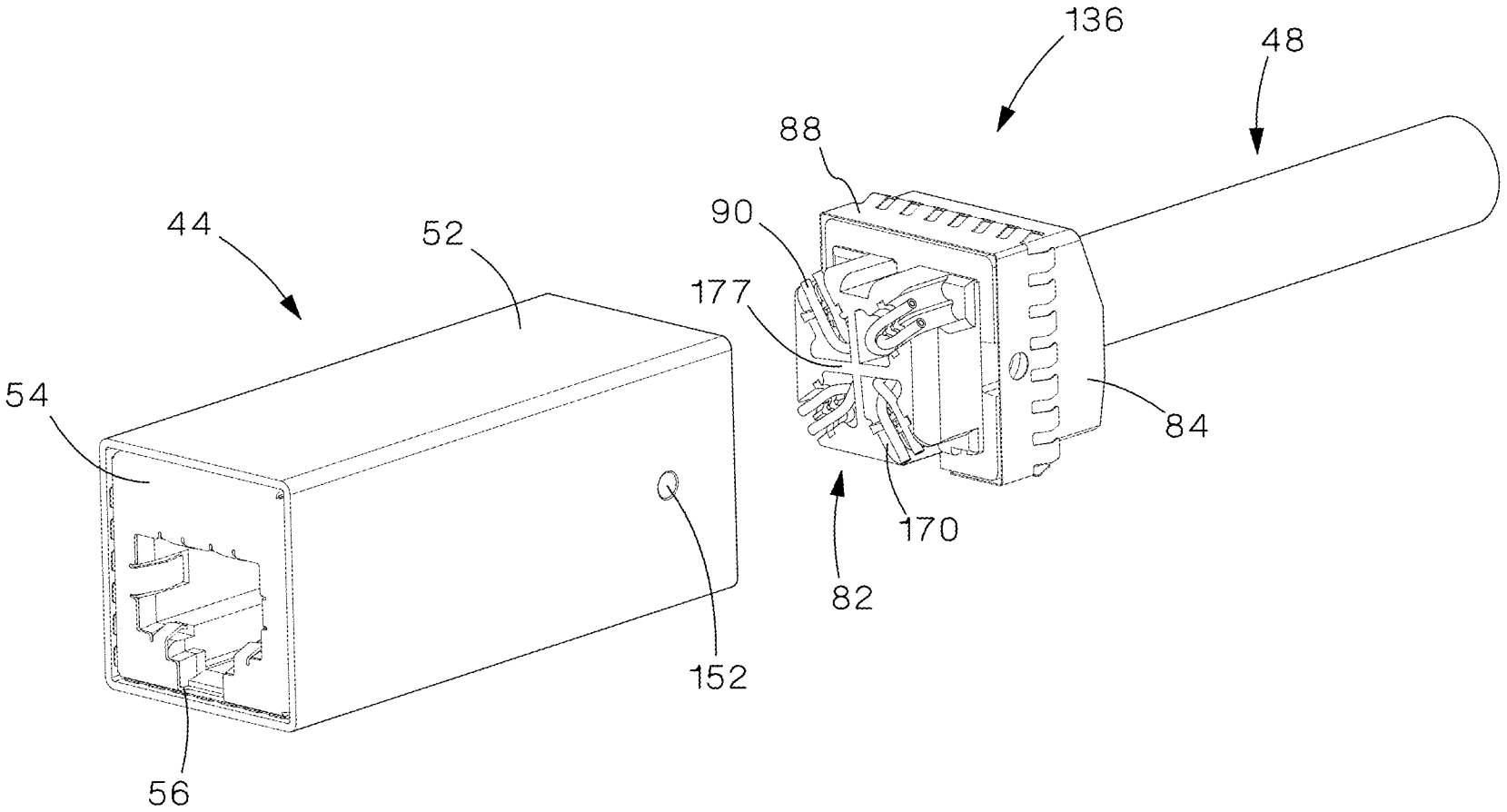
FIG. 12 illustrates a front perspective view of the jack of FIG. 2 with the rear cap assembly detached.

As shown in FIG. 12, assembly of the jack 44 can be completed by connecting the conductors 90 and braid 92

Figure 13:
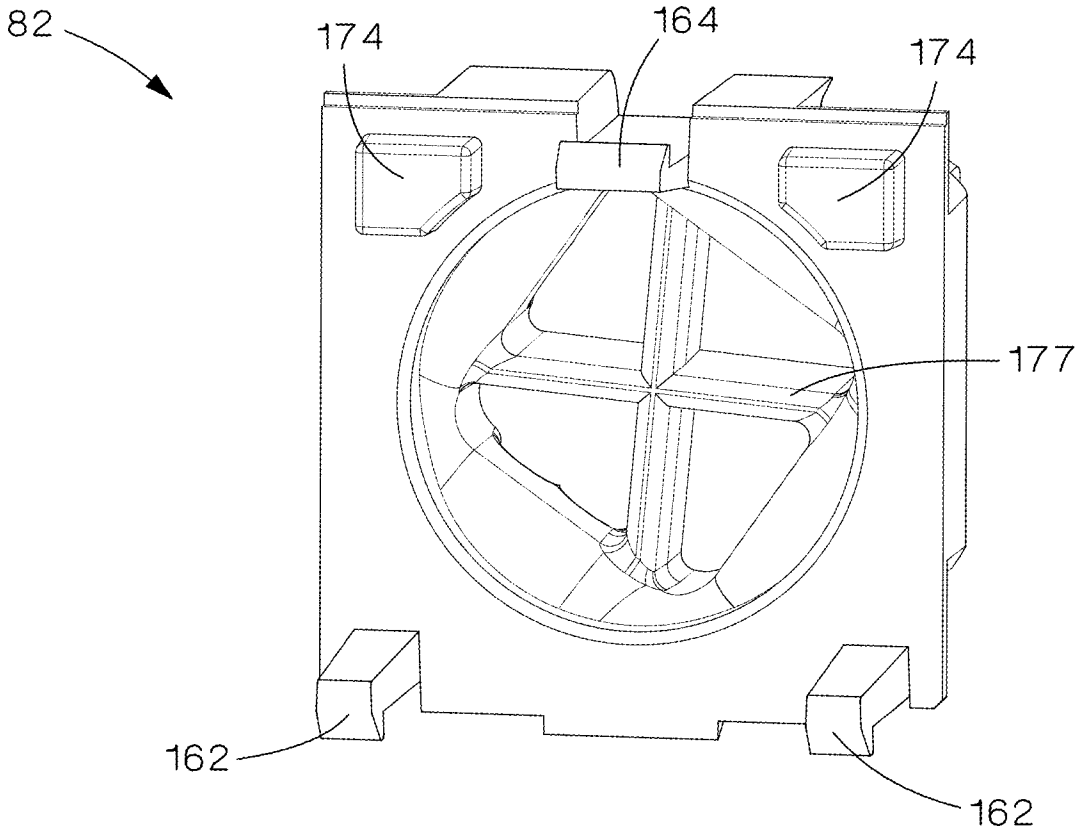
FIG. 13 illustrates a containment cap of the rear cap assembly of the jack of FIG. 2.
Figure 14:
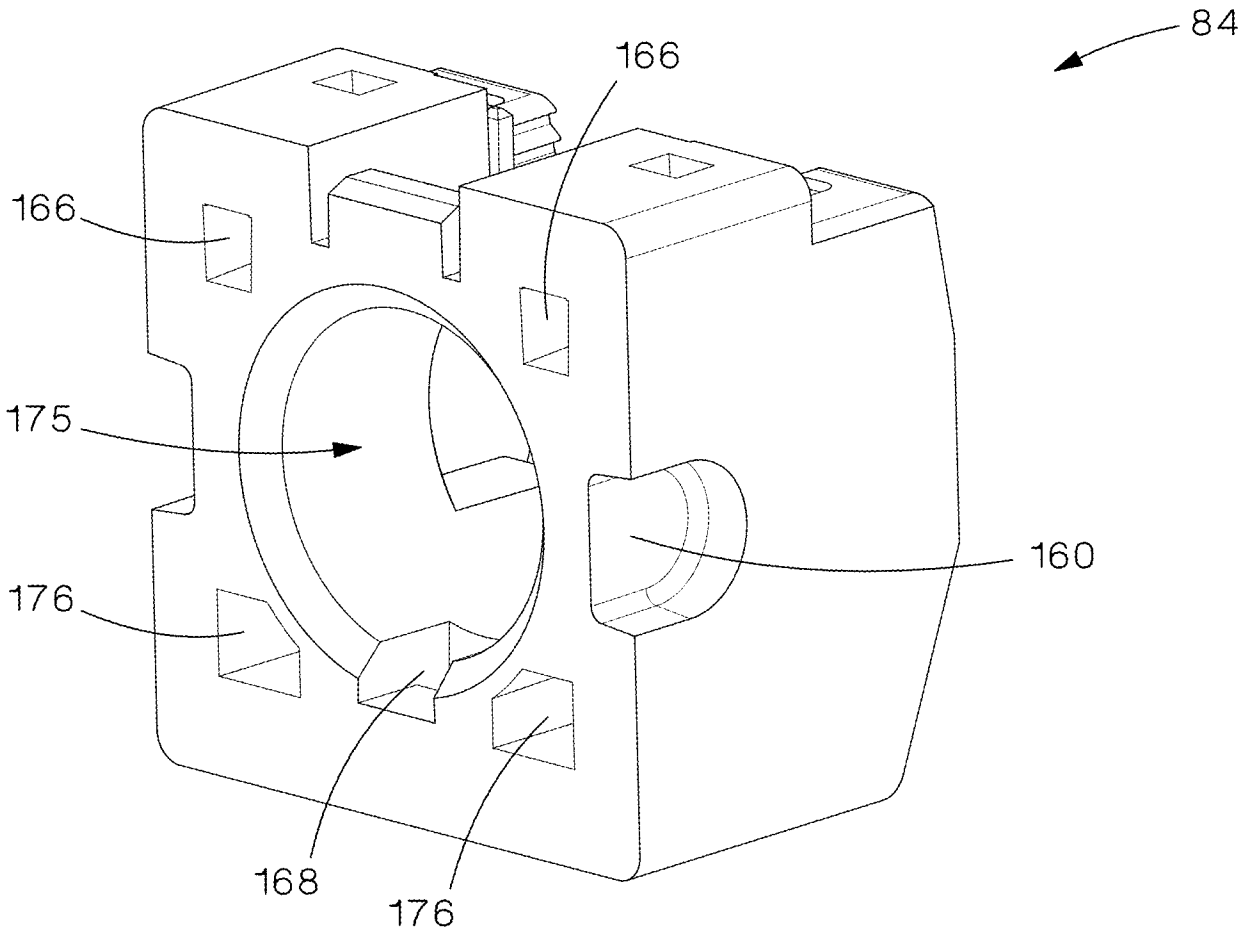
FIG. 14 illustrates a conductive cap of the rear cap assembly of the jack of FIG. 2.

(see FIG. 5) of the cable 48 to the previously assembled portion of jack 44 via a rear cap assembly 136 (which includes wire containment cap 82, conductive rear cap 84, conductive strain relief clip 86, and rear EMI gasket 88). To do this, the wire containment cap 82 is connected to the conductive rear cap 84 by aligning and engaging flexible latches 162 and 164 (shown in FIG. 13) with respective latch pockets 166 and 168 (shown in FIG. 14). The alignment of the wire containment cap 82 with the conductive rear cap 84 is aided by the bosses 174 and the receiving pockets 176.

Figure 15:
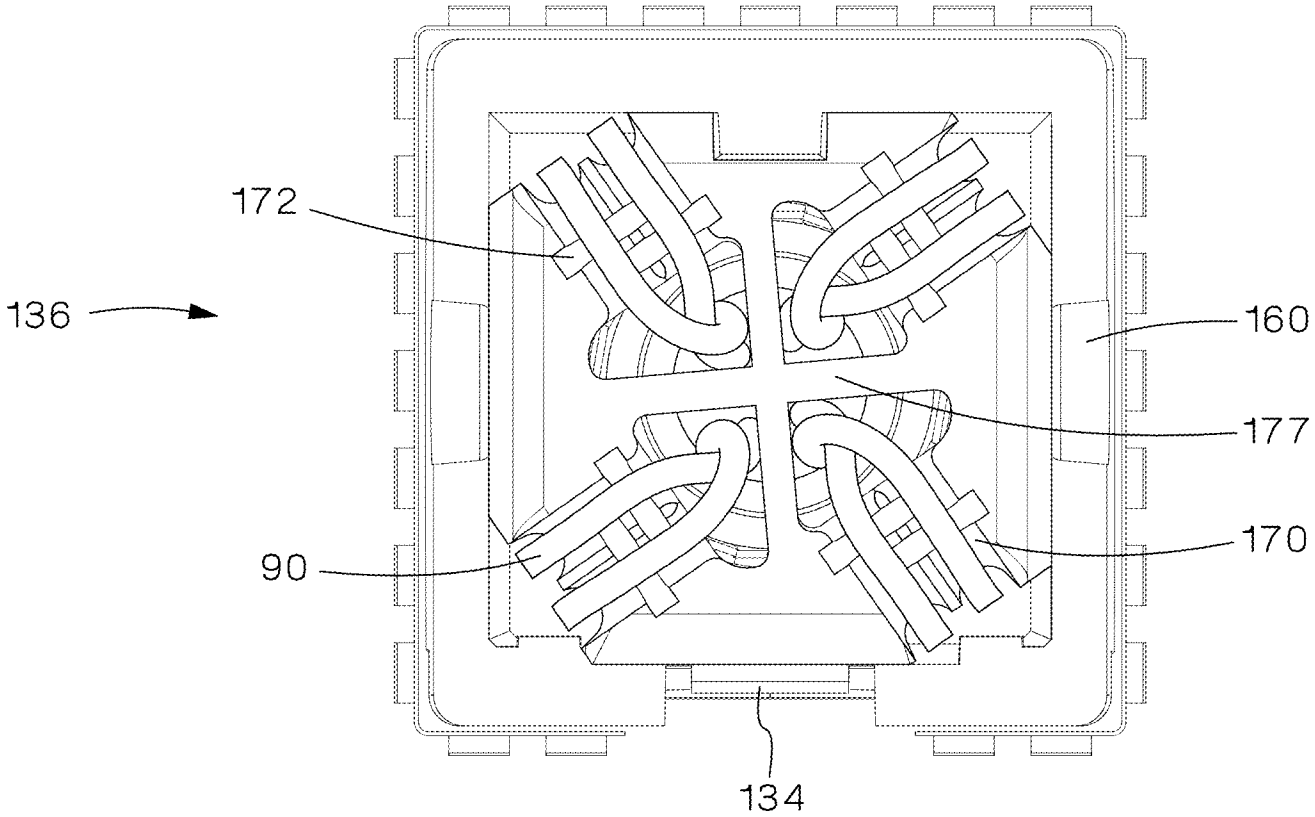
FIG. 15 illustrates a front view of the rear cap assembly of the jack of FIG. 2.
Figure 16:
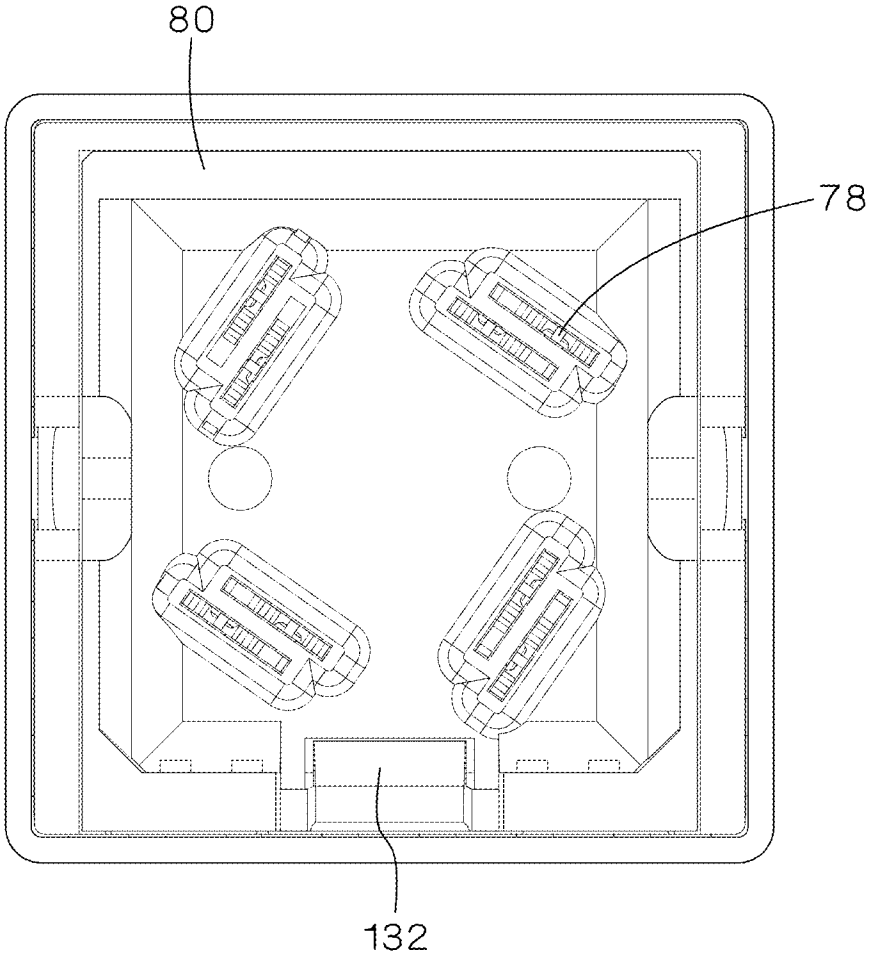
FIG. 16 illustrates a rear view of a rear sled assembled to the jack housing of the jack of FIG. 2.

Referring back to FIG. 13, the wire containment cap 82 includes a divider 177 which controls separation of pairs of conductors 90. As the cable 48 is fed through the cable receiving aperture 175 of conductive rear cap 84, each conductor pair is separated and routed through one of four conductor pair holes created by the divider 177. As can be seen in FIGS. 12 and 15, each pair of conductors 90 are aligned with a respective pair of conductor slots 170 in the wire containment cap 82 and each conductor slot 170 includes an IDC slot 172 which aligns with one of the IDCs 78. FIG. 16 illustrates the alignment of the IDCs 78 as they protrude through the rear sled 80. The layout shown in FIG. 16 may reduce the total amount of alien crosstalk as well as it may improve the pair-to-pair internal crosstalk coupling, thereby improving the balance of the jack. When the rear cap assembly 136 is mated with the rest of the jack 44, IDCs 78 penetrate the insulation of conductors 90 and establish an electrical contact therewith.

Figure 17:
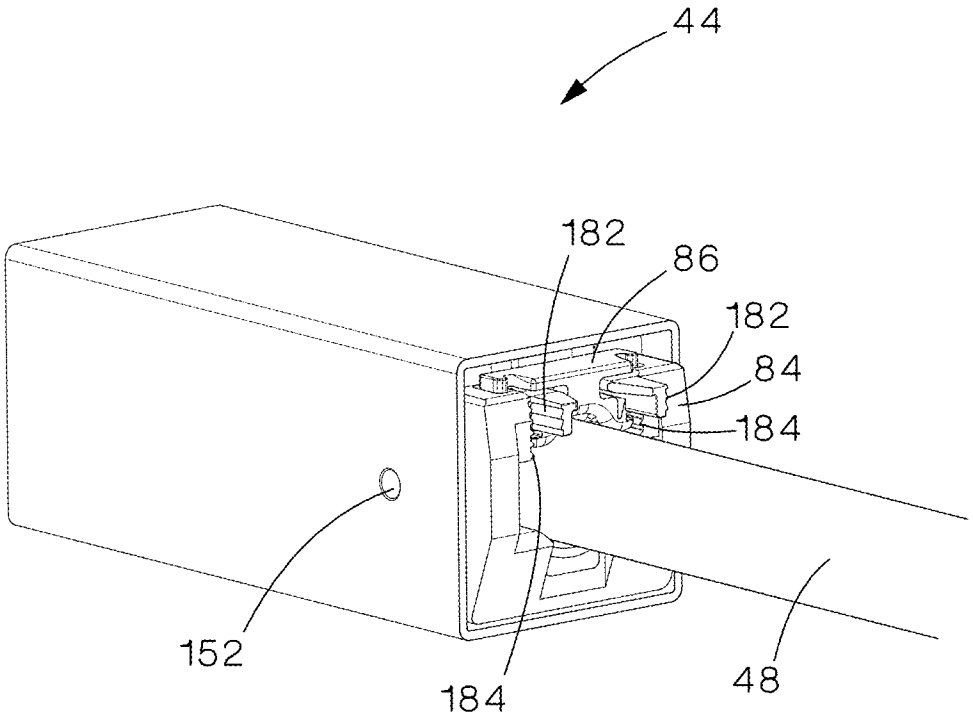
FIG. 17 illustrates a rear perspective view of an assembled jack of FIG. 2.

A conductive strain relief clip 86 is used to secure cable 48 to the conductive rear cap 84. As shown in FIGS. 7 and 17, it includes latches 182 which secure to teeth 184 as the conductive strain relief clip 86 is guided into the conductive rear cap 84. The interaction of the latches 182 and teeth 184 prevent the clip 86 from backing out of the cap 84, and allows the clip 86 to compress the cable 48 against the cap 84 securing it in the process.

A rear EMI gasket 88 is secured to conductive rear cap 84 through adhesive surfaces 178, which surrounds the inner perimeter of rear EMI gasket 88. Adhesive surfaces 178 may be conductive and the grounding path may include flanges 180, allowing electricity to flow between the conductive rear cap 84 and conductive shell 52 when the rear cap assembly 136 is mated with the rest of the jack 44.

As shown in FIG. 17, the rear cap assembly 136 is assembled to the rest of the jack 44 by mating it with rear sled 80, utilizing flexible latch 132 on rear sled 80 which attaches to rigid latch 134 on conductive rear cap 84, and posts 152 of jack housing 58 which engage holes 169 in the rear EMI gasket 88. To avoid interference between flexible members 154 and the rear cap 84, relief pockets 160 are provided on both sides of the rear cap 84.

Figure 18:
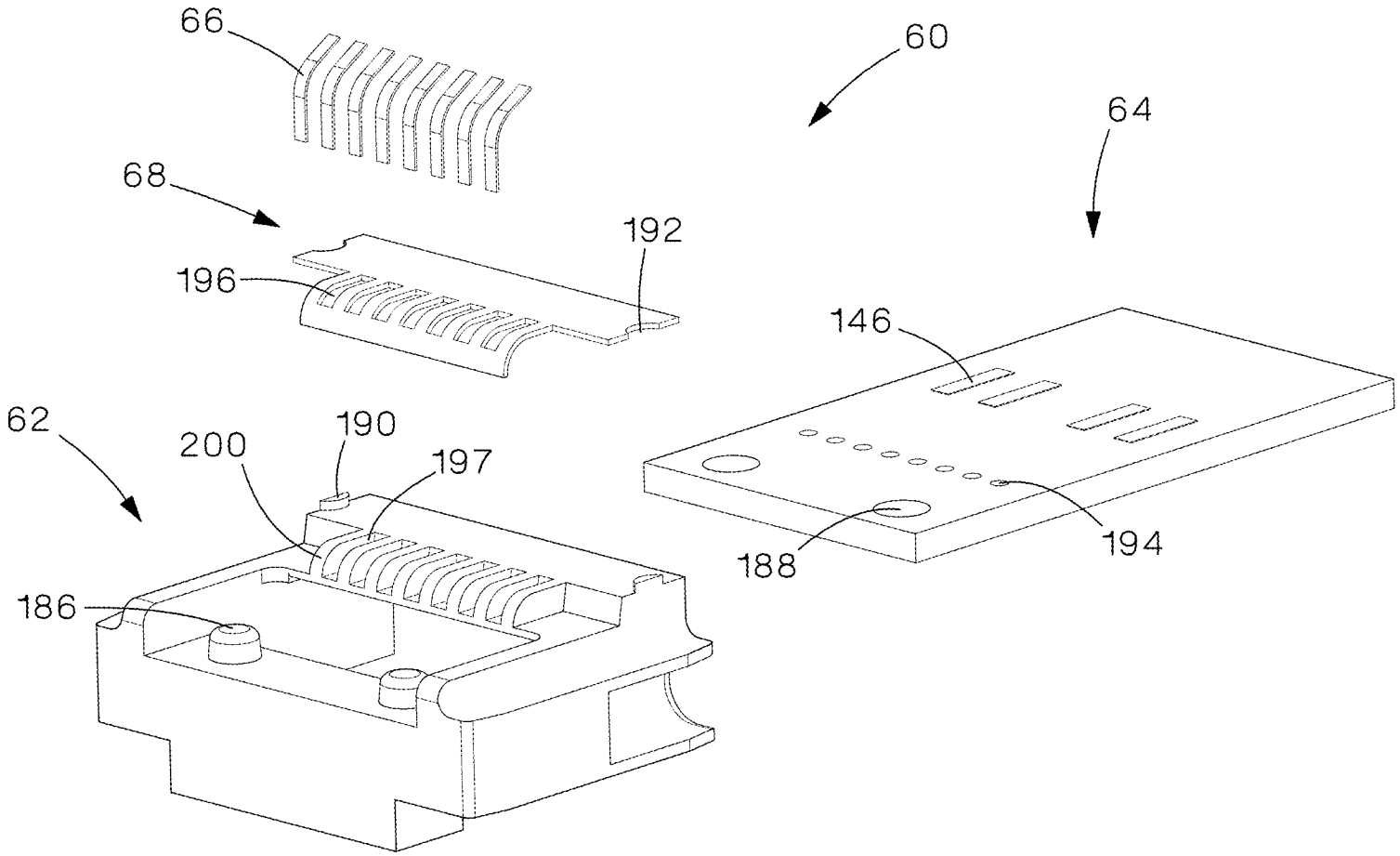
FIG. 18 illustrates an exploded front perspective view of the sled assembly of the jack of FIG. 2.
Figure 19:
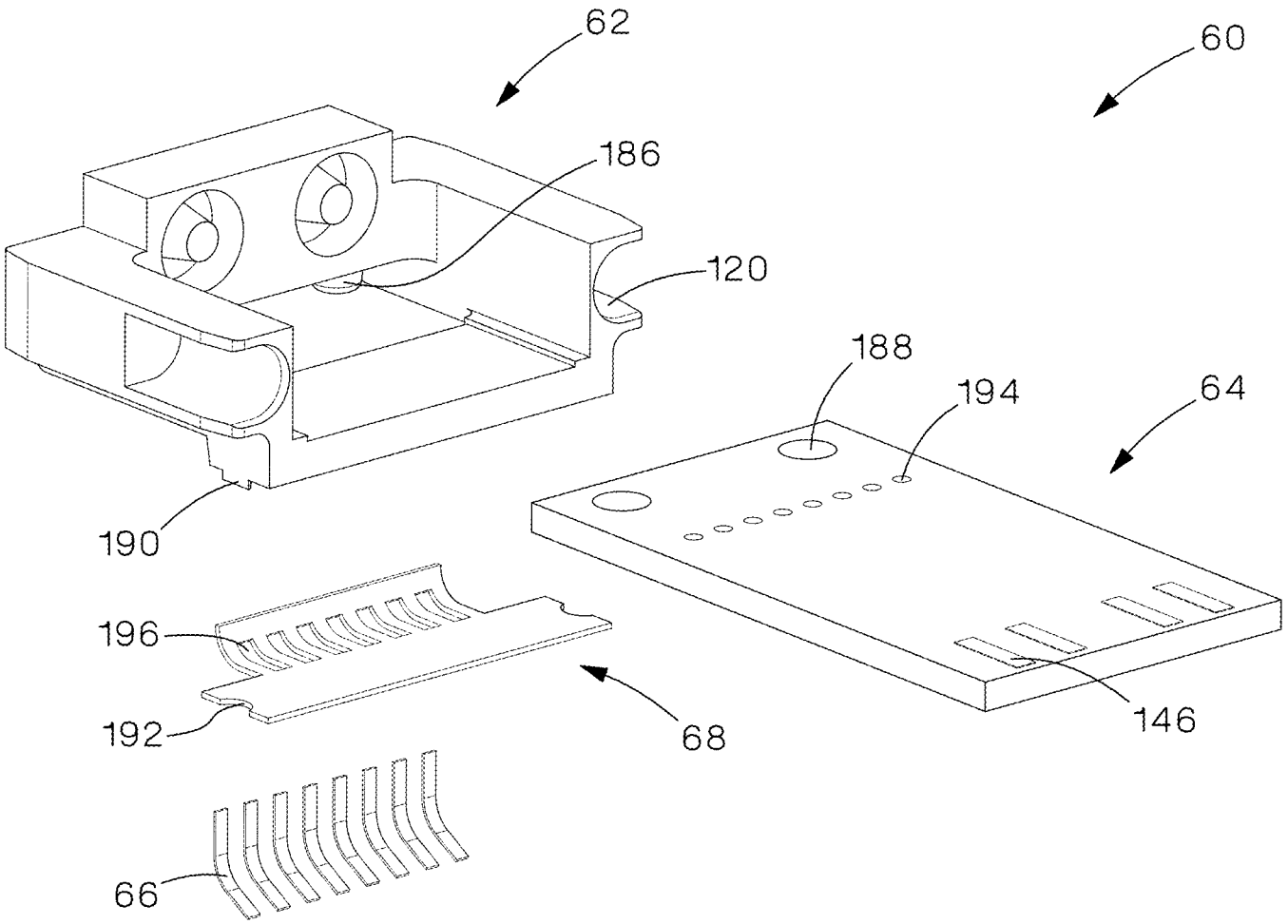
FIG. 19 illustrates an exploded rear perspective view of the sled assembly of FIG. 18 rotated 180 degrees about the assembly's central longitudinal axis.
Figure 20:
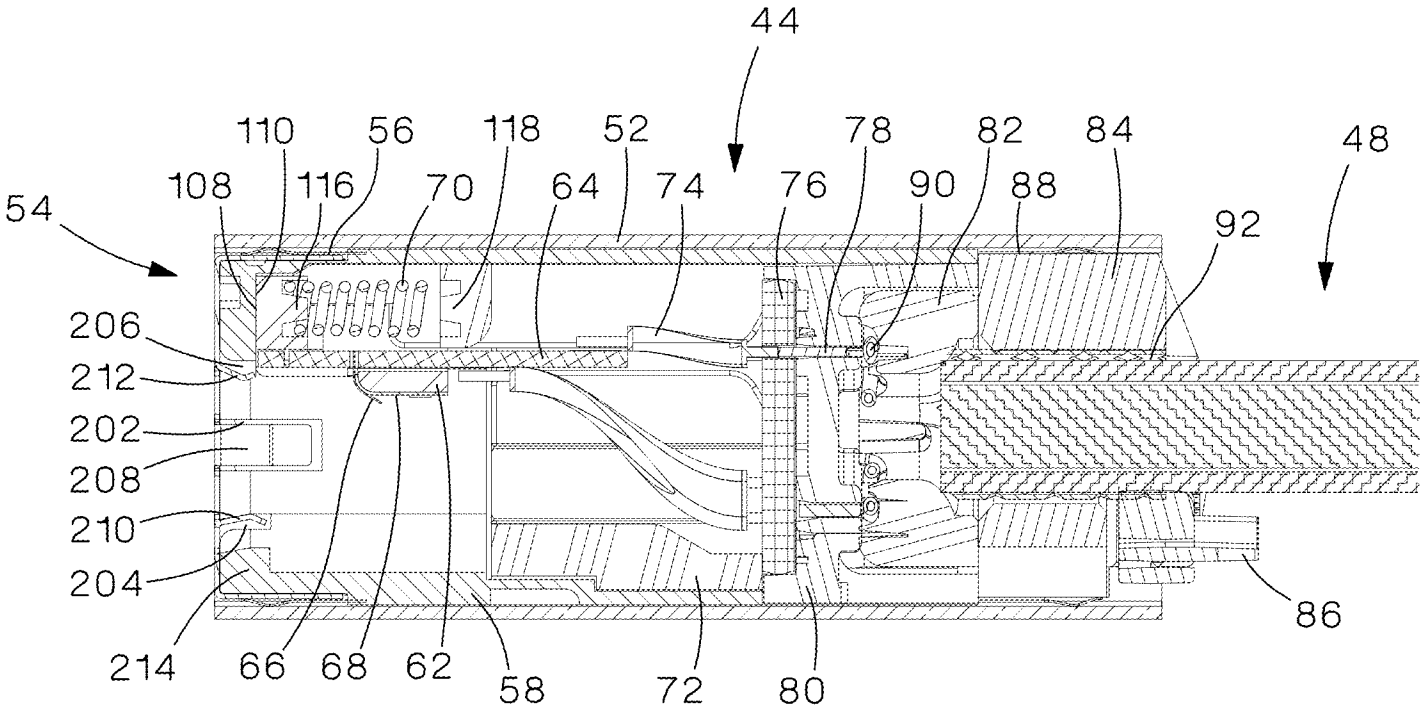
FIG. 20 illustrates a cross-section view taken along section line 20-20 of FIG. 3.

Referring now to FIGS. 18 and 19, additional details regarding the sled assembly 60 will henceforth be described. The sled assembly 60 includes support sled 62 with positioning posts 186 and positioning posts 190. Posts 186 align with positioning holes 188 of horizontal PCB 64 and posts 190 align with cutouts 192 of flexible PCB 68. This allows both the horizontal PCB 64 and flexible PCB 68 to be accurately positioned relative to the support sled 62. To allow the jack 44 to mate with a corresponding plug, PICs 66 are installed on PCB 64. While PICs 66 are shown as being soldered in via holes 194, other known methods of joining PICs to a PCB may be used, including, but not limited to, using compliant pins. Additionally, to accommodate plug combs 198 (see FIG. 3), flexible PCB 68 and support sled 62 are provided with cutouts 196 and cutouts 197, respectively. Support sled 62 further includes support ribs 200 which help ensure that PICs 66 establish a connection with contact pads on flexible PCB 68 by controlling the bend radius of PICs 66 and providing a surface against which the flexible PCB 68 can rest. A cross-section view of an assembled jack 44 is provided in FIG. 20.

Figure 21:
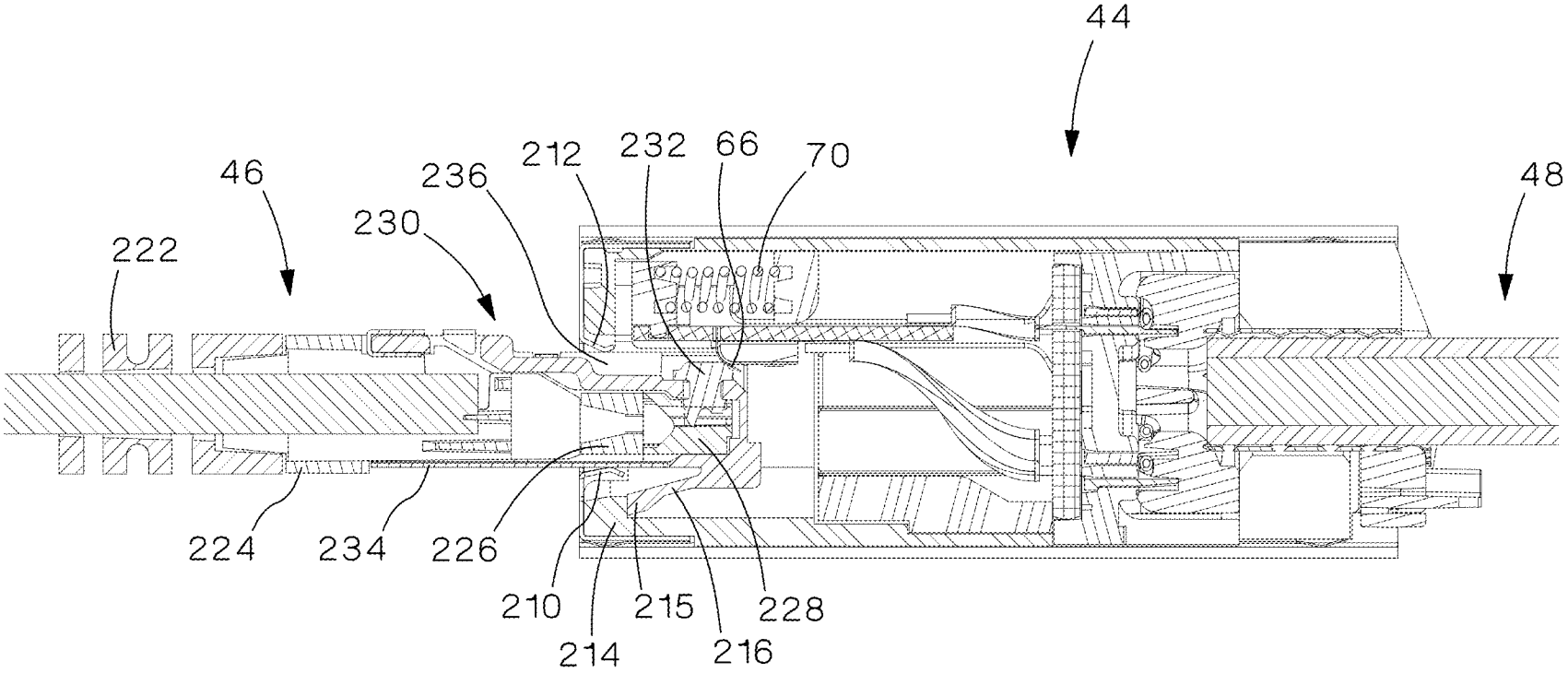
FIG. 21 illustrates a cross-section view taken along section line 21-21 of FIG. 2.
Figure 22:
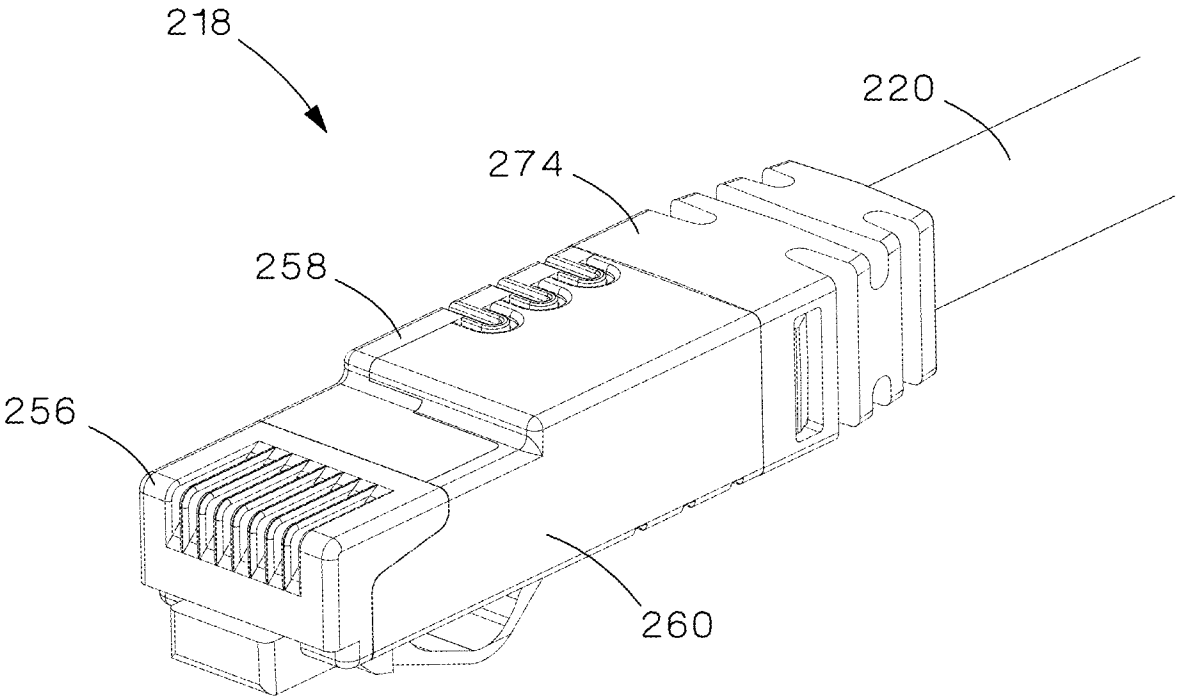
FIG. 22 illustrates a front perspective view of a communication plug according to an embodiment of the present invention.
Figure 23:
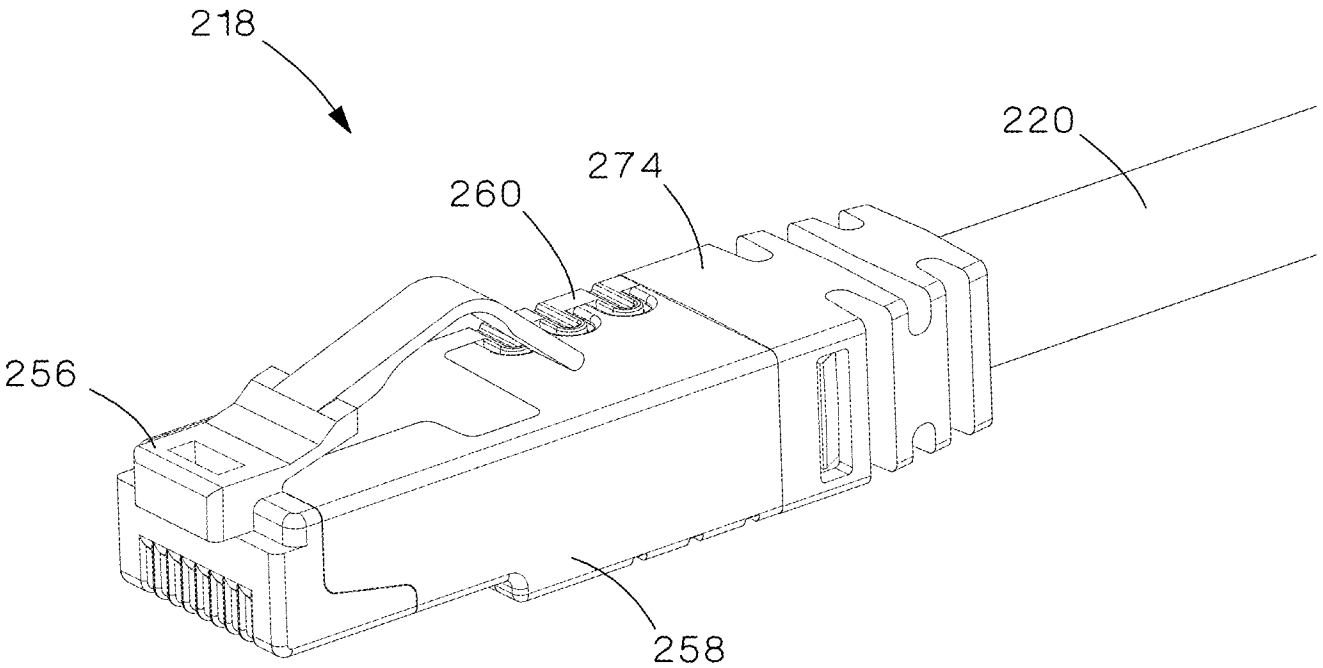
FIG. 23 illustrates a front perspective view of the plug of FIG. 22 rotated 180 degrees about the plug's central longitudinal axis.
Figure 24:
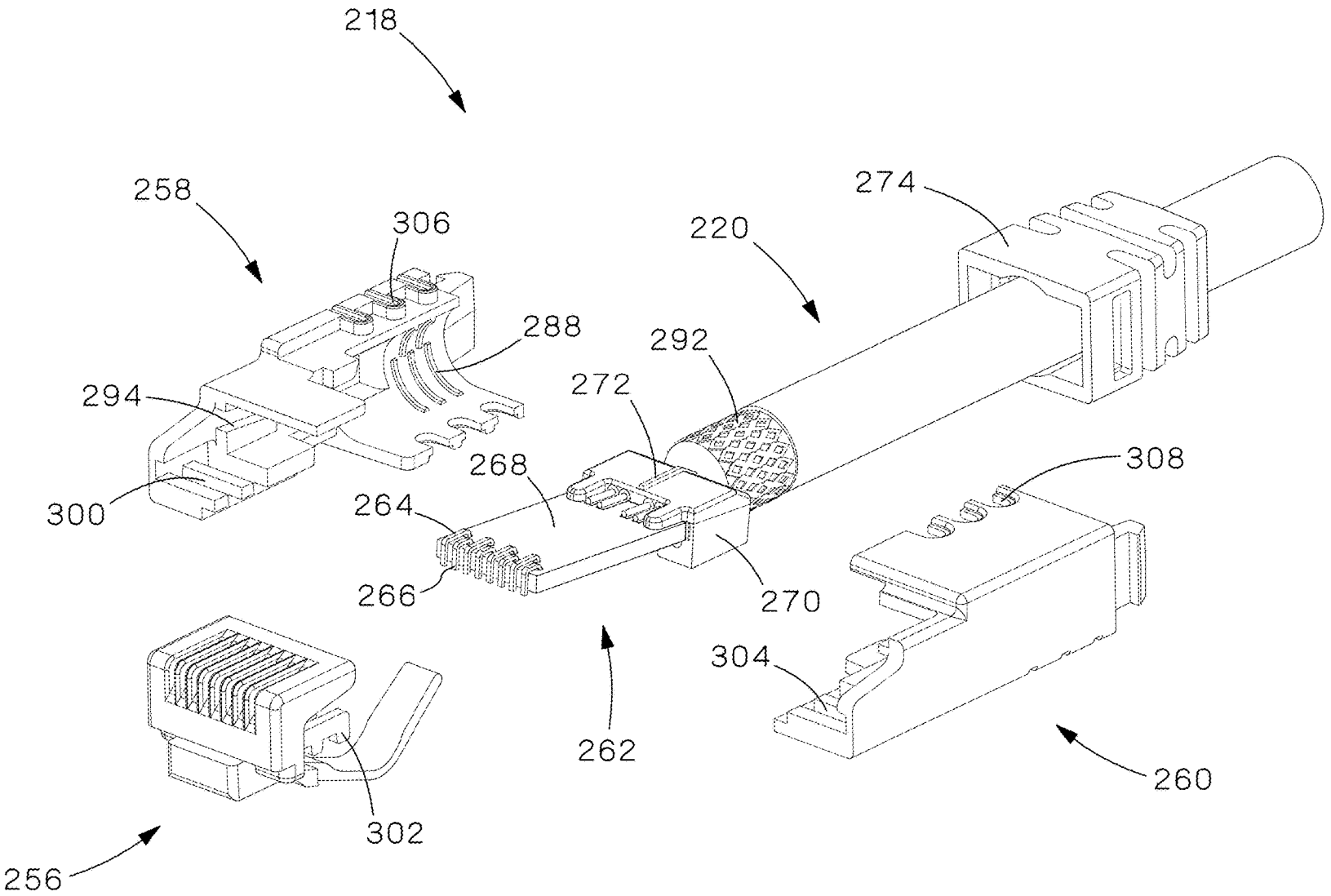
FIG. 24 illustrates an exploded front perspective view of the plug of FIG. 22.
Figure 25:
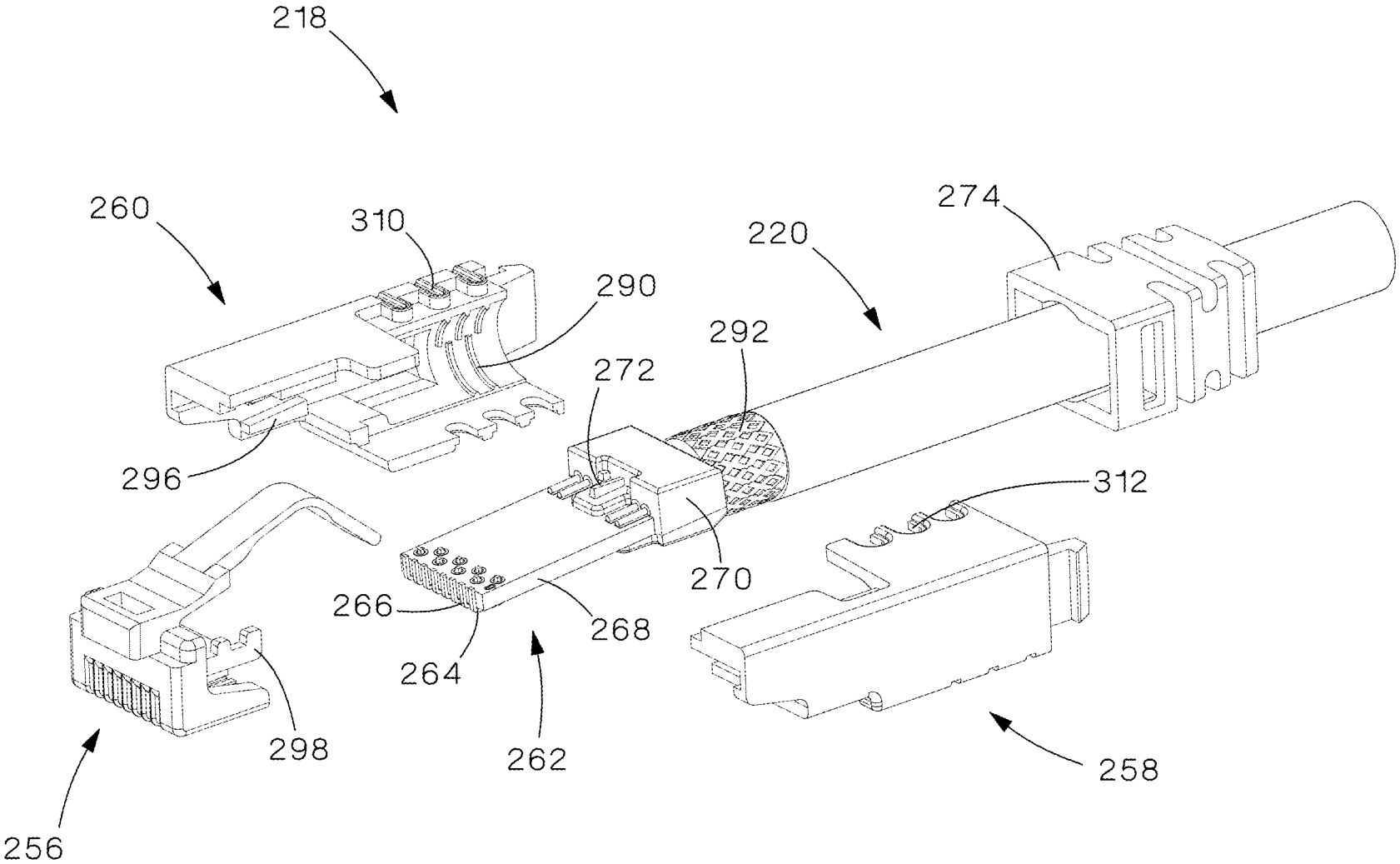
FIG. 25 illustrates an exploded front perspective view of the plug of FIG. 23.

A cross-section view of jack 44 mated with plug 46 taken along section line 21-21 of FIG. 2 (across plug latch stop 215 and jack latch stop 214) is shown in FIG. 21. RJ45 plug assembly 46 includes bend radius control boot 222, strain relief collar 224, divider 226, load bar 228, plug housing 230, plug IPCs (insulation piercing contacts) 232, and conductive shield 234. The RJ45 plug assembly 46 is inserted into plug opening 106 and the plug IPCs 232 make contact with PICs 66 of sled assembly 60. The force of springs 70 resists the insertion of RJ45 plug assembly 46, creating a normal force between plug IPCs 232 and PICs 66. Upon sufficient insertion of the RJ45 plug assembly 46 into the plug opening 106 (see FIG. 3) of the jack 44, jack latch stop 214 of jack housing 58 engages plug latch stop 215 of release latch 216. This prevents plug 46 from unintentionally disengaging from the jack 44. Furthermore, the force of springs 70 biases the RJ45 plug 46 in the direction opposite of the insertion direction, causing the plug 46 to rest in a latched rearward-biased position. This helps stabilize the distance between the crosstalk-producing circuitry within the plug 46 and any crosstalk compensation circuitry which may be present in the jack 44.

As defined in IEC 60603-7-1:2011 and IEC 60603-7-7:2010, in typical RJ45 plug/jack connector combinations there are only two contact regions between the external shield of the plug and that of the jack. In particular, these contact regions are on the sides of the plug and jack comparable to the contact of grounding flanges 208 with conductive shield 234 (see FIG. 4). However, as operating frequency of the jack increases, the shielding effectiveness requirements become more stringent. This is due to the fact that as the frequency of the signal increases, the signal will pass through smaller and smaller openings, which in turn can have a negative effect on performance parameters such as, for example, alien crosstalk and EMI susceptibility. Since the largest opening in the shield of the typical plug/jack connector combination is between the plug and the jack near the area of the jack's plug receiving aperture, in some instances it can be beneficial to reduce this opening.

The addition of grounding flanges 210 and 212 on jack 44 lessen the amount of open space around the plug opening 106. It further provides a more comprehensive grounding connection around plug opening 106. However, depending on the type of plug used, only flanges 208 and 210 might make contact with conductive shield 234, while flanges 212 fall into shielding void 236 avoiding contact with the shield of the plug assembly 46. This may reduce the overall potential for shielding effectiveness as only four of the six surfaces make contact with the plug shield 234.

Thus, shielding effectiveness of at least some embodiments of the present invention may be improved when used in conjunction with a more comprehensive shielded RJ45 plug such as plug 218 shown in FIGS. 22-28. Plug 218 includes non-conductive front housing 256, first conductive shell 258, second conductive shell 260, PCB assembly 262 (which includes wire contacts 264, wire contacts 266, PCB 268, cable over molding 270, and conductive pair manager 272), and bend radius control boot 274. Conductive shells 258 and 260 are in electrical contact with each other and are in electrical contact with the grounding element of cable 220, which may include, but are not limited to, drain wires, foils, and/or braids.

Figure 26:
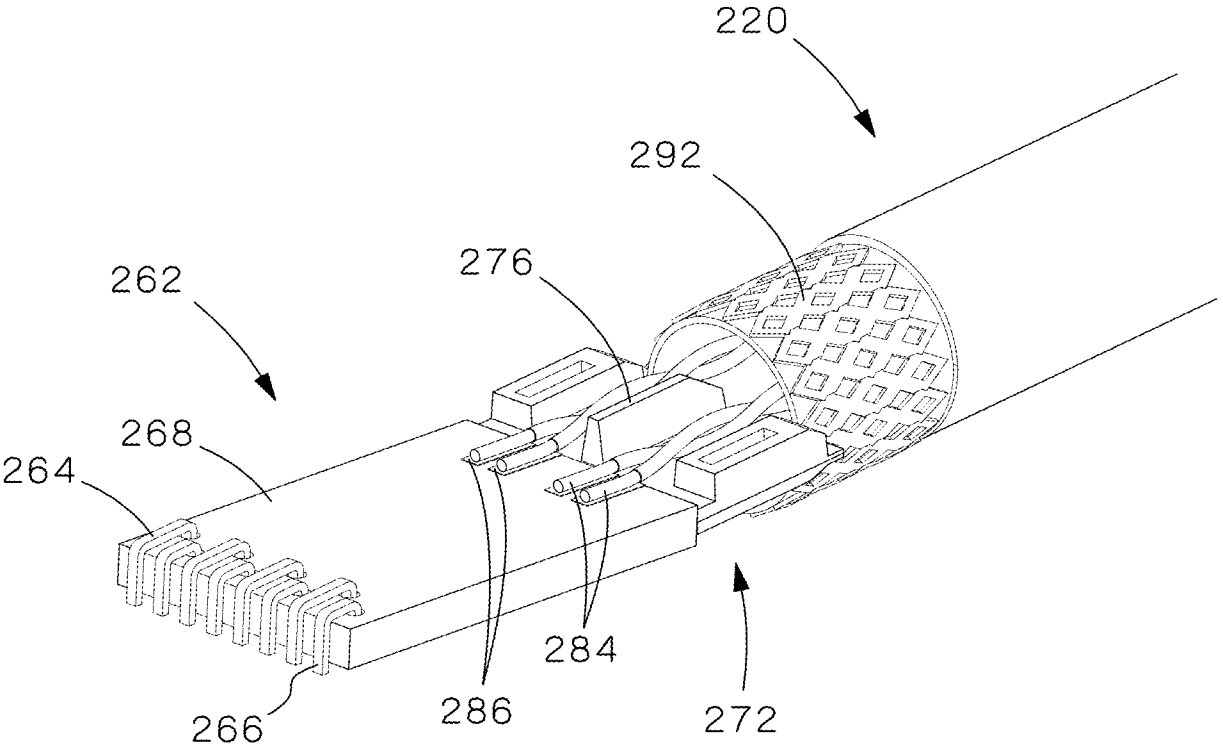
FIG. 26 illustrates a front perspective view of a printed circuit board of the plug shown in FIG. 24 attached to a communication cable.
Figure 27:
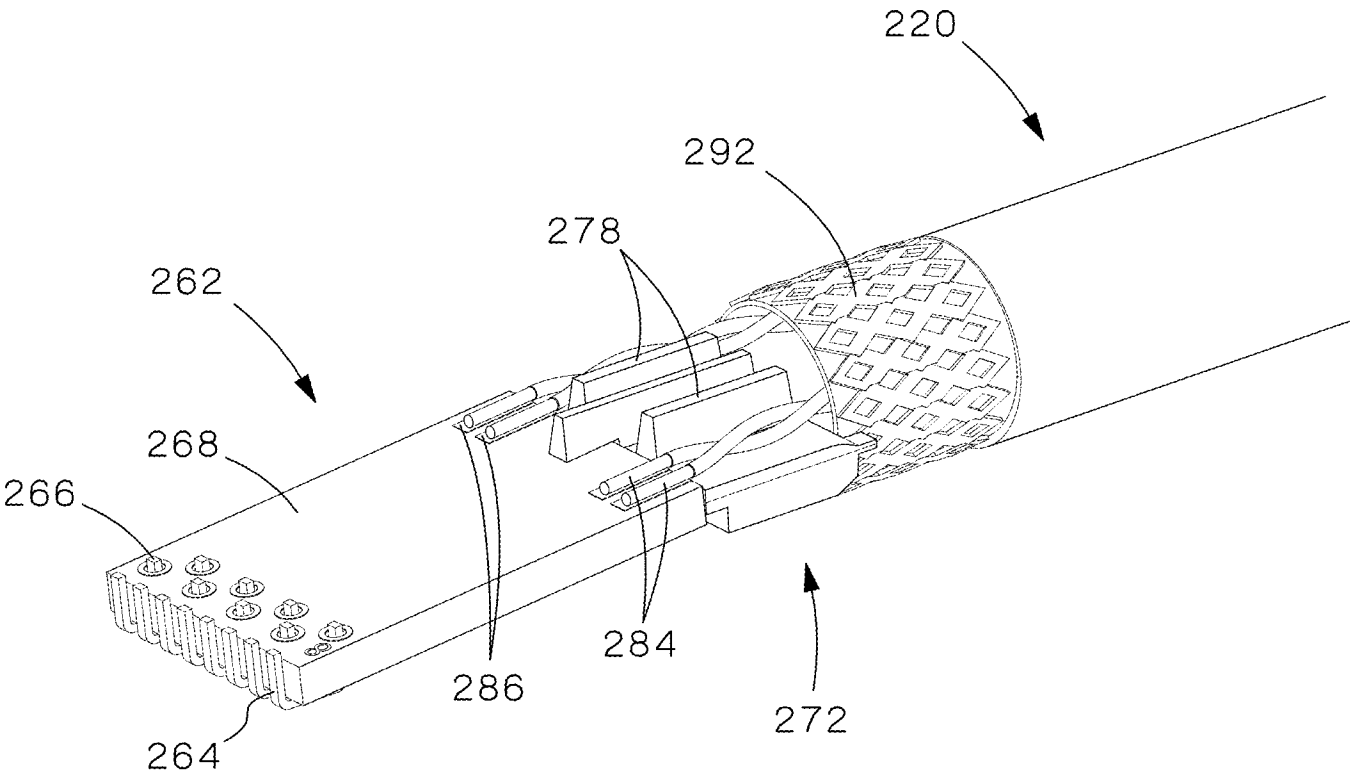
FIG. 27 illustrates a front perspective view of a printed circuit board of the plug shown in FIG. 25 attached to a communication cable.
Figure 28:
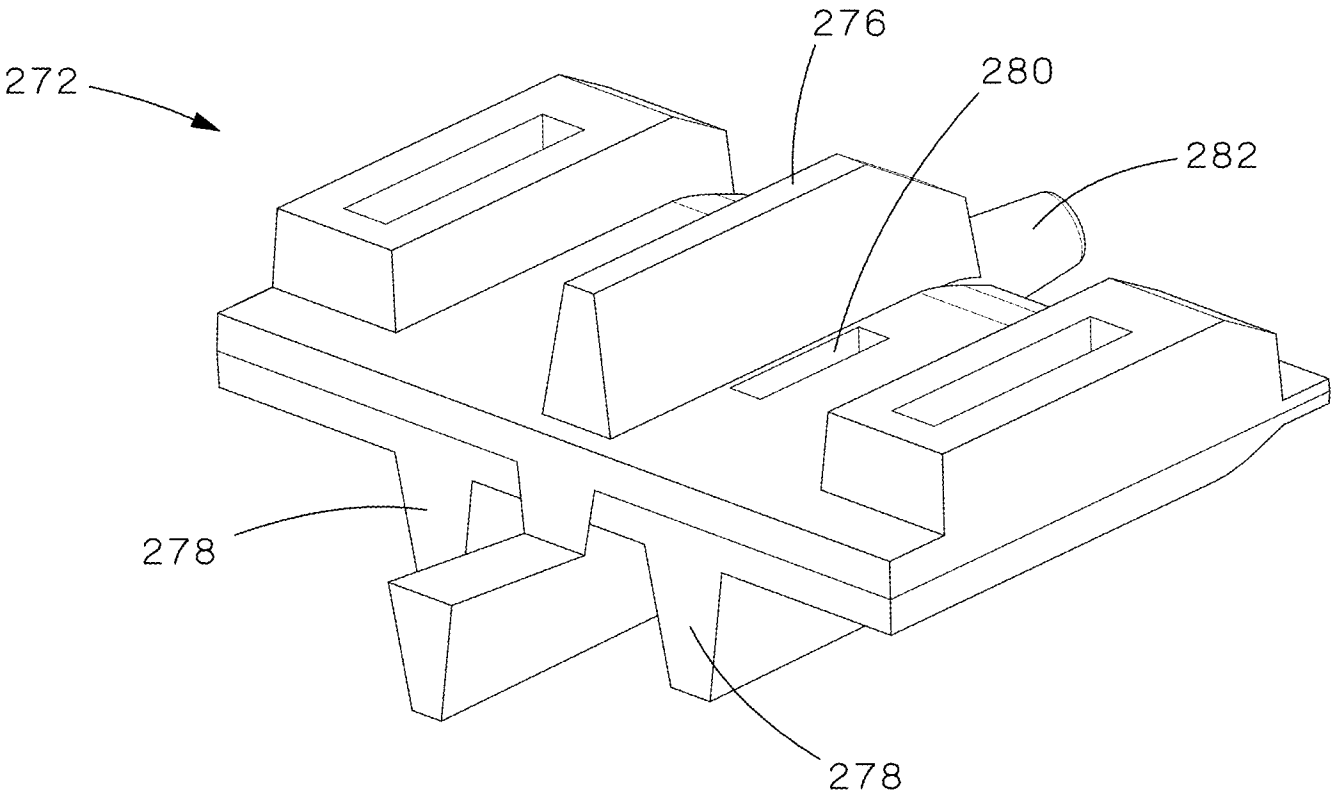
FIG. 28 illustrates a front perspective view of a cable manager of the plug of FIG. 22.

During the assembly of plug 218, bend radius control boot 274 is first positioned over cable 220. Then, as shown in FIGS. 26 and 27, each conductor pair of cable 220 is positioned in a separate electrically isolated quadrant on conductive pair manager 272. Pair manager 272 isolates each conductor pair by way of divider walls such as 276 and 278. Shown also are pockets 280 that allow for greater adhesion of over molding 270 without sacrificing electrical isolation. Simultaneously, post 282 is positioned into cable 220 to ease assembly and positioning of pair manager 272 relative to cable 220. Thereafter, conductors 284 of cable 220 are attached to PCB 268 through pads 286. Conductors 284 are shown attached to PCB 268 through a soldered connection; however other non-limiting means of connecting conductors to a PCB may be used, including, but not limited to, providing a plurality of IDCs which are positioned in the PCB 268 and make contact with the conductors 284.

To provide added strain relief and more location stability with respect to conductors 284 over time, cable over molding 270 solidifies the location of conductors 284. After the conductors are connected to the PCB, the PCB is placed into the front housing 256. Thereafter, the first shell 258 and second shell 260 close over front housing 256. In this process, ribs 288 and ribs 290 compress braid 292 of cable 220 which makes an electrical connection to ground through cable 220, and rails 294 and 296 support PCB 268 ensuring that it remains properly positioned. Front housing 256 secures to first shell 258 through latches 298 that rest in pockets 300, and to second shell 260 through latches 302 that rest in pockets 304.

The first and second shells 258 and 260 secure to each other by way of staking posts 306 and 310 which align with pockets 308 and 312, respectively. The posts and pockets 306-312 which secure both shells together are provided near the corners of said shells such that when joined together, each post/pocket combination is off-center relative to sagittal and transverse planes of the plug 218 which coincide with the cable 220 axis. This configuration may be beneficial by providing additional support for more efficient staking. That is since the staking features are positioned along the sides which have greater physical resilience, less structural concerns may arise during manufacturing. Furthermore, avoiding centerline sagittal and/or transverse seams can enable the thickness of the plug shell to remain relatively high along those centerlines, maintaining improved EMI properties while providing greater structural rigidity.

Figure 29:
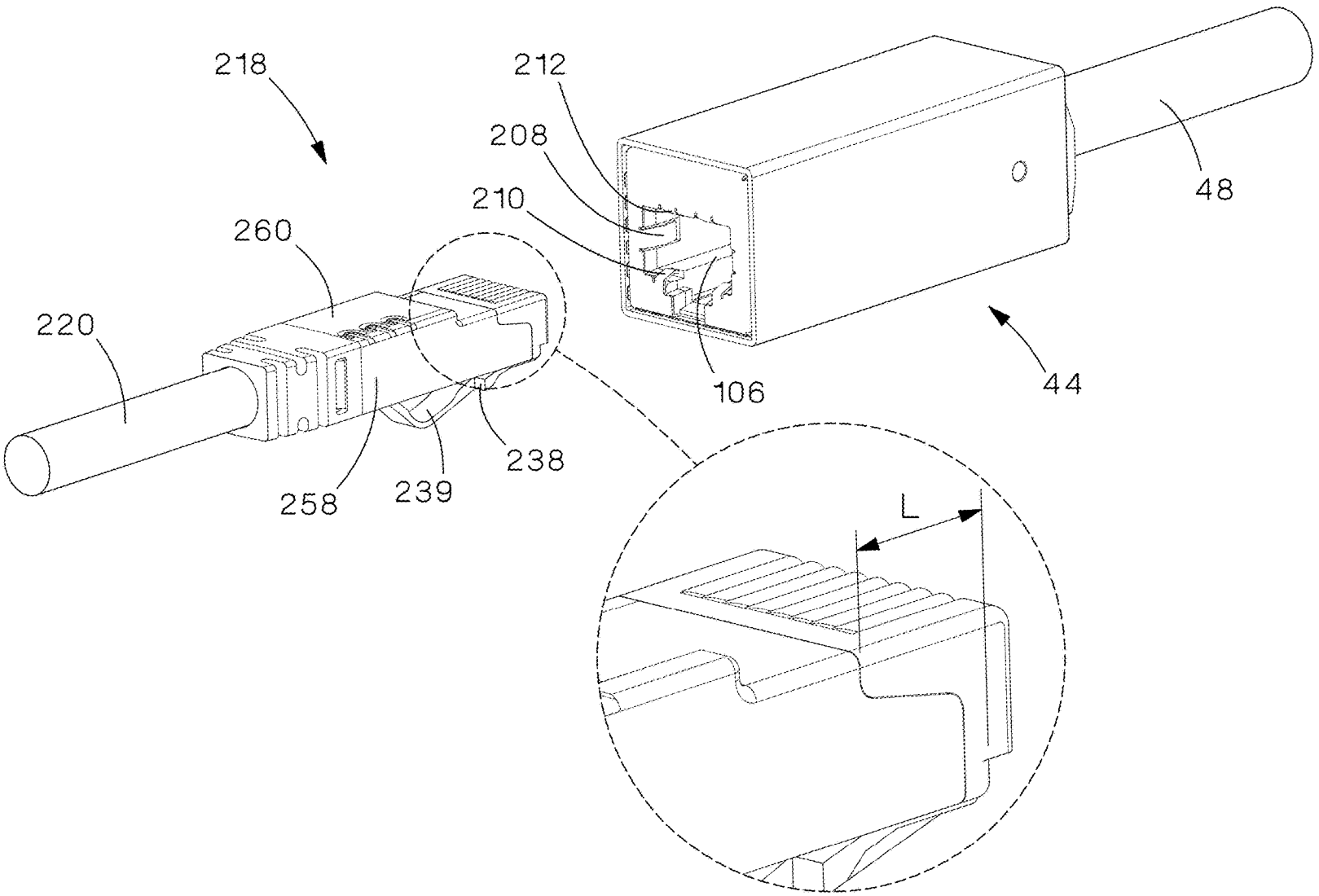
FIG. 29 illustrates a plug/jack combination in an unmated state according to an embodiment of the present invention.
Figure 30:
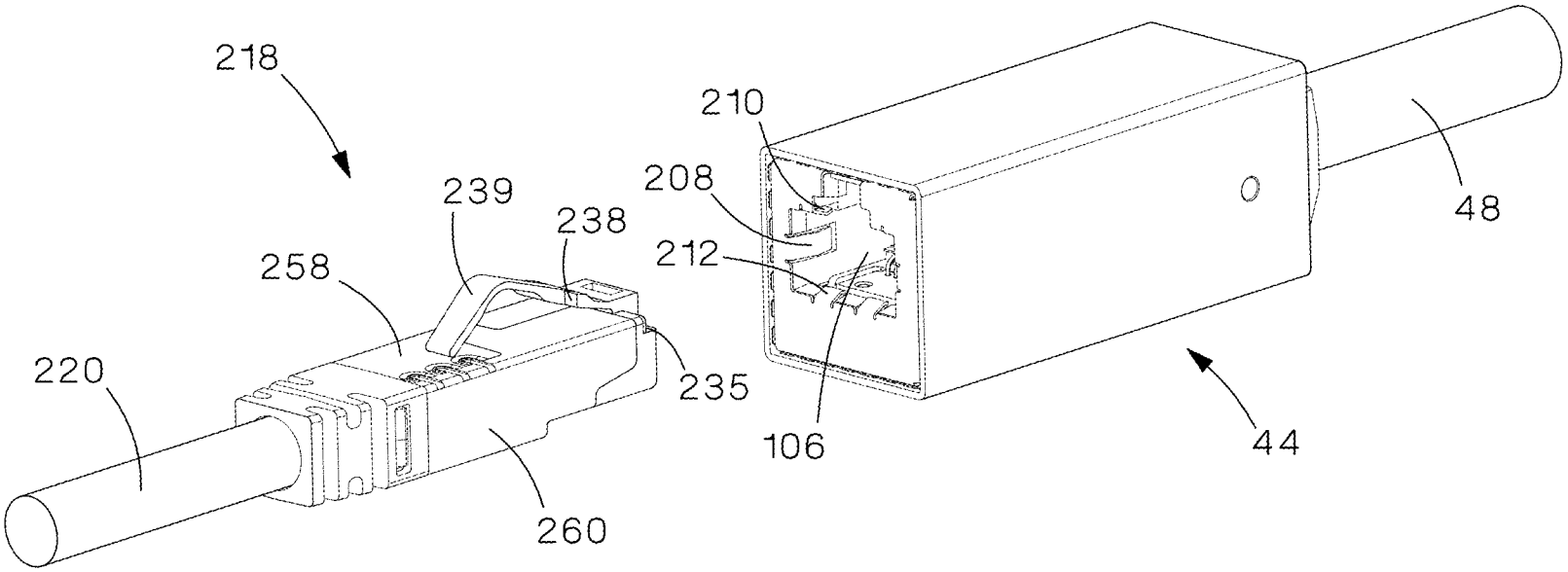
FIG. 30 illustrates the plug/jack combination of FIG. 29 rotated 180 degrees about the plug/jack's central longitudinal axis.
Figure 31:
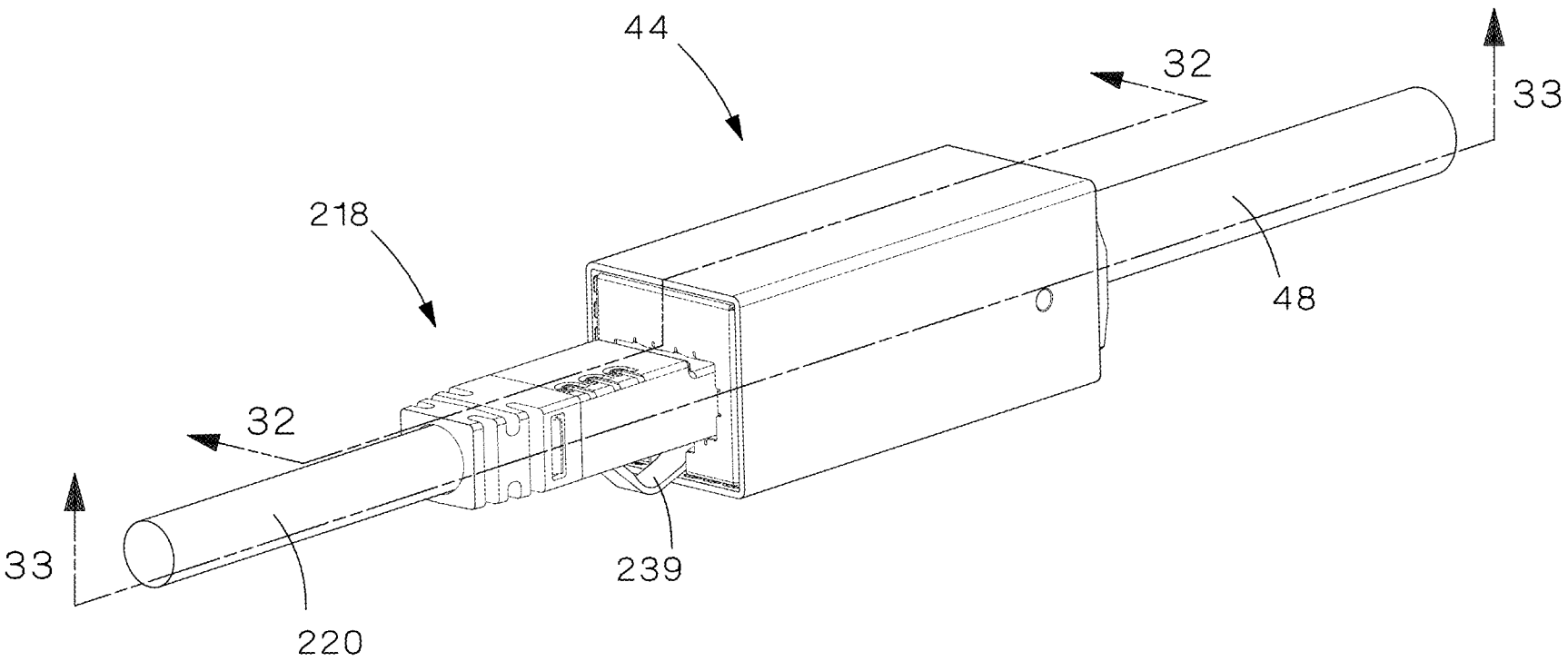
FIG. 31 illustrates the plug/jack combination of FIG. 29 in a mated state.
Figure 32:
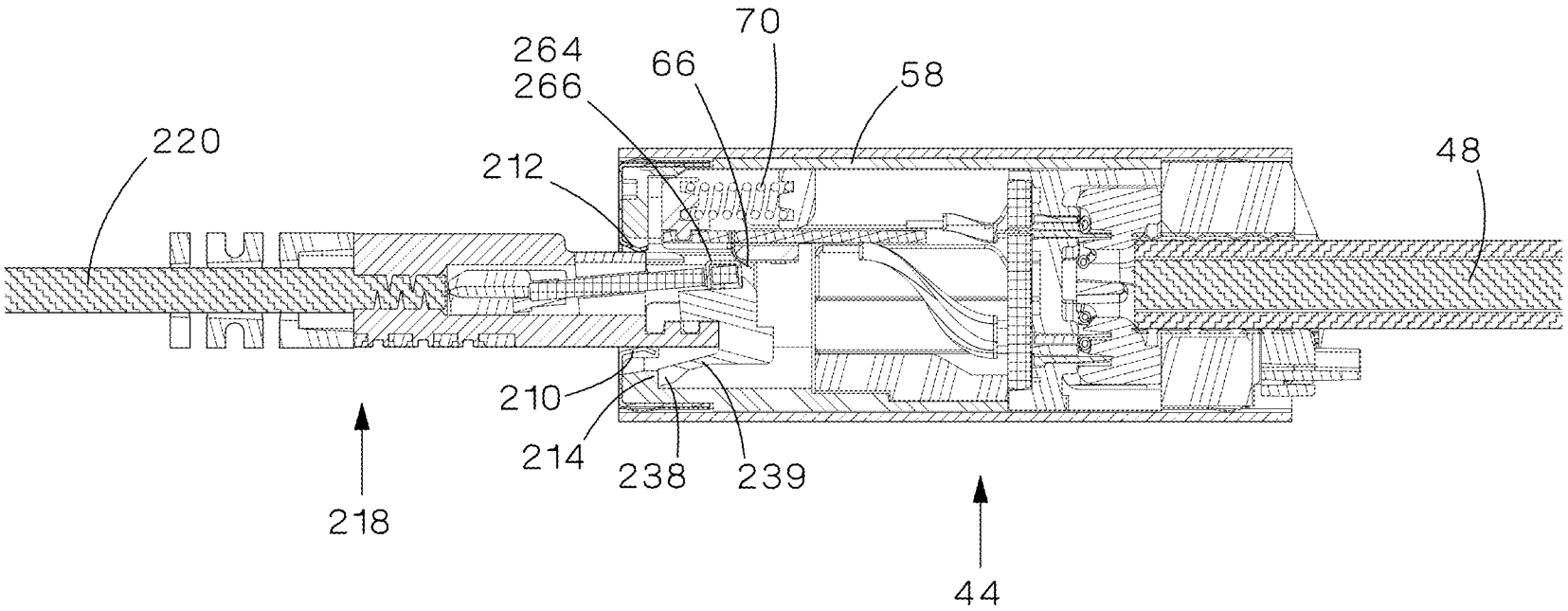
FIG. 32 is a cross-section view taken along section line 32-32 of FIG. 31.
Figure 33:
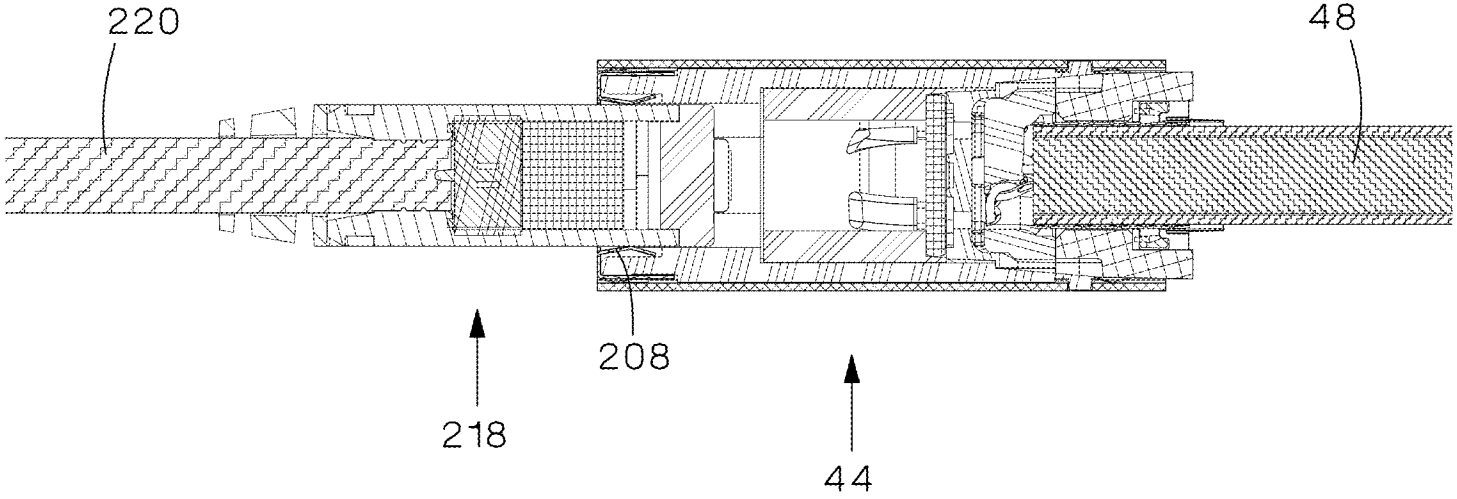
FIG. 33 is a cross-section view taken along section line 33-33 of FIG. 31.
Figure 34:
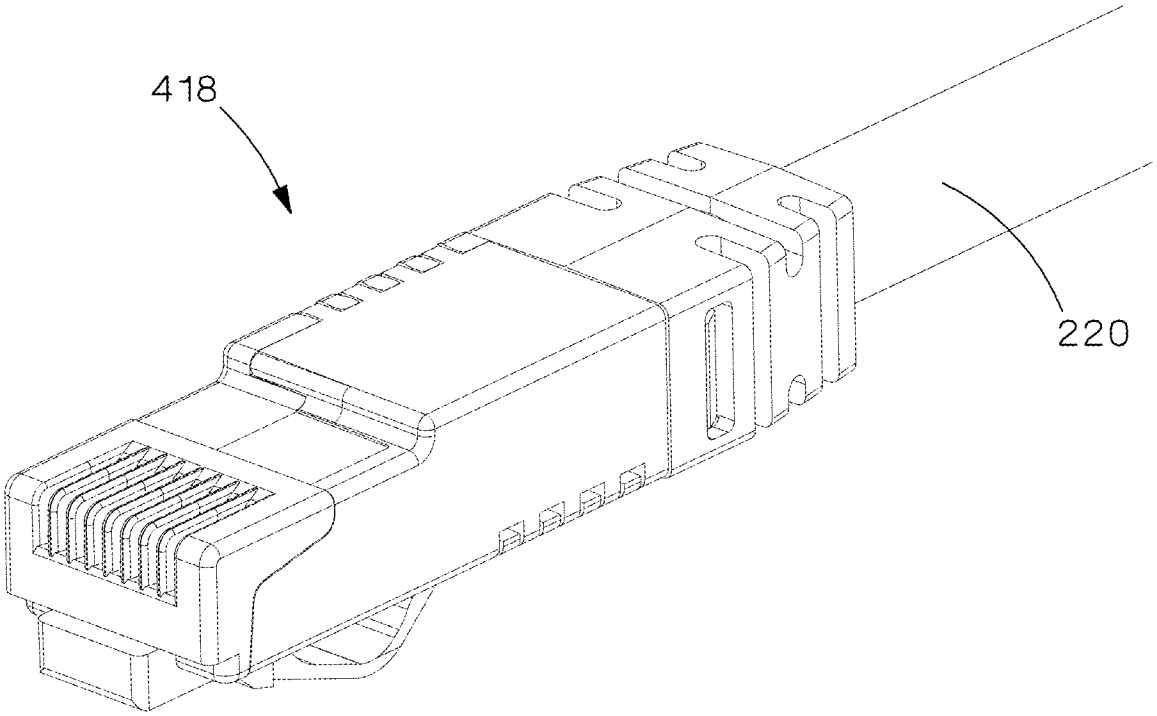
FIG. 34 illustrates a front perspective view of a communication plug according to an embodiment of the present invention.
Figure 35:
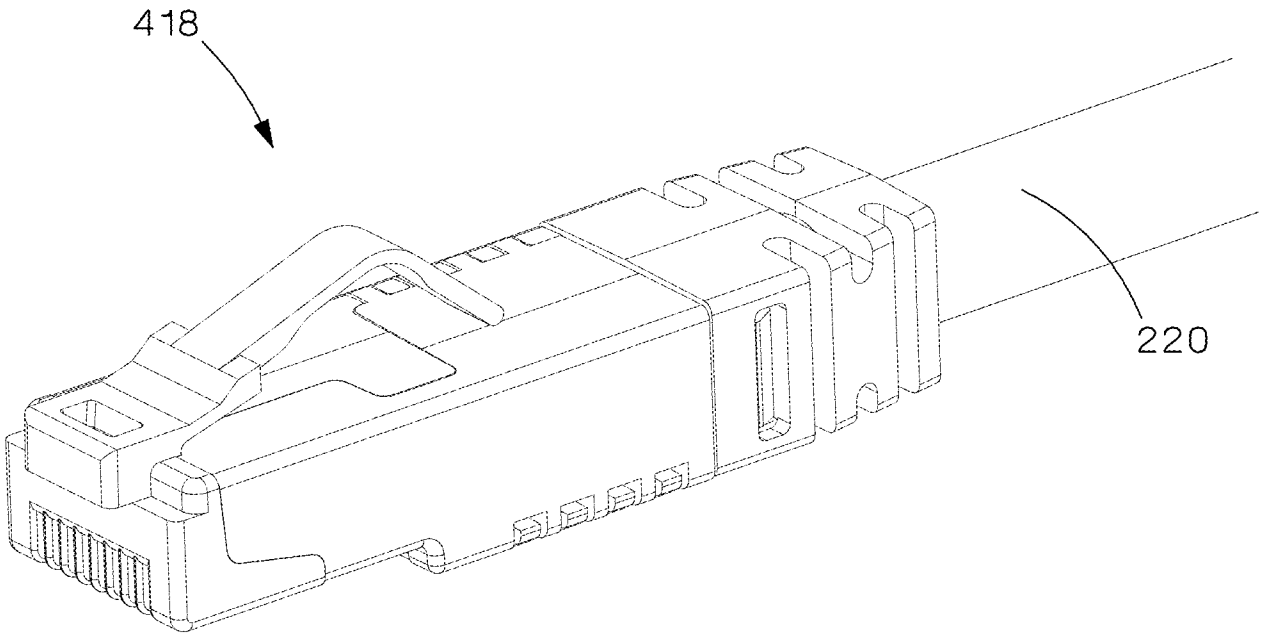
FIG. 35 illustrates a front perspective view of the plug of FIG. 34 rotated 180 degrees about the plug's central longitudinal axis.
Figure 36:
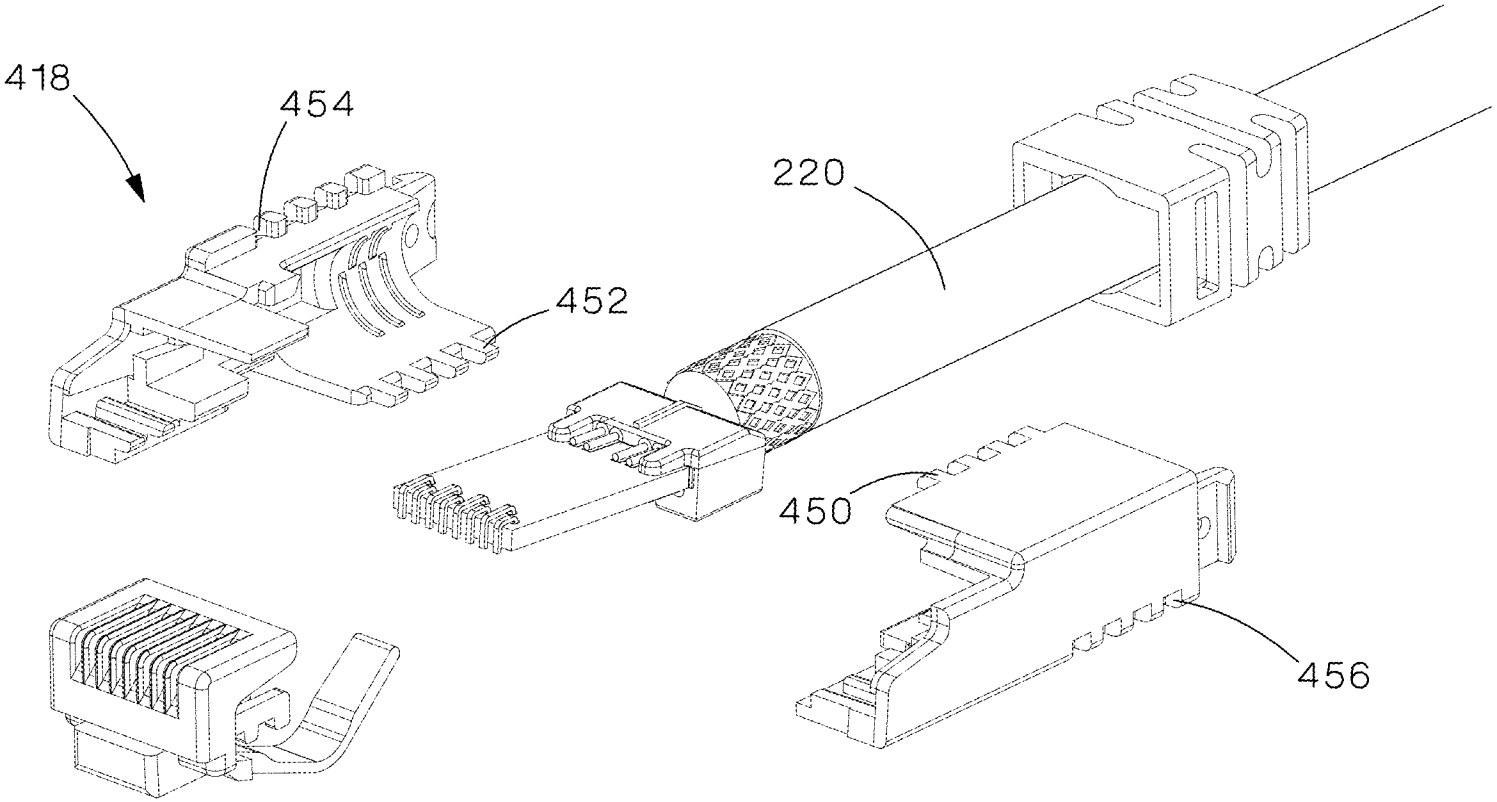
FIG. 36 illustrates an exploded front perspective view of the plug of FIG. 34.
Figure 37:
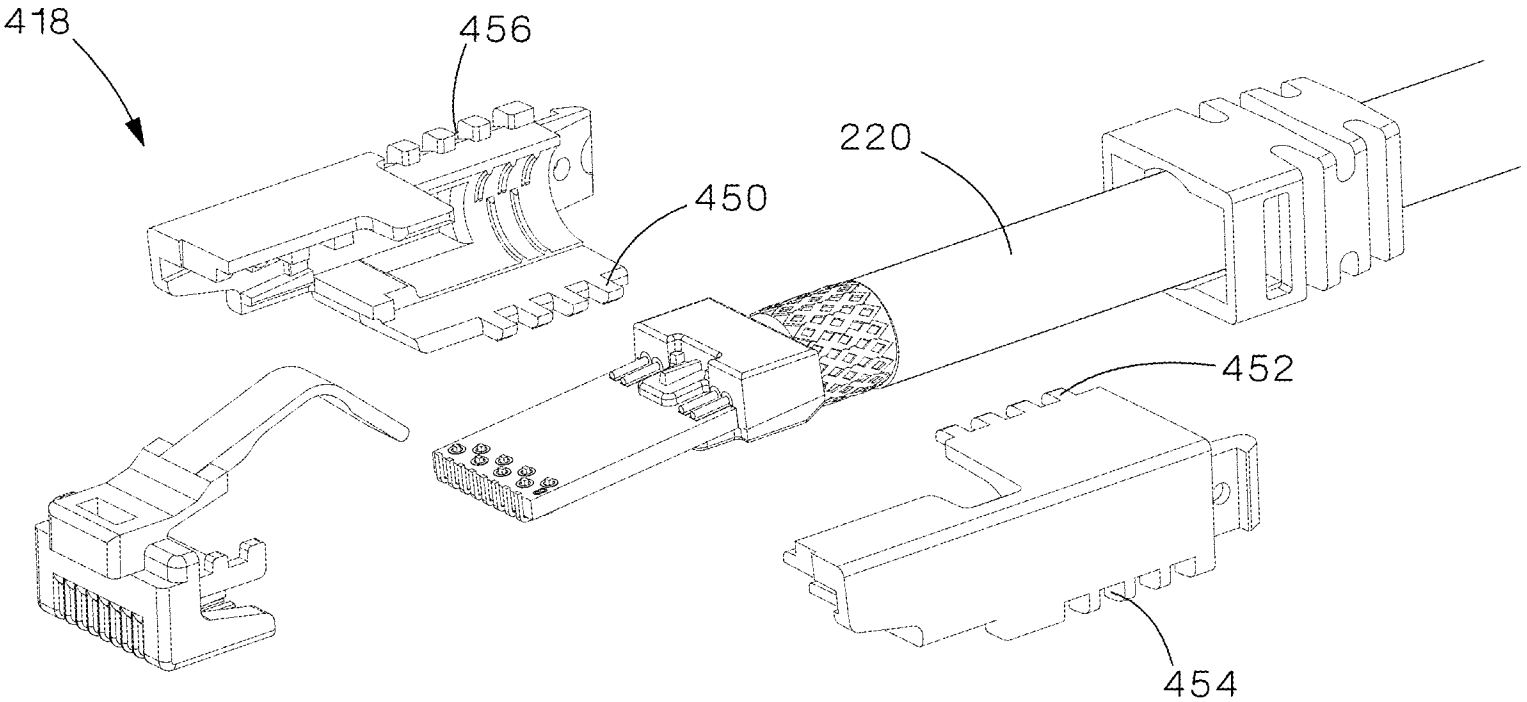
FIG. 37 illustrates an exploded front perspective view of the plug of FIG. 35.

The advantage of using corresponding RJ45 plug 218 with jack 44 can be seen in FIGS. 29-33, where FIGS. 29 and 30 illustrate an isometric view of the jack 44 and plug 218 prior to mating, FIG. 31 illustrates the same jack 44 and plug 218 after mating, and FIGS. 32 and 33 illustrate cross-section views taken along section lines 32-32 and 33-33 of FIG. 31, respectively. As plug assembly 218 is inserted into plug opening 106, plug contacts 264, 266 make contact with PICs 66 of sled assembly 60. The force of springs 70 resists the insertion of plug assembly 218, creating a normal force between plug contacts 264, 266 and PICs 66. Upon sufficient insertion of the plug assembly 218 into the plug opening 106 of the jack 44, jack latch stop 214 of jack housing 58 engages plug latch stop 238 of release latch 239. This prevents plug 218 from unintentionally disengaging from the jack 44. Furthermore, the force of springs 70 biases the plug 218 in the direction opposite of the insertion direction, causing the plug 218 to rest in a latched rearward-biased position. This helps stabilize the distance between the crosstalk-producing circuitry within the plug 218 and any crosstalk compensation circuitry which may be present in the jack 44.

Unlike the previously described embodiment where the RJ45 plug assembly 46 engaged flanges 208 and 210, when the plug assembly 218 is inserted into jack 44 and rested in a latched position, its conductive shielding portions makes contact with grounding flanges 208, 210, and 212. This is achieved by having the conductive area which forms a portion of the plug's shield along the bottom of said plug (i.e., along the side opposite of the release latch 239) be present at least 6.5 to 6.7 mm away from the stop face 235 of the plug 218. Note that this distance is measured along the longitudinal plane and is denoted as "L" in the detailed view of FIG. 29. As a result, the first conductive shell 258 of the plug 218 make contact with one ground flange 208, one ground flange 210, and both ground flanges 212; and second conductive shell 260 of the plug 218 make contact with one ground flange 208 and one ground flange 210.

An alternate embodiment of a plug 418 is shown in FIGS. 34-37. The plug 418 differs from plug 218 in that it includes solid, semi-rectangular staking features 450 and 452 which interface with respective staking slots 454 and 456. This configuration may reduce the need for thin-walled material in the plug shell.

Figure 38:
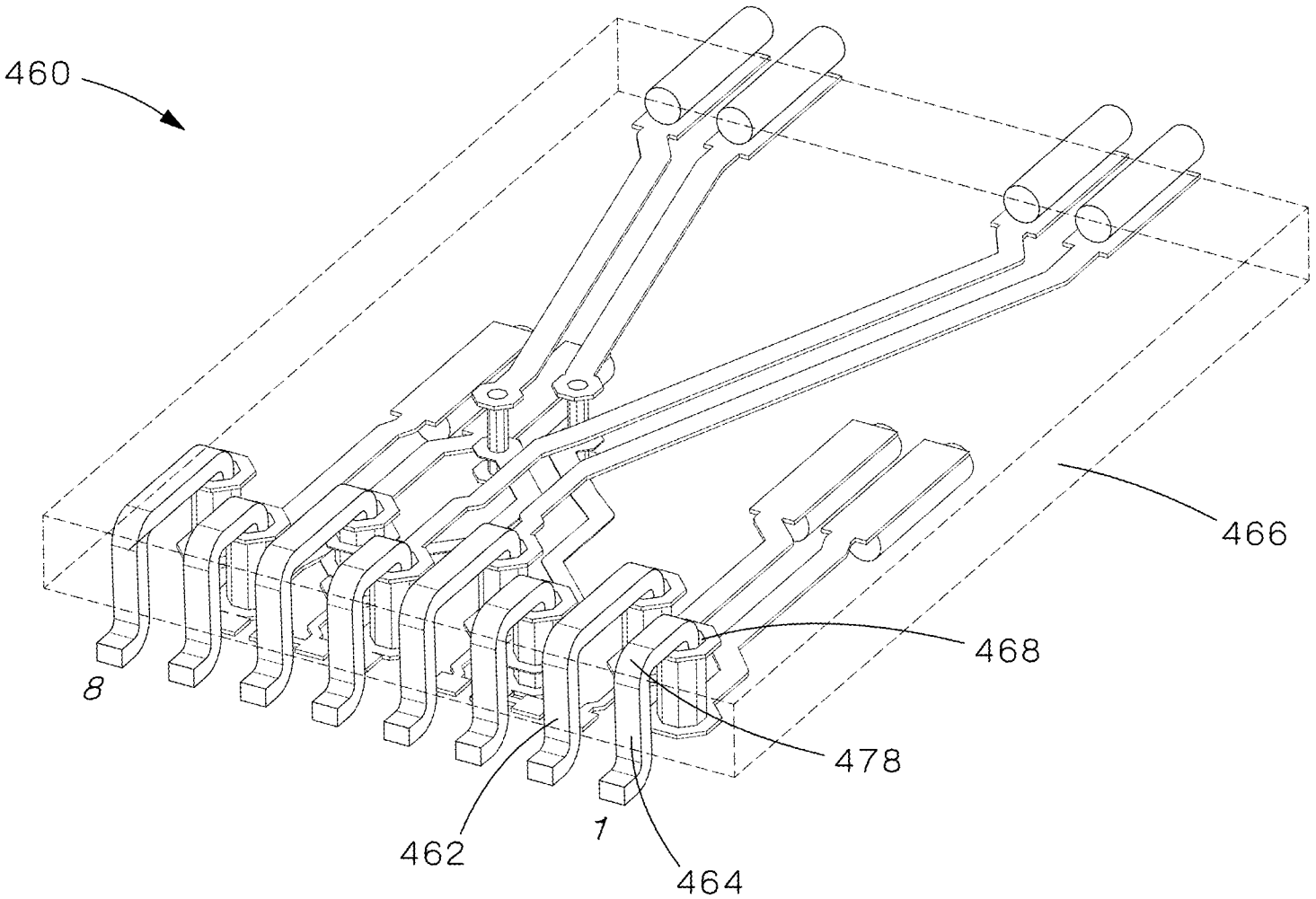
FIGS. 38-40 illustrate a plug PCB assembly in accordance with an embodiment of the present invention.
Figure 39:
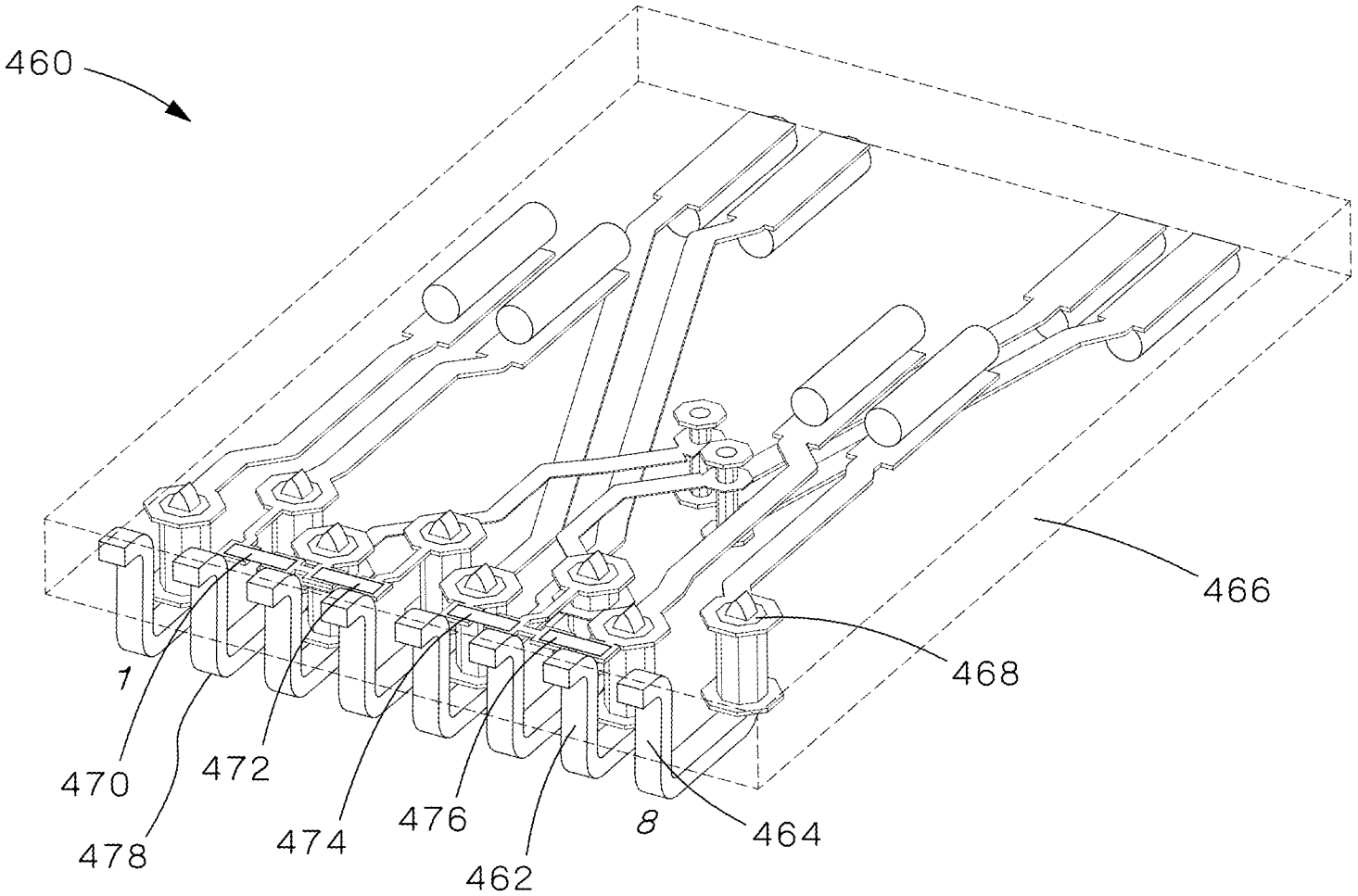
Figure 40:
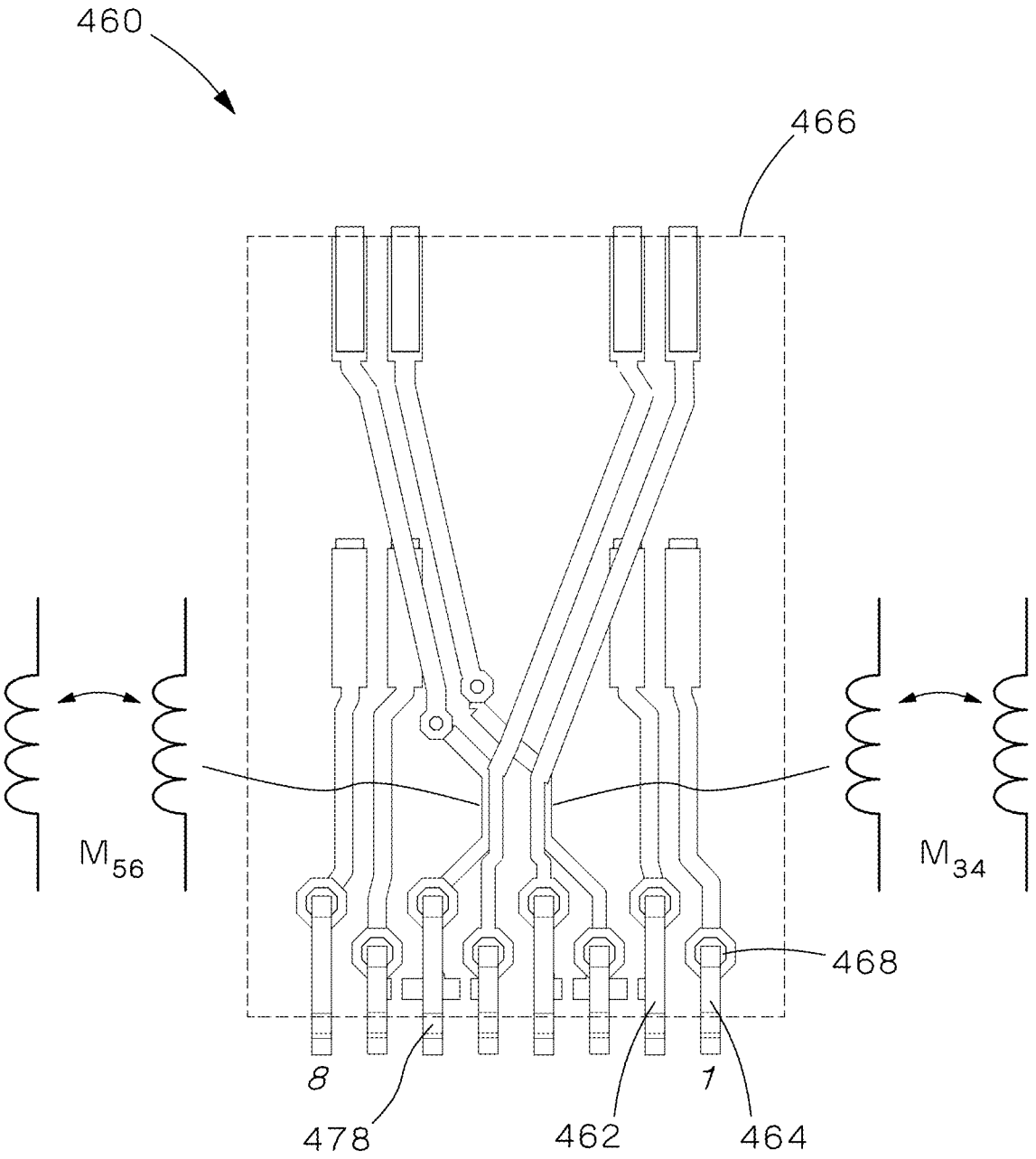

In an embodiment, the communication plugs described herein may be paired with a PCB shown in FIGS. 38-40 with FIG. 38 showing a front top trimetric view of PCB assembly 460, FIG. 39 showing a front bottom trimetric view of PCB assembly 460, and FIG. 40 showing a wire frame top view of PCB assembly 460. Wire contacts 462 and 464 mechanically and electrically join PCB 466 by plated through holes 468. Wire contacts 462 and 464 are relatively small in profile to reduce electromagnetic coupling between adjacent wire contacts of neighboring pairs such as pairs 1:2 and 3:6. By reducing coupling between neighboring wire contacts, additional coupling can be added in a strategic manner between non-neighboring wire contacts to provide balanced crosstalk between pairs. Due to the small size of the contacts, there might not be enough electromagnetic coupling between pairs to satisfy crosstalk magnitude range requirements of ANSI/TIA-568-C.2. Therefore, additional crosstalk coupling elements are implemented on PCB 466. It is desirable to locate the crosstalk coupling elements as close to the plug/jack mating interface as reasonably possible to enable optimal NEXT (near-end crosstalk) and FEXT (far-end crosstalk) cancellation ability of a mated jack. FIG. 39 shows additional crosstalk coupling 470, 472, 474, 476 added to PCB 466 with capacitor 470 being positioned between conductors 2 and 3, capacitor 472 being positioned between conductors 3 and 4, capacitor 474 being positioned between conductors 5 and 6, and capacitor 476 being positioned between conductors 6 and 7. The positioning of the capacitors is selected such that each capacitor is located relatively close to the plates through hole 37, bringing them overall closer to the mating interface 478.

The capacitor values can be selected depending on the target NEXT and FEXT performance that is desired. Capacitors can be a discrete component capacitor, such as a surface mount or other component capacitor, as in FIG. 39, embedded capacitors designed into one or more layers on PCB 466, or generated by some other non-limiting means such as distributed capacitance. Furthermore, to maintain a balanced load and/or to minimize mode conversion (differential mode to common mode or common mode to differential mode conversion) capacitors of the same wire-pair combination (e.g., wire-pair combination 4:5-3:6) may have same or similar magnitudes. To meet the ANSI/TIA-568-C.2 FEXT range requirements, a level of inductive crosstalk coupling is required in addition to the capacitive crosstalk coupling. As a signal propagates along the 3:6 pair and/or the 4:5 pair, a magnetic field is generated proportional to the current flowing in the conductors. Due to the arrangement and proximity of the conductors, the magnetic field created from the current in conductor 3 induces a current in conductor 4 and the current in conductor 6 induces a current in conductor 5. Conversely, the magnetic field created from the current in conductor 4 induces a current in conductor 3 and the current in conductor 5 induces a current in conductor 6. The net result is inductive crosstalk between the 4:5 and 3:6 differential pairs. FIG. 40 shows inductive coupling M34 occurring between trace 3 and trace 4 and inductive coupling M56 occurring between trace 5 and trace 6. Inductive coupling M56 is approximately the same magnitude as inductive coupling M34. This helps maintain a balanced load and reduces mode conversion. The inductive coupling is still desired to be close to mating interface 478 to minimize the distance to the compensation in a jack. The level of inductive coupling can be adjusted to a desired level by a variety of ways, such as trace width, spacing and board thickness, or other non-limiting means. The inductor values can and will vary depending on the target NEXT and FEXT performance. The relative closeness of plug's inductive and capacitive coupling to mating interface 478 aids in meeting the NEXT and FEXT requirements when mated with a corresponding jack. Inductive crosstalk coupling can be added to any or all six possible pair combinations (e.g., 3:6-1:2, 3:6-7:8) in an RJ45 mated connection to meet the ANSI/TIA-568-C.2 NEXT and FEXT requirements.

Figure 41:
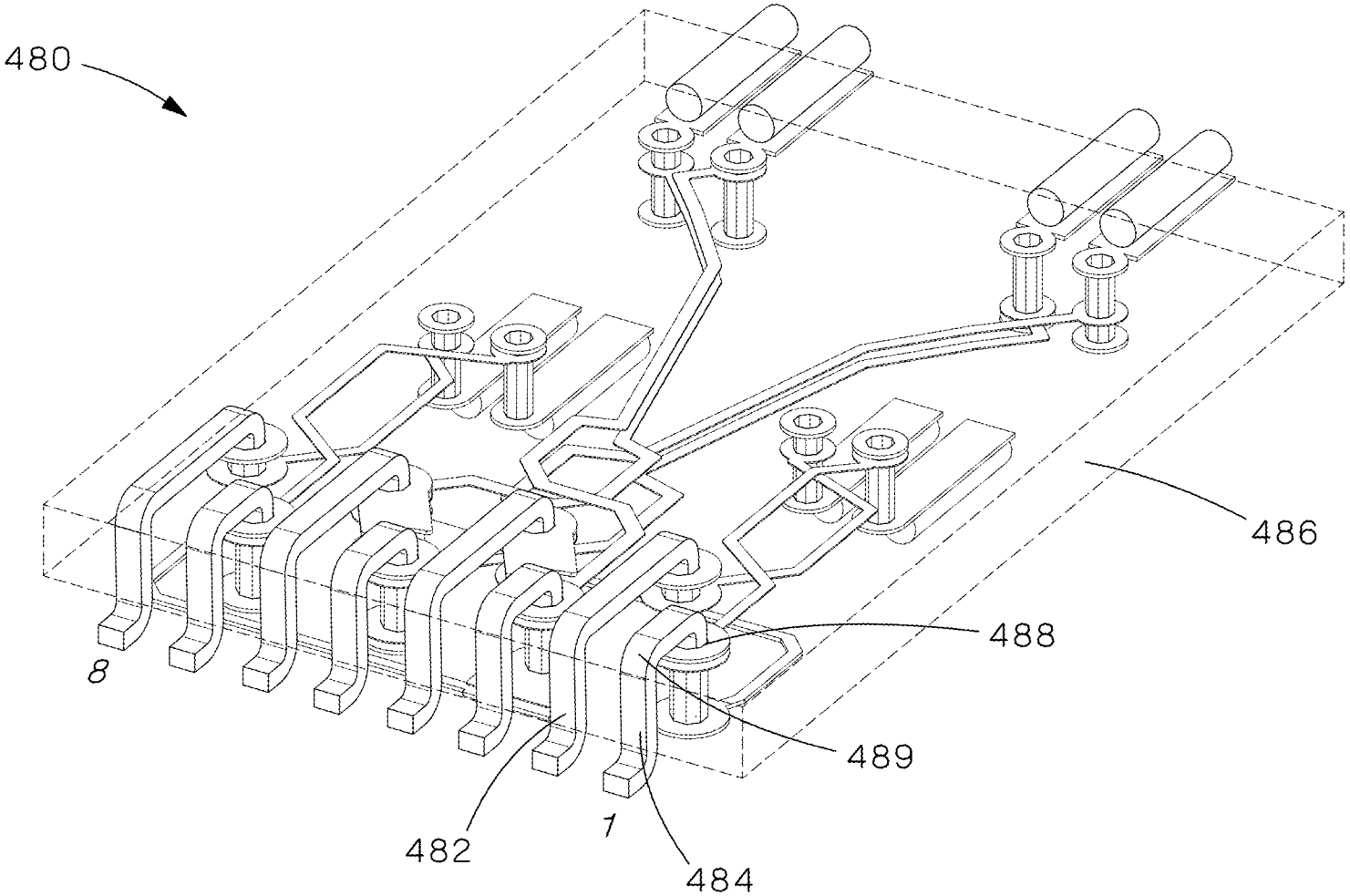
FIGS. 41-43 illustrate a plug PCB assembly in accordance with an embodiment of the present invention.
Figure 42:
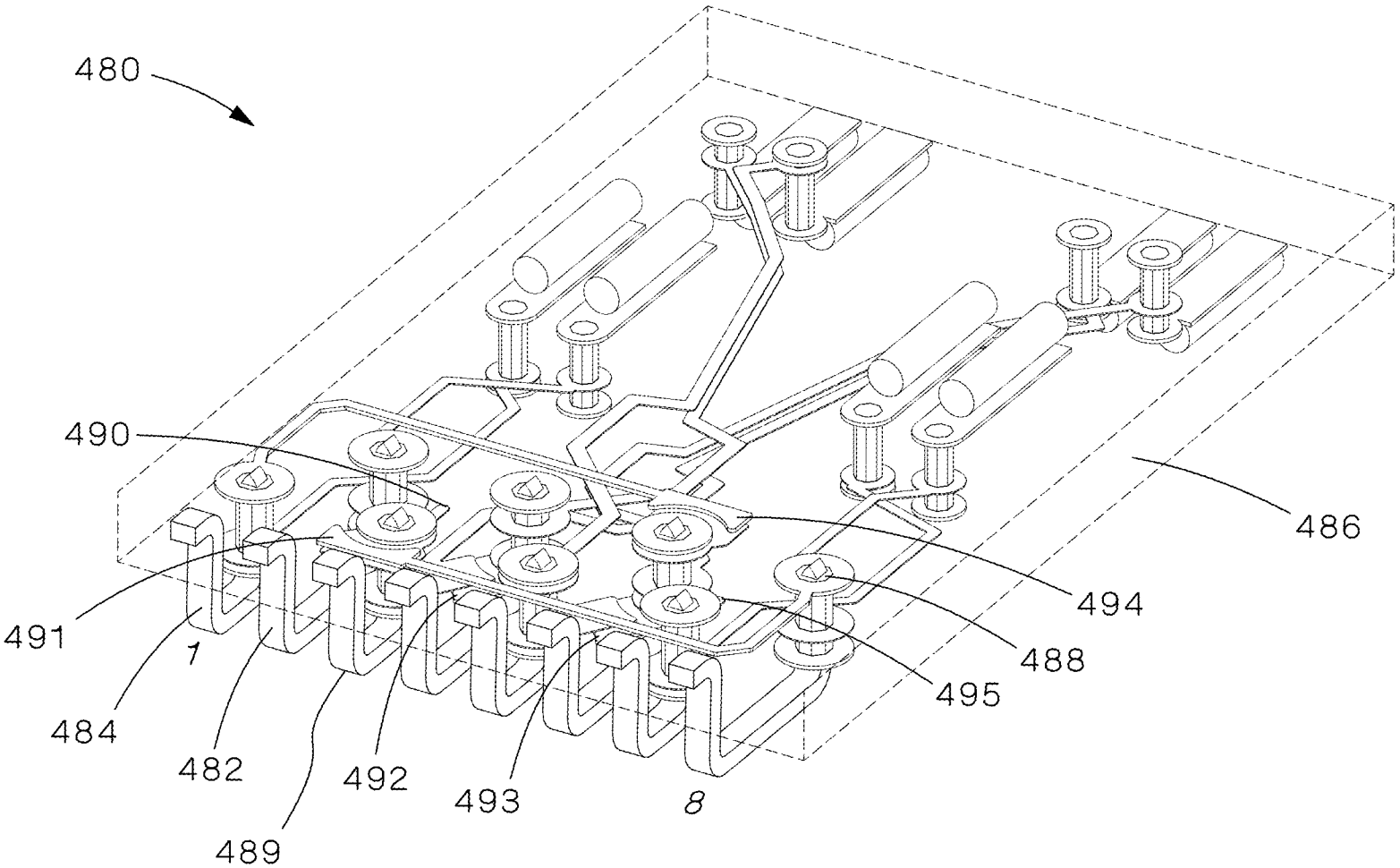
Figure 43:
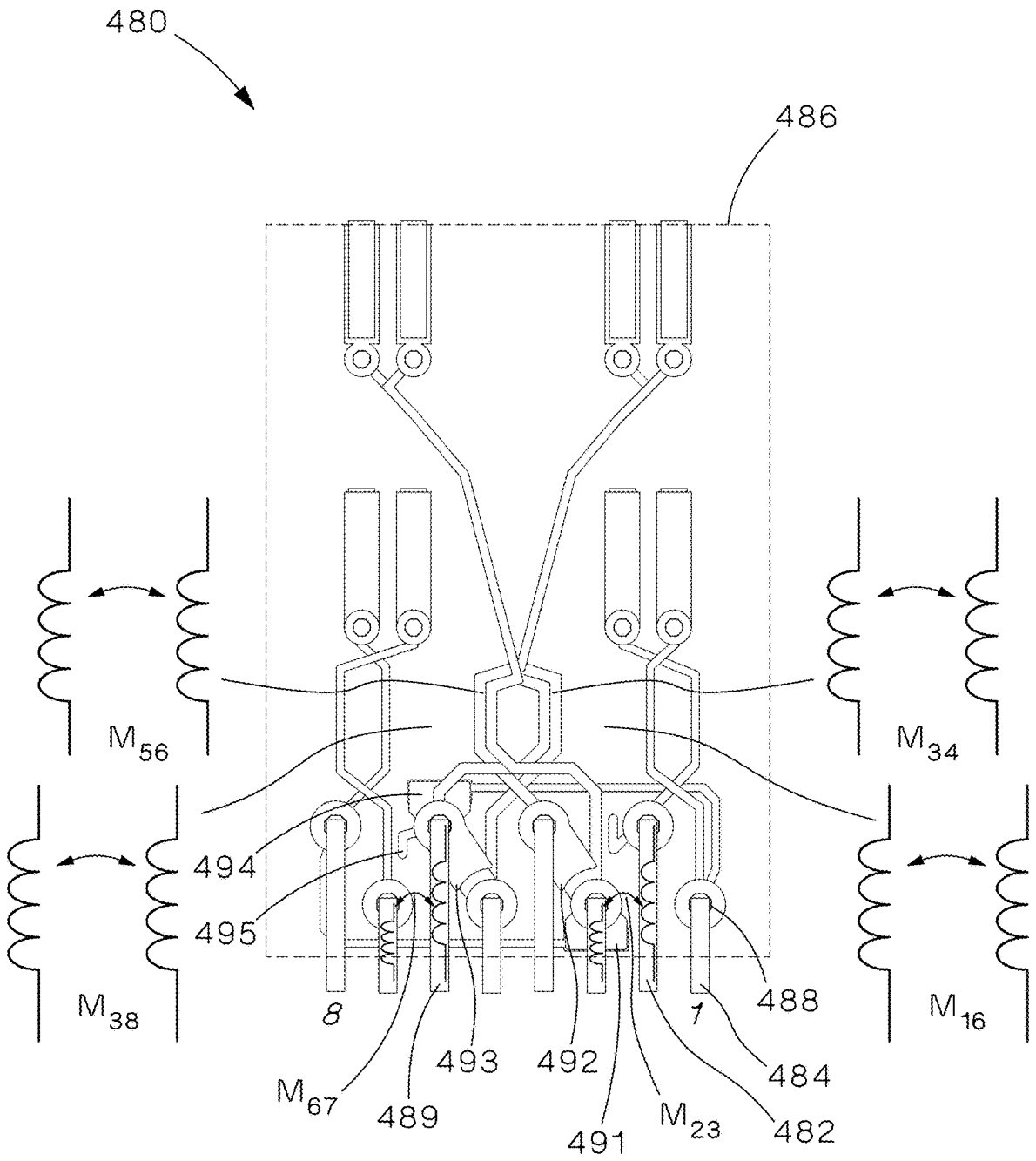

In another embodiment, the communication plugs described herein may be paired with a PCB assembly shown in FIGS. 41-43 with FIG. 41 showing a front top trimetric view of PCB assembly 480, FIG. 42 showing a front bottom trimetric view of PCB assembly 480, and FIG. 43 showing a wire frame top view of PCB assembly 480. Wire contacts 482 and 484 mechanically and electrically join PCB 486 by plated through holes 488. Wire contacts 482 and 484 are designed to be relatively small in profile so as to reduce electromagnetic coupling between adjacent wire contacts of neighboring pairs such as pair 1:2 and pair 3:6. Inherently, there is not enough electromagnetic coupling between pairs to satisfy the crosstalk magnitude range requirements of ANSI/TIA-568-C.2. By reducing coupling between neighboring wire contacts, additional coupling can be added in a strategic manner between non neighboring wire contacts to provide balanced crosstalk between pairs. It is desirable to locate the crosstalk coupling as close to mating interface 489 as possible to enable optimal NEXT and FEXT cancellation ability of a mated jack. FIG. 42 and FIG. 43 show additional crosstalk producing coupling elements 490, 491, 492, 493, 494, and 495 added to PCB 486. In particular, the coupling between conductors 2 and 3 is provided by a distributed capacitive coupling 490; the coupling between conductors 3 and 4 is provided by a capacitor 492; the coupling between conductors 5 and 6 is provided by a capacitor 493; and the coupling between conductors 6 and 7 is provided by a distributed capacitive coupling 495. Furthermore, to maintain a balanced load, conductor 1 is capacitively coupled to conductor 6 via capacitor 494 and conductor 8 is capacitively coupled to conductor 3 via capacitor 491. The capacitance values are sized to achieve the target NEXT and FEXT performance while maintaining balanced coupling between the 3:6 pair and the other three pairs. Capacitors could be embedded capacitors designed into one or more layers on PCB 486, discrete capacitor or generated by some other non-limiting means.

To meet both the ANSI/TIA-568-C.2 NEXT and FEXT range requirements, there must exist a level of inductive crosstalk coupling in addition to the capacitive crosstalk coupling in the plug. To prevent mode conversion and the associated detrimental effects, the inductive crosstalk between the 3:6 pair and the other three pairs is created in a balanced manner. As a signal travels through the plug to the mating jack, the position and design of the wire contacts 482 and 484 along with the plated through holes 488 creates an inherent imbalance in inductive crosstalk between pairs 3:6 and 1:2 as well as between pairs 3:6 and 7:8. Similar to the inherent capacitive crosstalk in the plug, the inherent inductive crosstalk is not large enough to satisfy crosstalk magnitude range requirements of ANSI/TIA-568-C.2. This allows the strategic introduction of additional inductive crosstalk that produces balanced coupling between the 3:6, 1:2, and 7:8 pairs while at the same time satisfying the crosstalk magnitude range requirements of ANSI/TIA-568-C.2.

FIG. 42 shows wire contacts 482 and 484 joined to PCB 486 by plated through holes 488 near the nose of the plug (when the PCB assembly 480 is made part of a plug). There is an inherent amount of inductive crosstalk produced in this region of the plug due to the arrangement of these elements. Considering pair combination 3:6-1:2, the inductive crosstalk M23 in this region is between conductors 2 and 3, as shown in FIG. 43. To satisfy the range requirements of ANSI/TIA-568-C.2, additional inductive crosstalk is added to the plug on PCB 486. Particularly in the region of PCB 486 preceding the plated through holes 488, the conductive traces are arranged in a fashion to create additional inductive crosstalk between pair combination 3:6-1:2. More specifically, inductive crosstalk M16 occurs between conductor 1 and conductor 6, as shown in FIG. 43. The desired amount of inductive crosstalk can be tuned by adjusting the physical distance between conductors 1 and 6 and the parallel length of conductors 1 and 6. The net result of M23 and M16 produces the desired magnitude of crosstalk in a balanced manner.

Crosstalk can be similarly tuned for pair combination 3:6-7:8 where the inductive crosstalk M67 in the nose region occurs between conductors 6 and 7. To satisfy the range requirements of ANSI/TIA-568-C.2, additional inductive crosstalk is added to plug on PCB 486. As with pair combination 3:6-1:2, in the region of PCB 486 preceding the plated through holes 488, the conductive traces are arranged in a fashion to create additional inductive crosstalk between pair combination 3:6-7:8. Specifically, inductive crosstalk M38 occurs between conductor 3 and conductor 8. The desired amount of inductive crosstalk can be tuned by adjusting the physical distance between conductors 3 and 8 and the parallel length of conductors 3 and 8. The net result of M67 and M38 produces the desired magnitude of crosstalk in a balanced manner.

Next, considering pair combination 3:6-4:5, the arrangement of wire contacts 482 and 484 along with the plated through holes 488 are inherently balanced. The symmetric configuration of conductors 3, 4, 5, and 6 in the plug creates inherently balanced crosstalk. Capacitors 492 and 493, shown in FIG. 43, are added to PCB 486 for the purpose of satisfying the crosstalk magnitude range requirements of ANSI/TIA-568-C.2. To meet both the ANSI/TIA-568-C.2 NEXT and FEXT range requirements, there must exist a level of inductive crosstalk coupling in addition to the capacitive crosstalk coupling in the plug. The symmetric arrangement of the respective conductive traces also produces a balanced amount of inductive crosstalk M34 and M56 as shown in FIG. 43.

Figure 44:
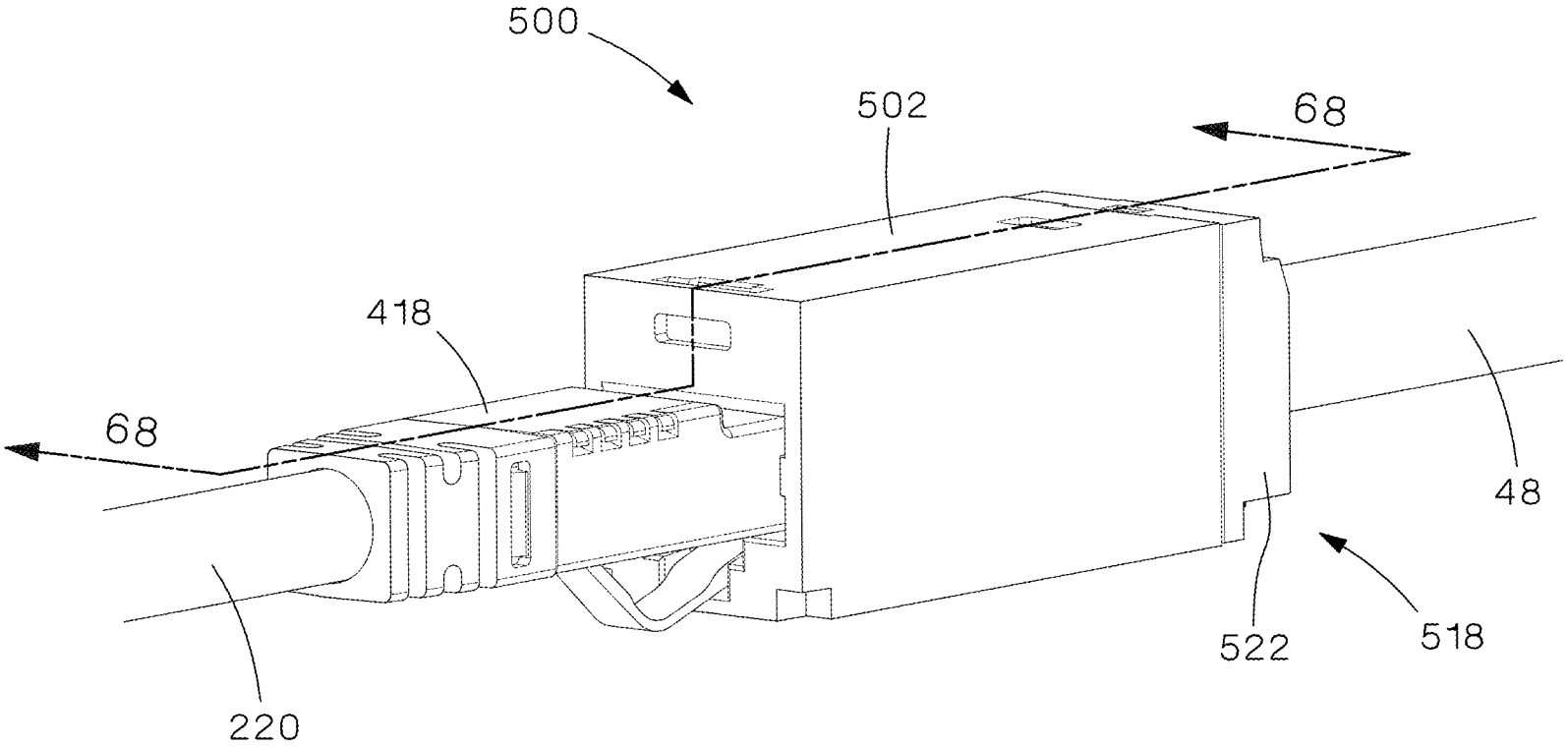
FIG. 44 illustrates a plug/jack combination in a mated state according to an embodiment of the present invention.
Figure 45:
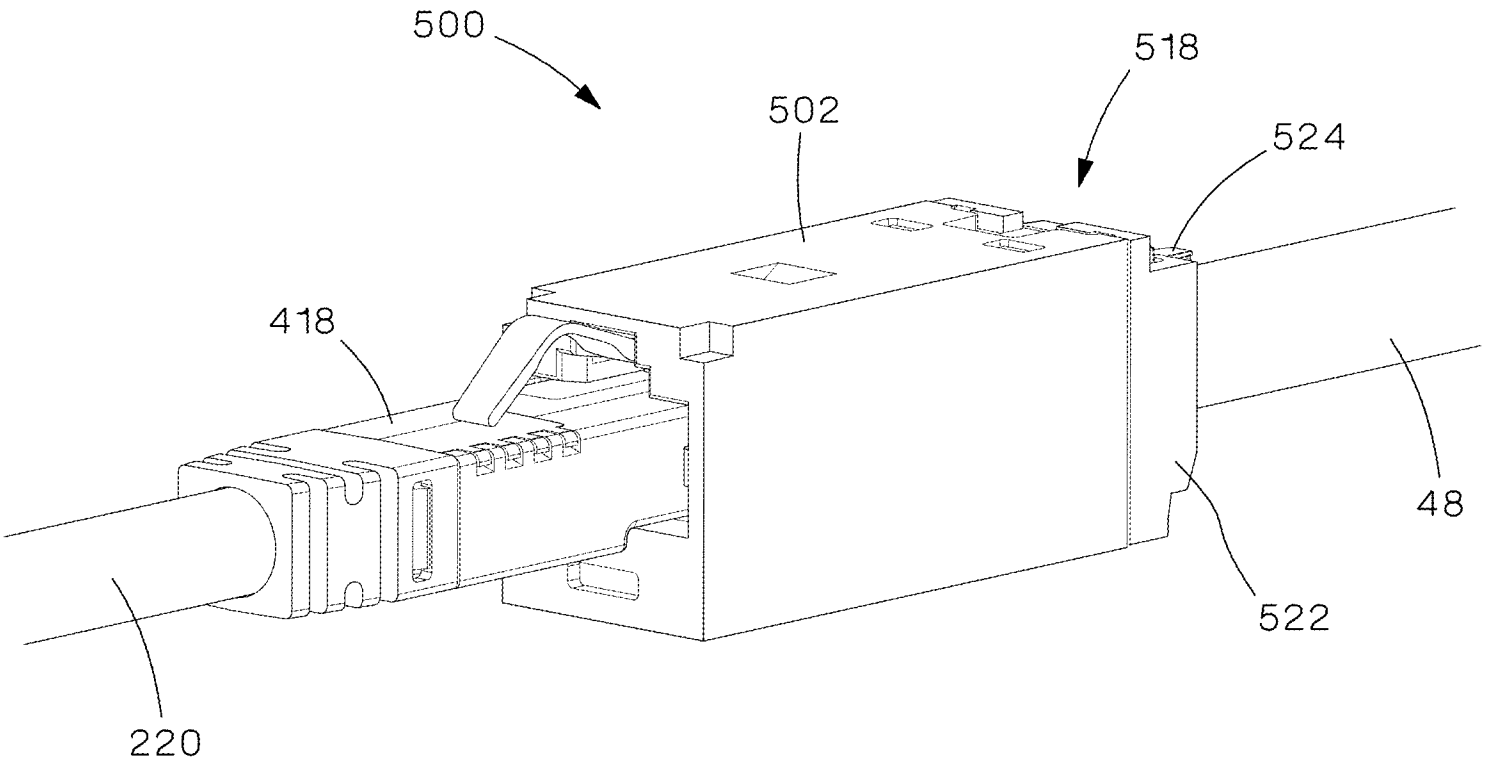
FIG. 45 illustrates the plug/jack combination of FIG. 44 rotated 180 degrees about a central cable axis.
Figure 46:
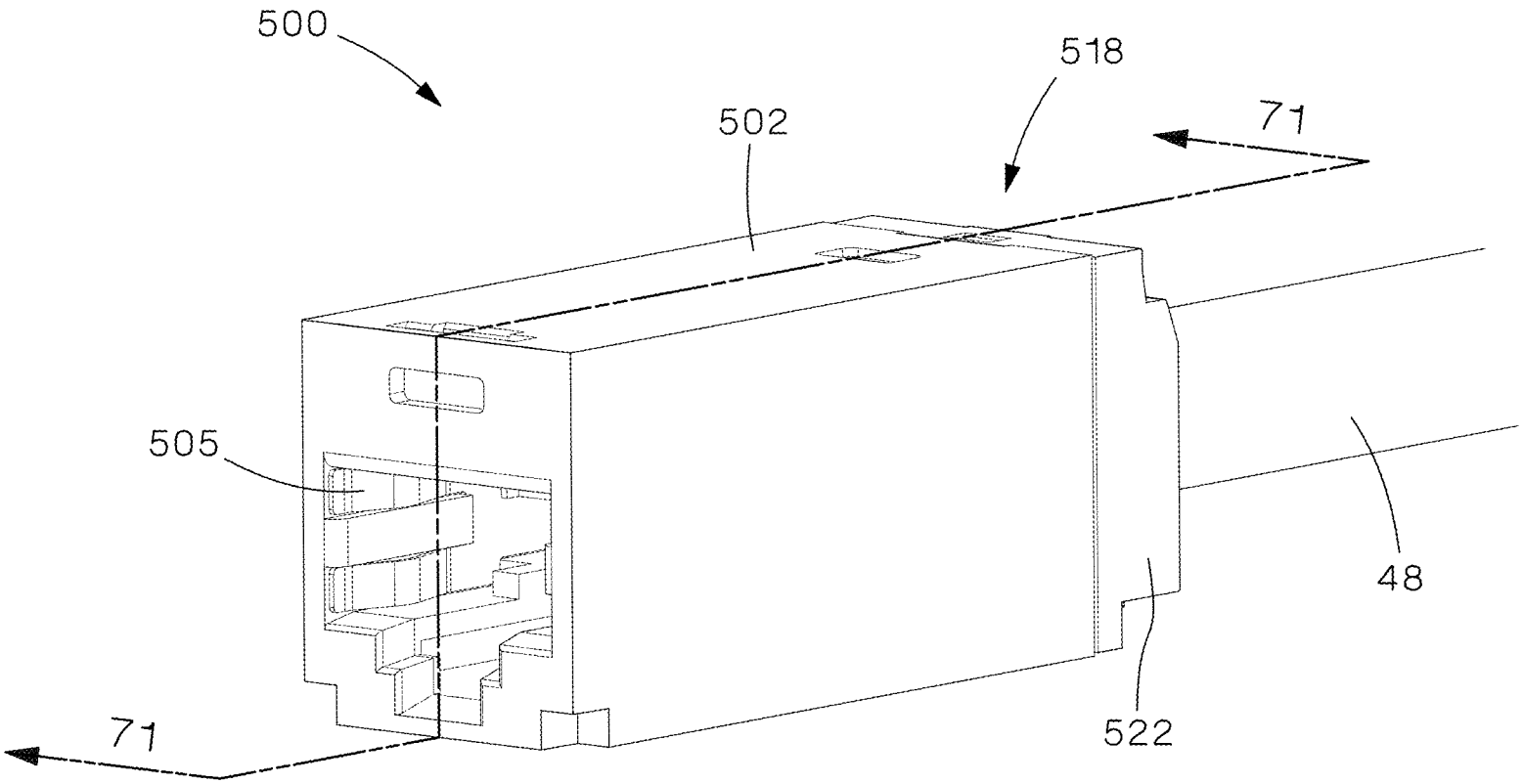
FIG. 46 illustrates a front perspective view of the jack of FIG. 44.
Figure 47:
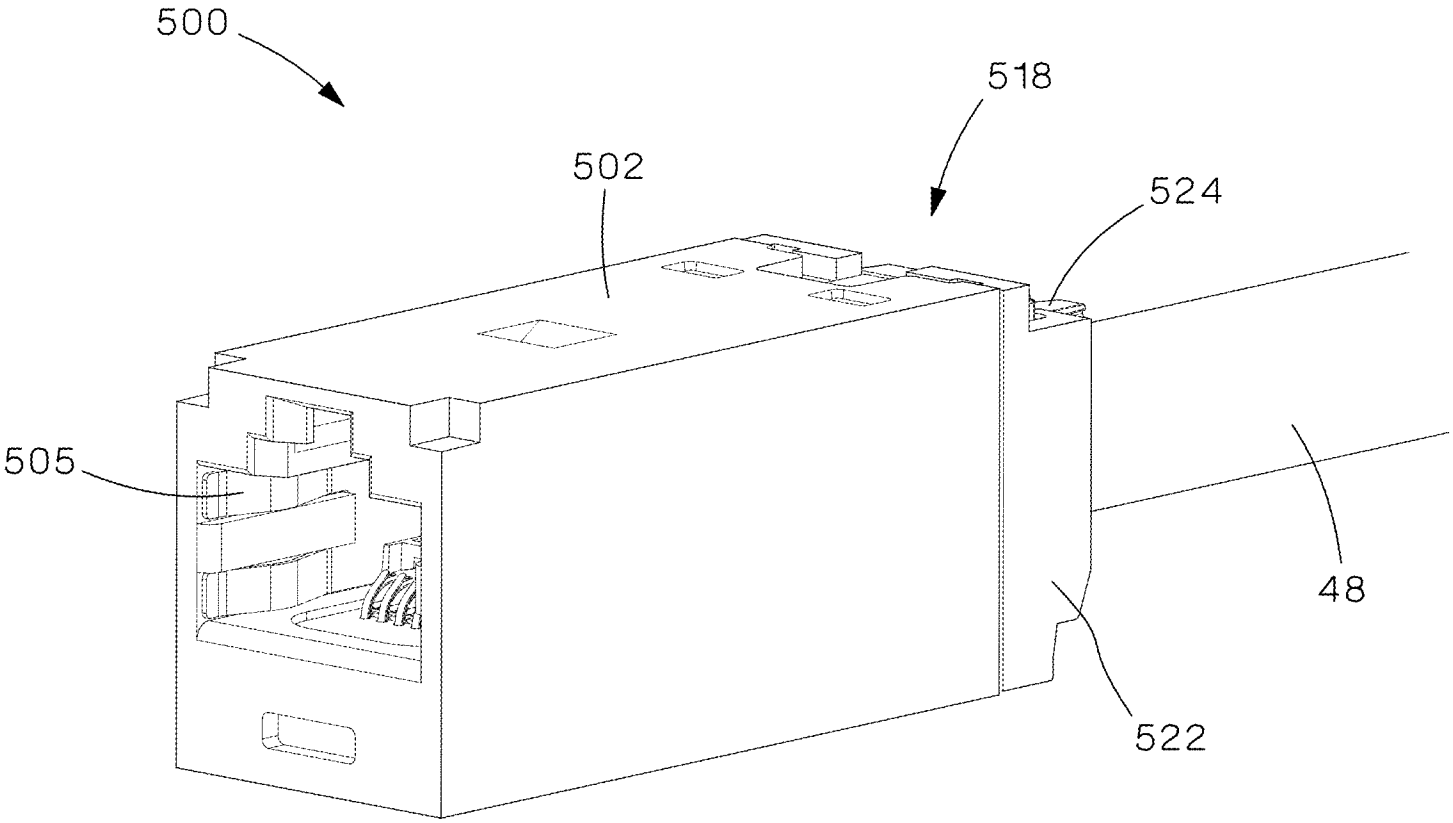
FIG. 47 illustrates the jack of FIG. 46 rotated 180 degrees about a central cable axis relative to FIG. 46.
Figure 48:
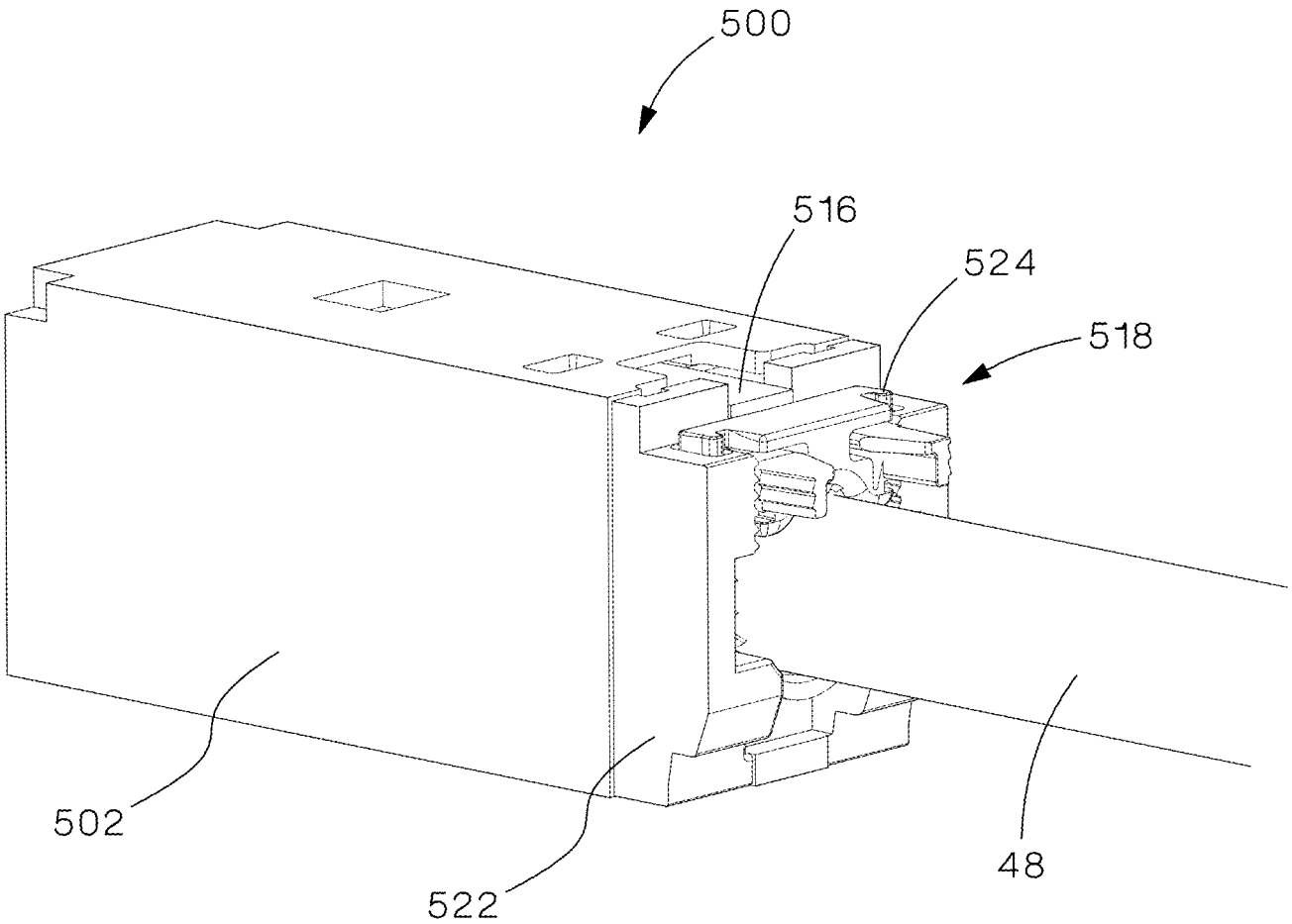
FIG. 48 illustrates a rear perspective view of the jack shown in FIG. 47.
Figure 49:
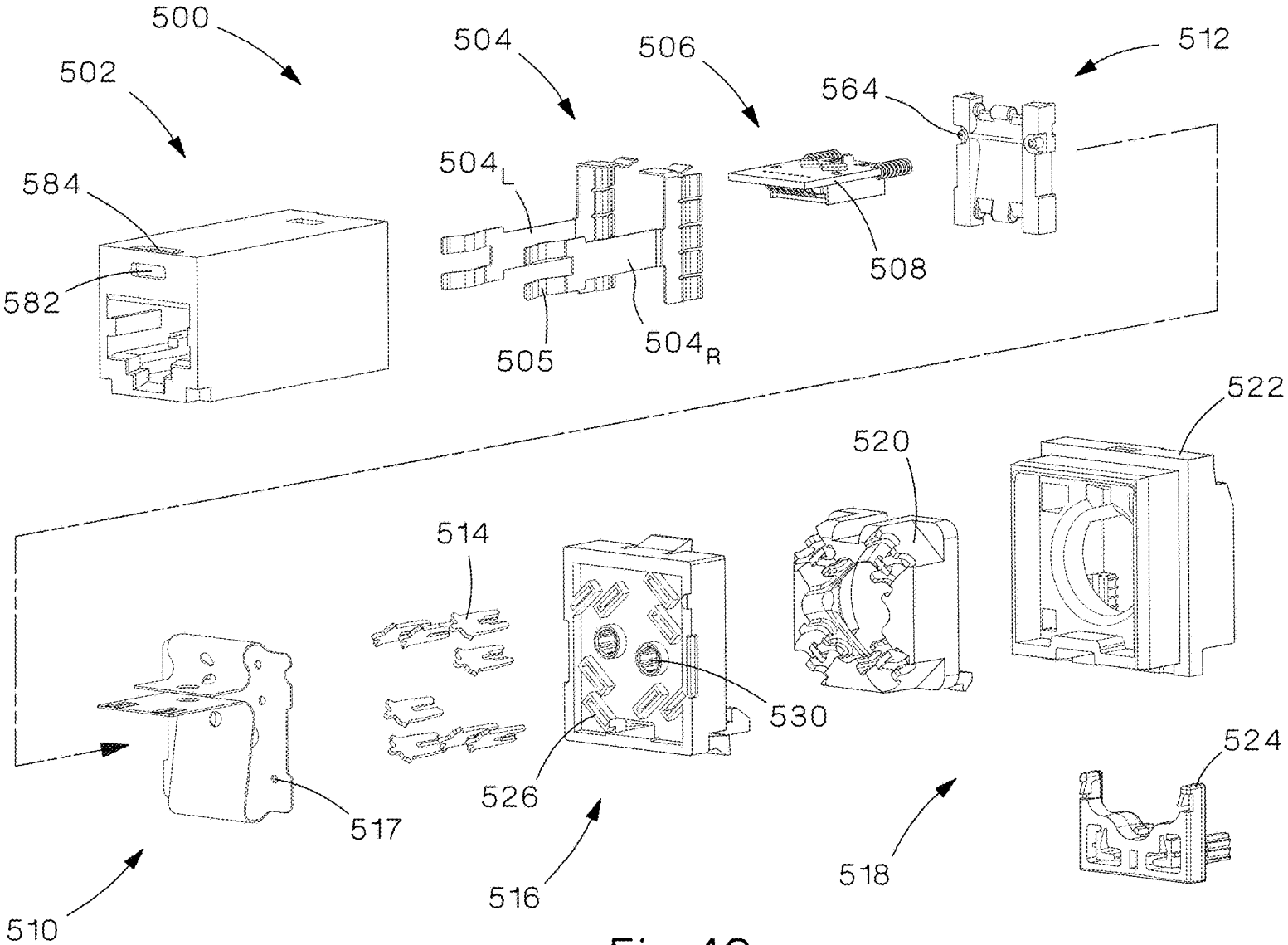
FIG. 49 illustrates an exploded front perspective view of the jack of FIG. 44.

FIGS. 44-61 illustrate yet another embodiment of a communication jack 500 in accordance with the present invention. While jack 500 is illustrated as having a Mini-Com® form factor, this is merely exemplary. FIGS. 44 and 45 illustrate isometric views of network jack 500 mated with RJ45 plug assembly 418, and FIGS. 46-48 illustrate isometric views of network jack 500 in an unmated state. As shown in the exploded isometric views illustrated in FIGS. 49-51, network jack 500 includes housing 502, grounding flanges 504 with plug grounding flanges 505, front sled assembly 506 with rigid PCB 508, back flexible PCB 510 supported by IDC/PCB support 512, IDCs 514, rear sled 516, and wire cap assembly 518 with wire containment cap 520, conductive rear cap 522, and conductive strain relief clip 524. Housing 502 can be conductive, semi-conductive, or non-conductive. Wire cap assembly 518 is similar to that of the rear cap assembly 136 except it is reduced in height and width to accommodate the exemplary form factor.

In the assembly of network jack 500, left grounding flange $\mathbf{504}_L$ and right grounding flange $\mathbf{504}_R$, which are mirror images of one another, are installed into housing 502. Next, referring to FIG. 52, the IDCs 514 are positioned in IDC slots 526 within the rear sled 516. IDCs 514 can be designed to include shoulder sections which prevent said IDCs from fully passing through slots 526. This allows IDCs 514 to remain in position while they are secured to the back flexible PCB 510 by way of soldering the tips of the IDCs to vias 517, or using any other applicable method such as employing compliant/press fit pins. Once the IDCs 514 are secured to the PCB 510, support structure 512 is positioned on the other side of the PCB 510 (opposite of the IDCs 514 and rear sled 516) and is press-fit to the rear sled 516 providing strain relief on the solder joints of vias 517. The press-fitting is achieved by having posts 528 press-fit into the holes 530 on the rear sled 516. In the process, posts 528 pass through openings 532 in the PCB 510 aligning it with and entrapping it between the support structure 512 and the rear sled 516.

Figure 57:
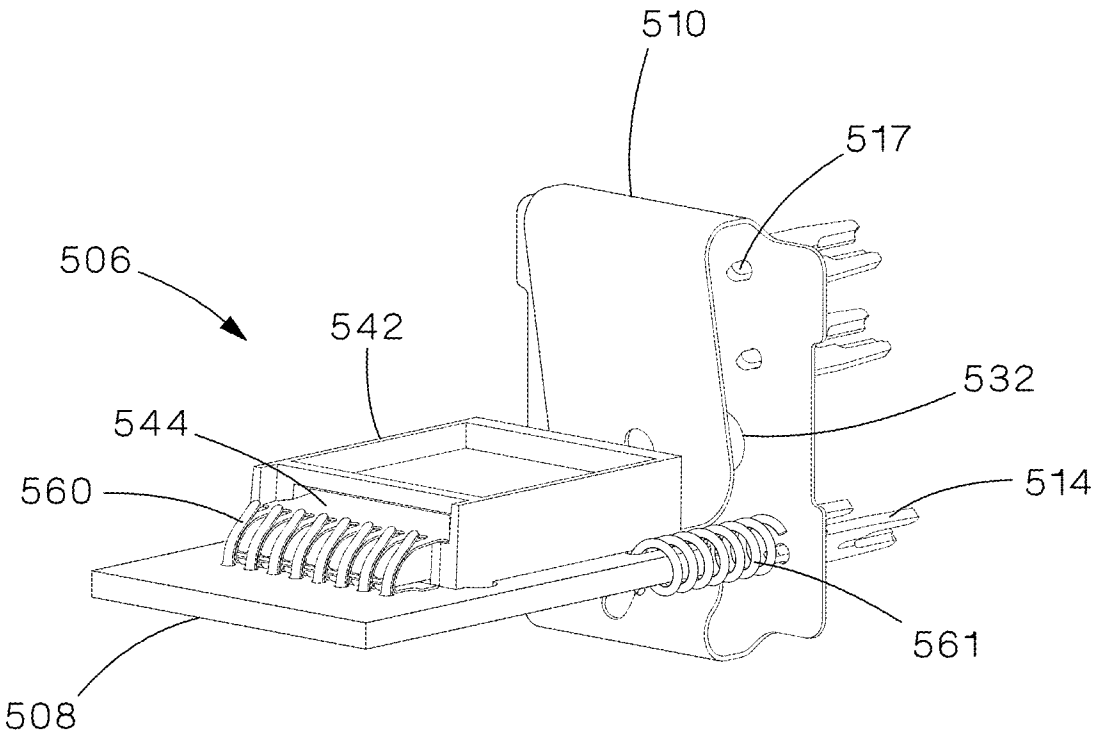
FIGS. 57-59 illustrate perspective views of the internal subassembly of the jack of FIG. 44 with the support structure and the rear sled removed for clarity.
Figure 58:
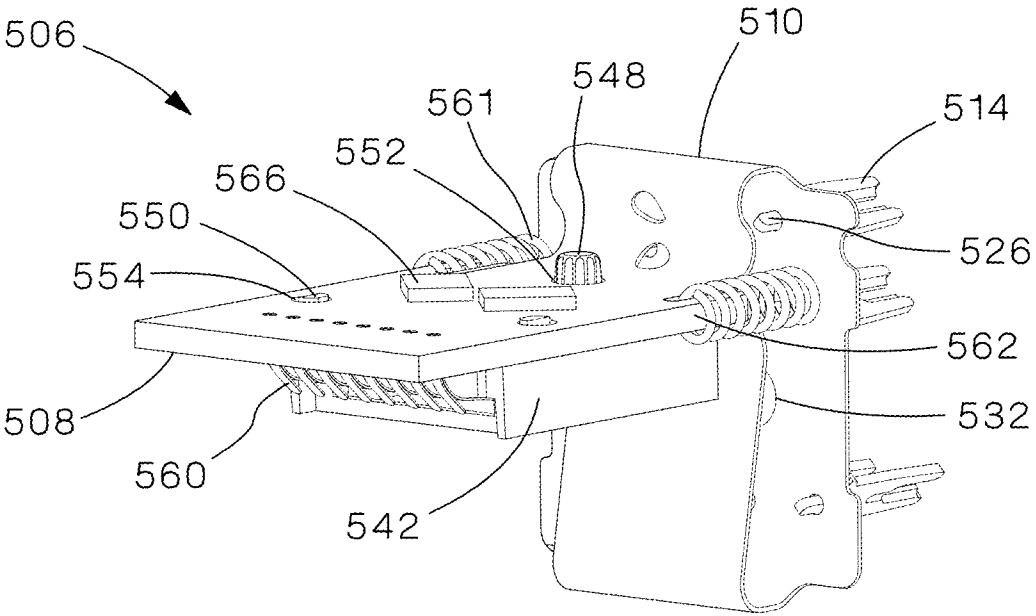
Figure 59:
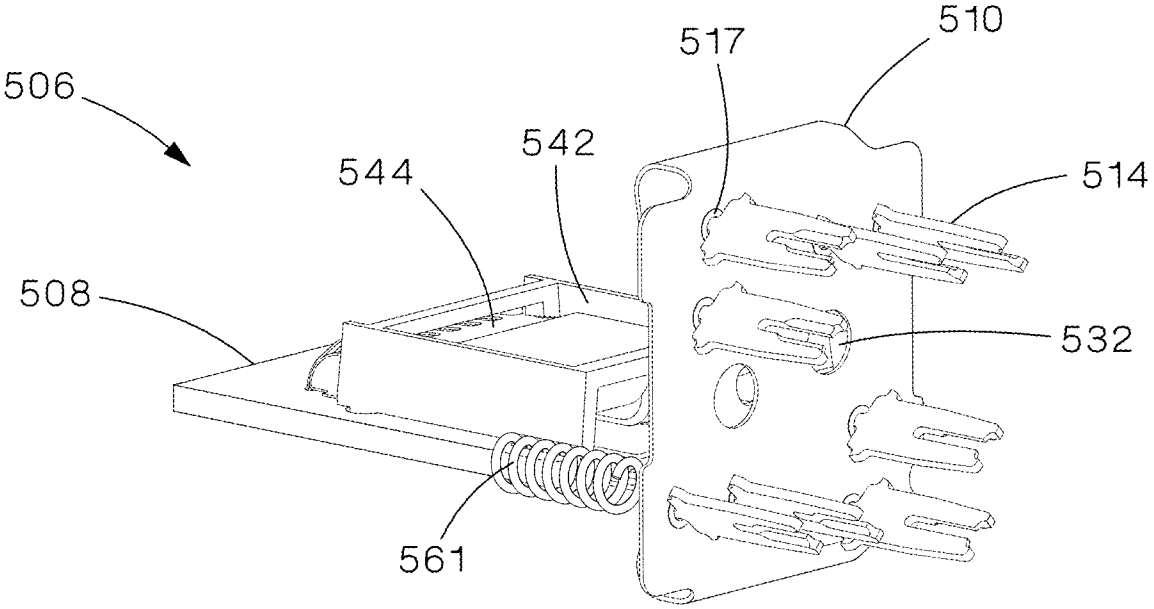
Figure 60:
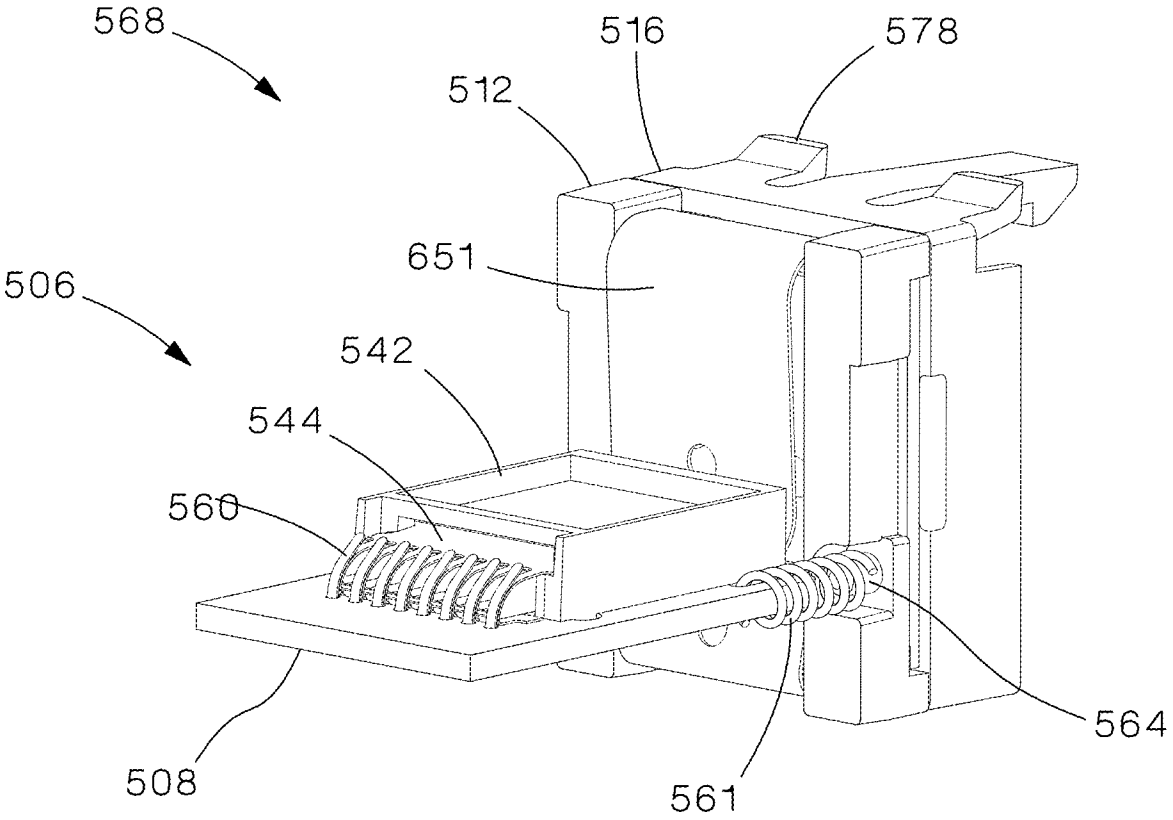
FIG. 60 illustrates a perspective view of the internal subassembly of the jack of FIG. 44.

Once the support structure 512, back flexible PCB 510, IDCs 514, and rear sled 516 are joined together, the PCB 510 is attached to rigid PCB 508 of the front sled assembly 506. Referring to FIGS. 53-56, back flexible PCB 510 is secured to rigid PCB 508 through solder pads 534, located on both top and bottom of rigid PCB 508, and respective solder pads 536, located on the top 538 and bottom 540 portions of the flexible PCB 510. Thereafter, the sled support 542 together with the front flexible PCB 544 are joined to the rigid PCB 508. To do this, the front flexible PCB 544 is wrapped around mandrel 546 of sled support 542, with the top portion of PCB 544 being inserted into the slot 547 and the bottom portion of PCB 544 being tucked underneath the mandrel 546 and support sled 542. The PCB 544 is secured to the sled support 542 via any suitable means, including adhesion and/or physical restraint. Sled support 542 is then secured to rigid PCB 508 through posts 548 and 550 which align with respective drill holes 552 and 554. Thru-holes 556 and 558 on back flexible PCB 510 provide clearance for post 548. Additionally, PICs 560 are installed in the PIC vias 562 of the rigid PCB 508. While in the current embodiment PICs 560 are soldered to the respective vias, other appropriate means could be used to secure the PICs to the PCB, including the use of compliant/press fit pins. Upon installation, PICs 560 rest over the front flexible PCB 544 such that upon a sufficient application of force they deform and make contact with the flexible PCB 544. To bias the front sled assembly 506 into a forward position, springs 561 are secured to routed posts 562 on rigid PCB 508 and spring posts 564 on IDC support 512. FIGS. 57-59 illustrate the front sled assembly 506 assembled to the flexible PCB 510 with the support structure 512 and the rear sled 516 removed for clarity, and FIG. 60 illustrates the front sled assembly 506 assembled to the flexible PCB 510 with the support structure 512 and the rear sled 516 present.

Note that while the flexible PCB 510 is referred to as "flexible," it is within the scope of the present invention that the PCB 510 can be entirely comprised of a flexible substrate or it can be comprised of both rigid and flexible portions. When installed into the housing 502, top 538 and bottom 540 portions of the flexible PCB 510 include some amount of slack. This slack along with the flexibility of the PCB 510 allows the front sled assembly 506 to transition relative to support 512/IDCs 514/rear sled 516 with minimal stress on solder joints of back flexible PCB 510.

While rigid PCB 508 is shown with discrete components 566 such as capacitors and/or inductors, these can be embedded into the artwork of rigid PCB 508.

Figure 61:
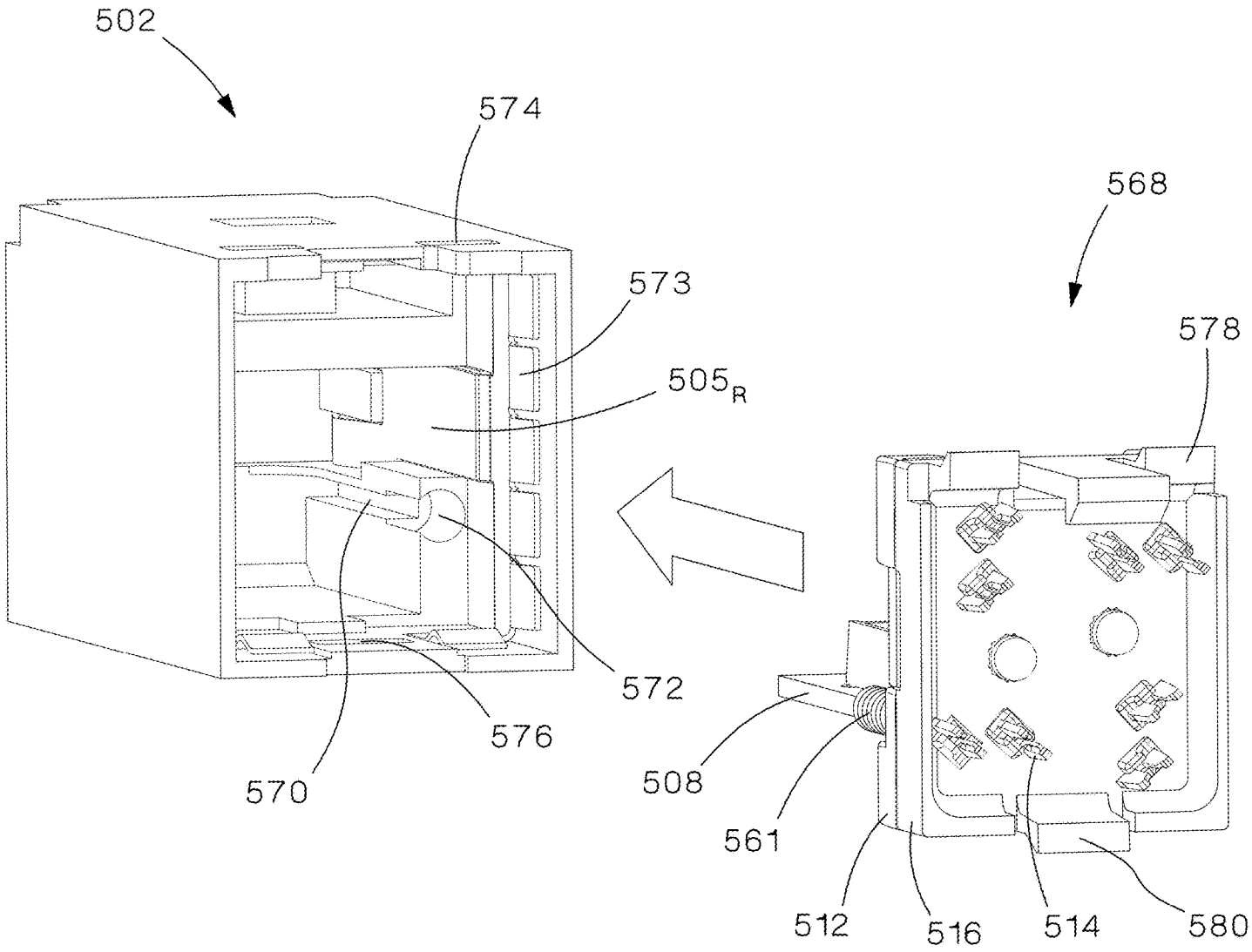
FIG. 61 illustrates a rear perspective view of the internal subassembly being joined with the housing of the jack of FIG. 44.

Upon the assembly of front sled assembly 506, flexible PCB 510, support structure 512, and rear sled 516 into an internal subassembly 568, the internal subassembly 568 is inserted into the back of the housing 502, as represented by the arrow in FIG. 61. During this insertion, rigid PCB 508 is aligned with PCB rails 570 and spring pockets 572 of housing 502 align with and provide clearance for springs 561. To secure the internal subassembly 568 within the housing 502, slots 574 and 576 align with and latch on to respective latches 578 and 580. Thereafter, wire cap assembly 518 together with the communication cable 48 can be attached to the remainder of the jack 500 in a fashion similar to that of the embodiment shown and described in FIGS. 12-17.

Upon final assembly, wire cap grounding flanges 573 make contact with conductive rear cap 522, providing an electrical bond. This configuration allows electrical continuity to exist from a shield of a shielded plug to a braid of cable 48. Reliably bonding the metal non-signal carrying components of the plug and jack can mitigate EMI susceptibility and can enable shielding effectiveness that may meet certain standards' requirements.

Figure 50:
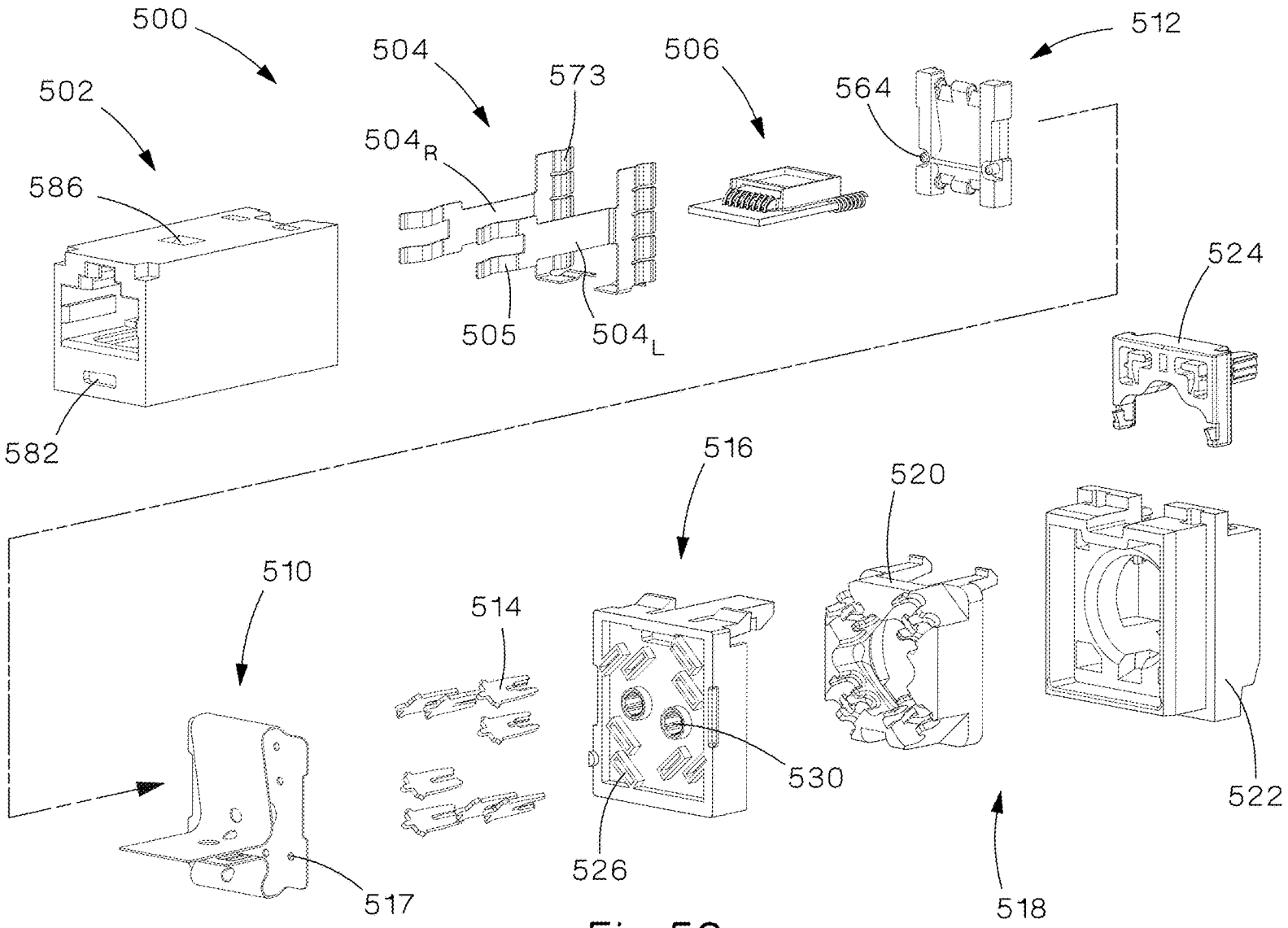
FIG. 50 illustrates an exploded front perspective view of the jack of FIG. 44 rotated 180 degrees about the jack's longitudinal axis relative to FIG. 49.
Figure 51:
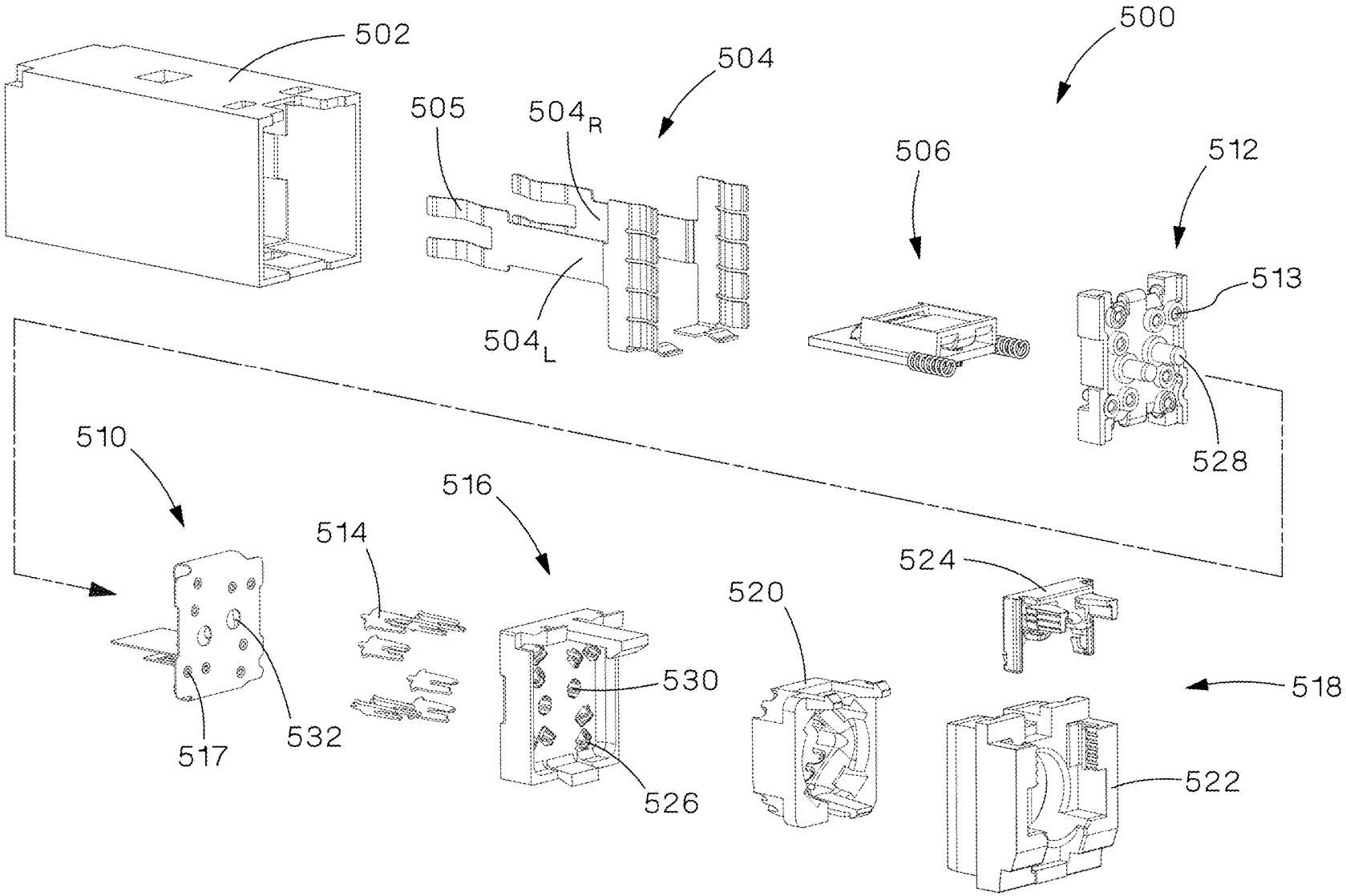
FIG. 51 illustrates an exploded rear perspective view of the jack of FIG. 44.
Figure 52:
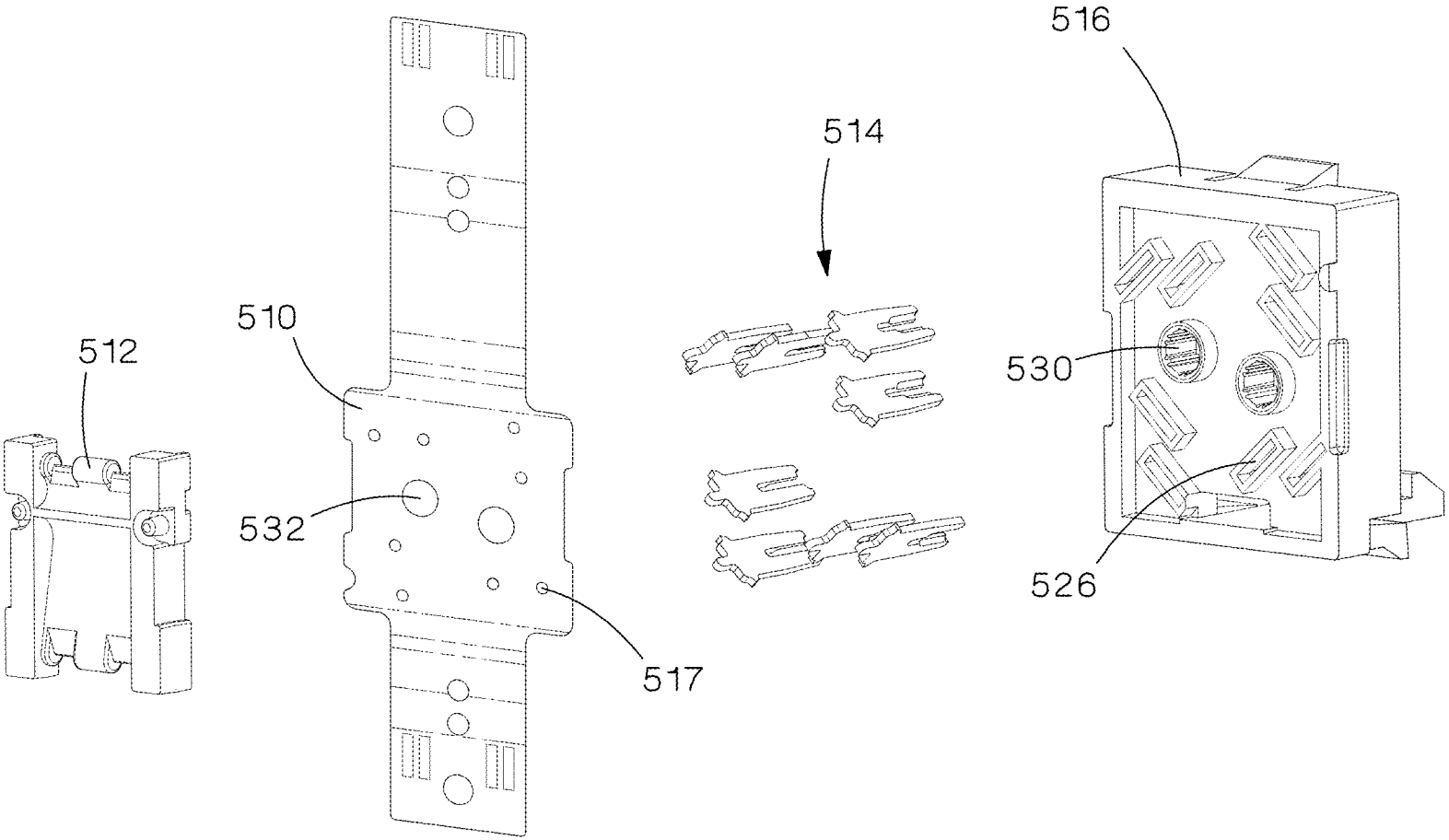
FIG. 52 illustrates an exploded view of the internal subassembly of the jack of FIG. 44.
Figure 53:
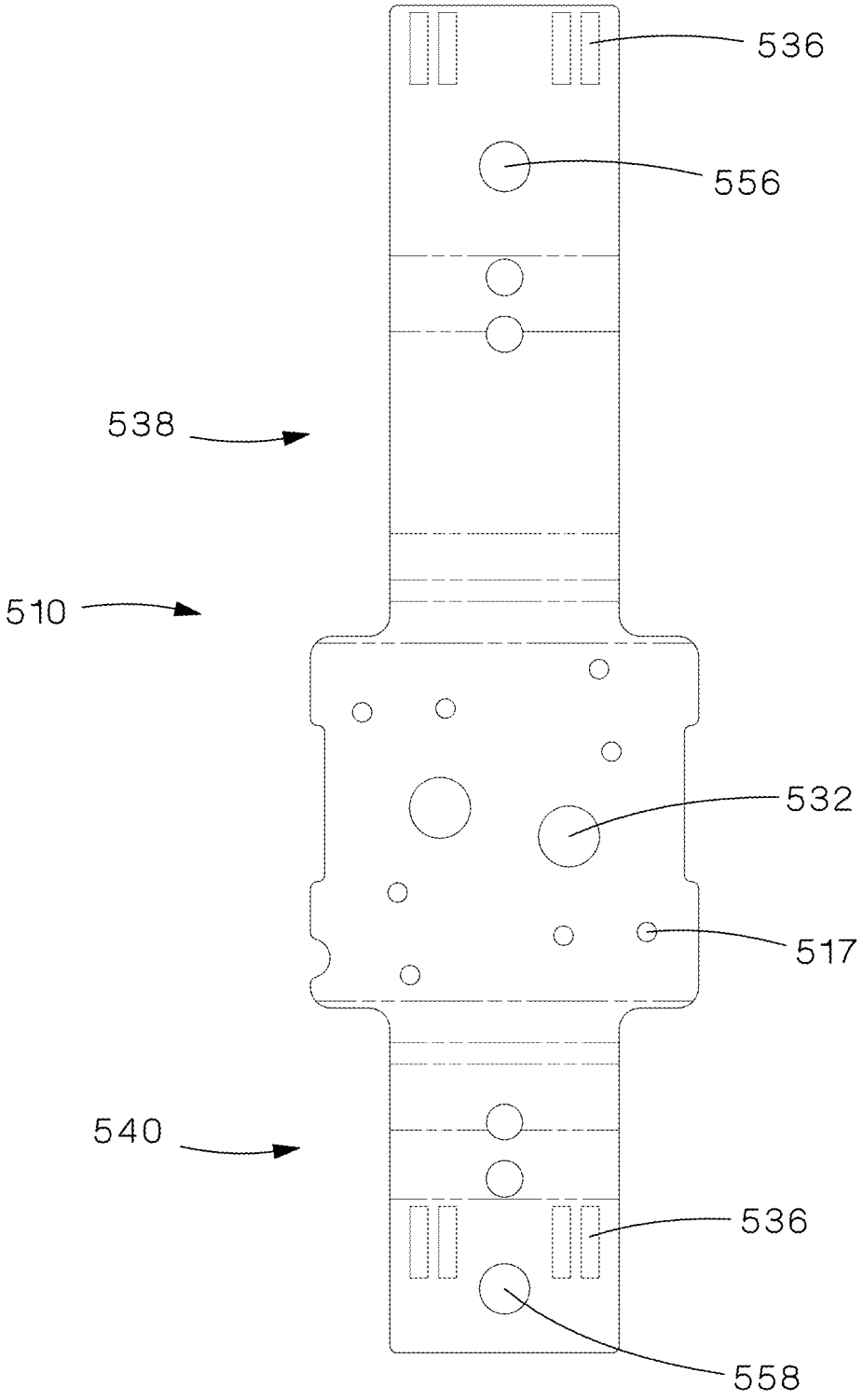
FIG. 53 illustrates a top view of the flat pattern of a back flexible PCB of the jack of FIG. 44.
Figure 54:
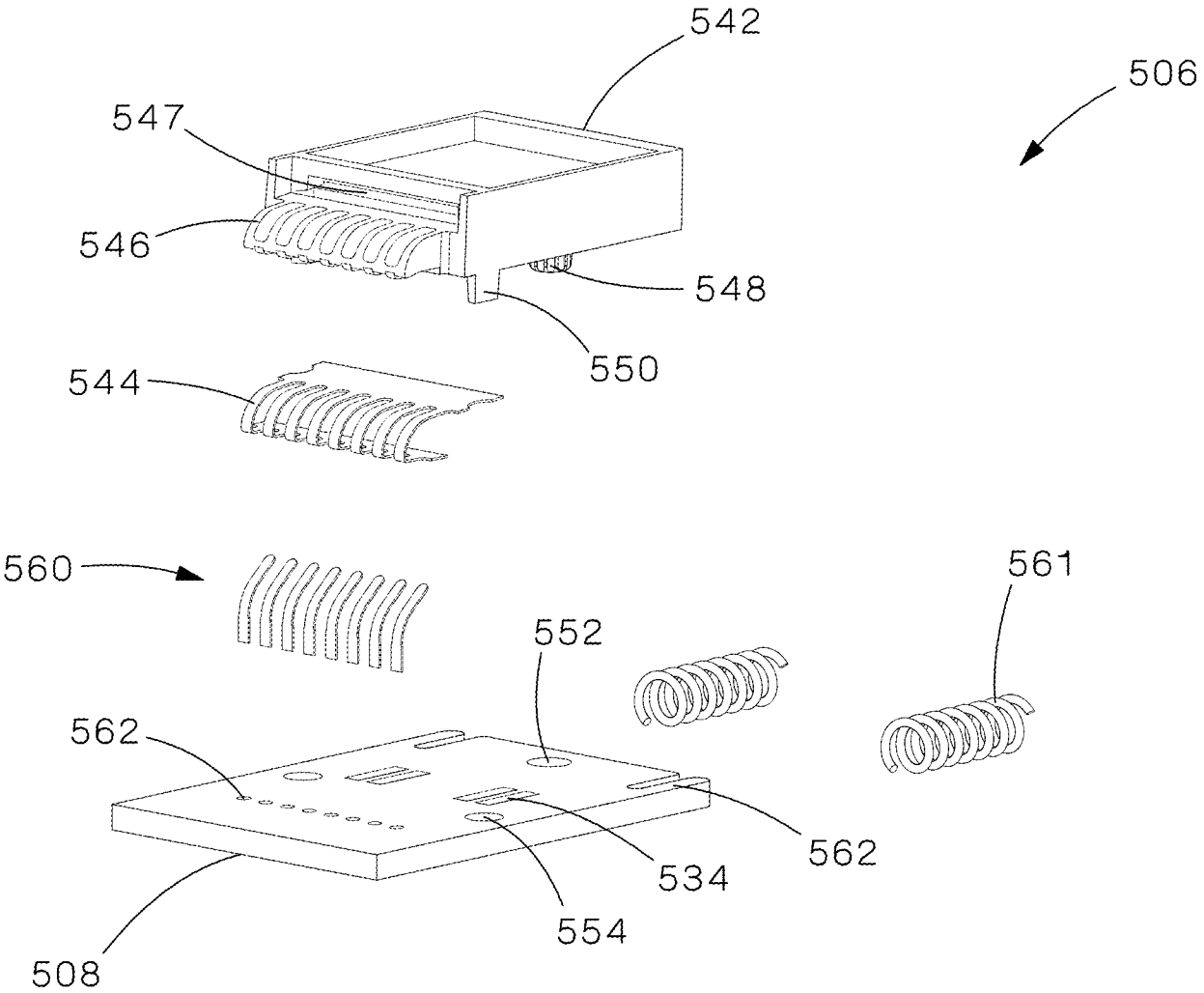
FIG. 54 illustrates an exploded front perspective view of the sled assembly of the jack of FIG. 44.
Figure 55:
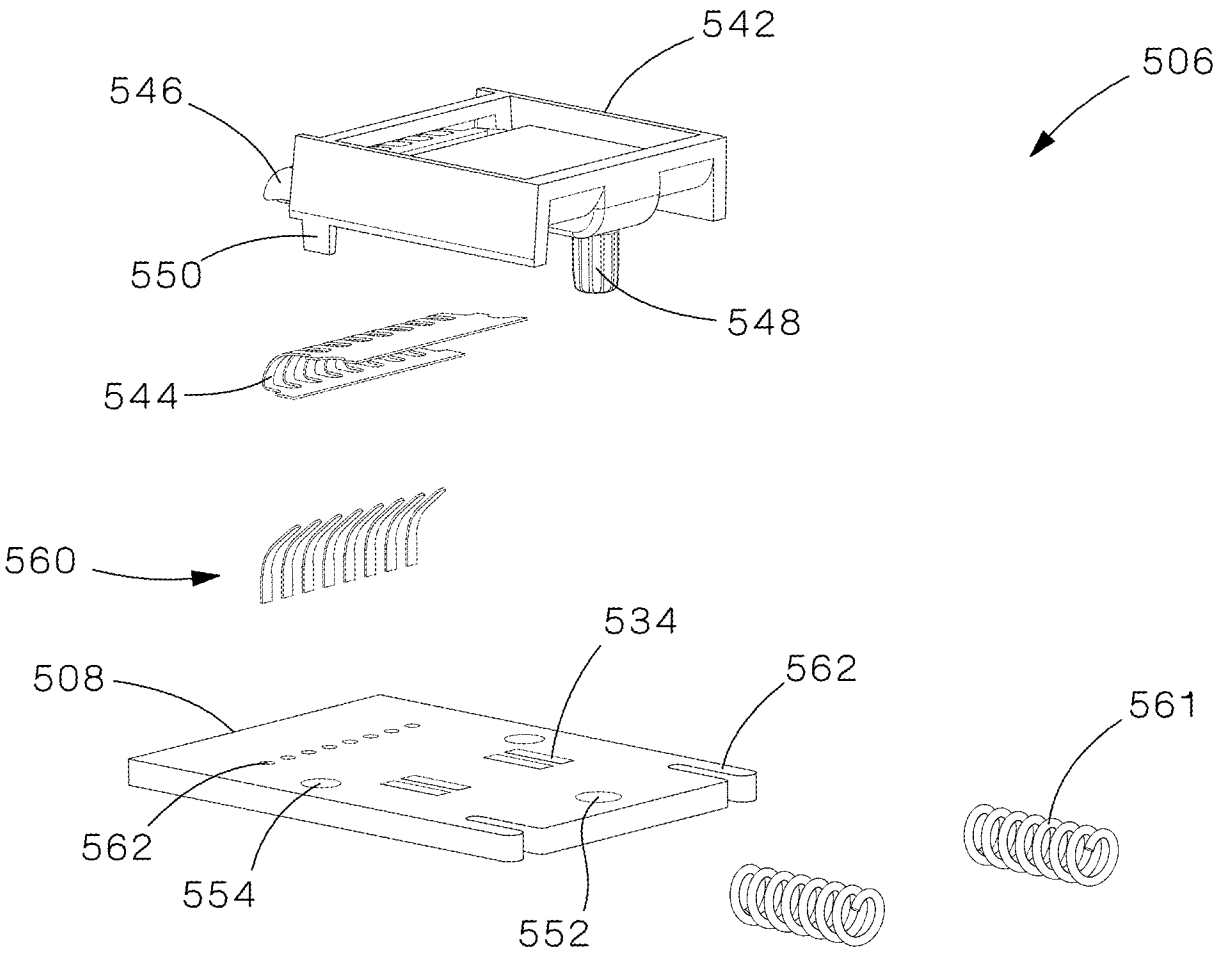
FIGS. 55 and 56 illustrate exploded rear perspective views of the sled assembly of the jack of FIG. 44.
Figure 56:
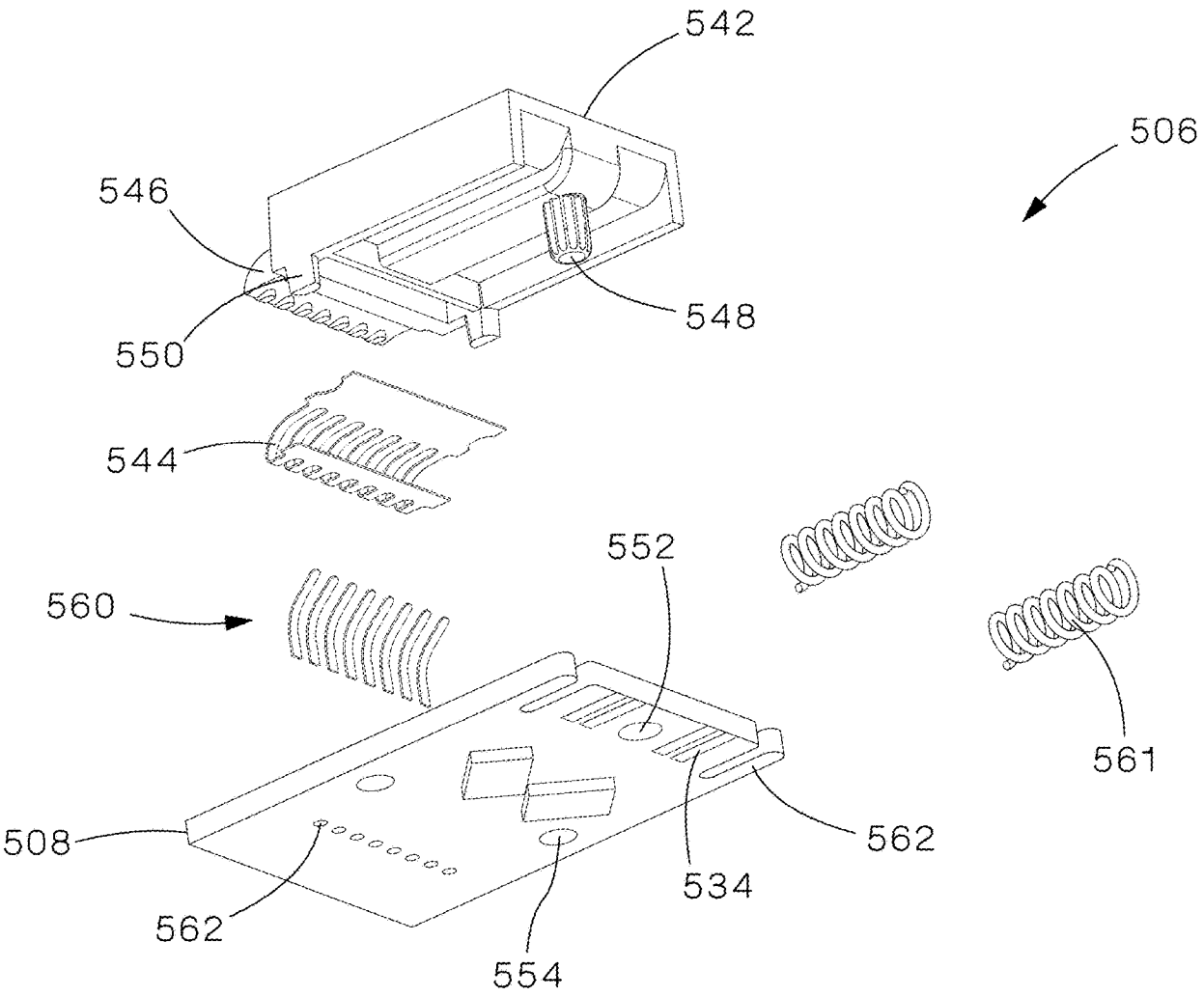

As shown in FIGS. 50 and 51, housing 502 of the currently described embodiment can include icon pocket 582, front latching slot 584, and back latch slot 586 for securing jack 500 to different latching geometries.

Figure 62:
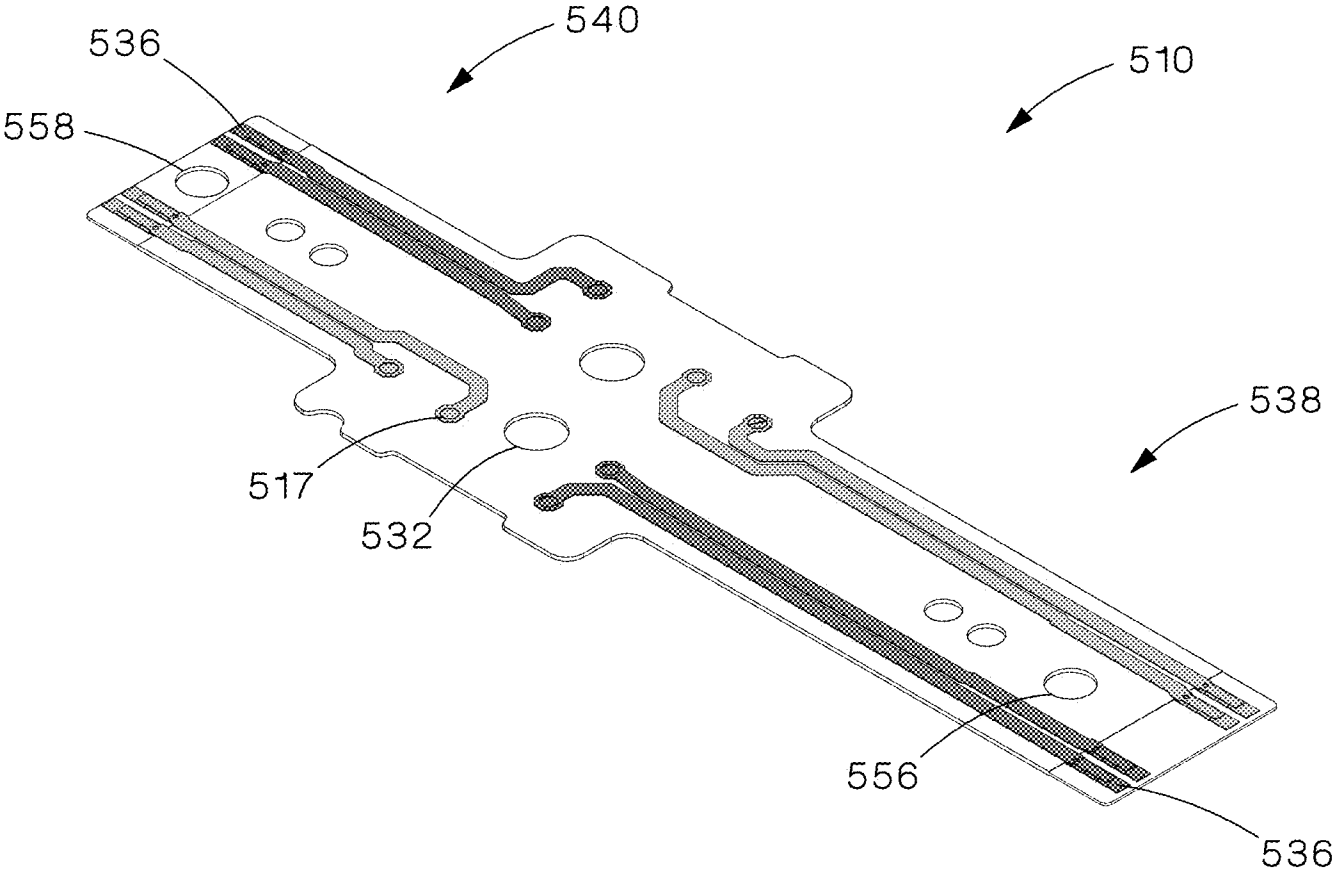
FIG. 62 illustrates an isometric view of a back flexible PCB in accordance with an embodiment of the present invention.

FIGS. 62-66 illustrate exemplary circuitry components that can be implemented in jack 500. As shown in FIG. 62, which shows a top isometric view of back flex PCB 510 with all layers shown, copper traces are spaced within each pair to maintain a predetermined impedance so as to not detrimentally affect return loss. Back flexible PCB 510 surface mount pads 526 are soldered to rigid PCB 508 surface mount pads 534. In an effort to maintain greater tuning ability, only four conductors are placed on each of top and bottom portions 538 and 540, respectively. As such, four of the eight conductors on back flexible PCB 510 extend from the top portion 538 towards the IDC vias 517 and four of the remaining four of the eight conductors on back flexible PCB 510 extend from the bottom portion 540 towards the IDC vias 517.

Figure 63:
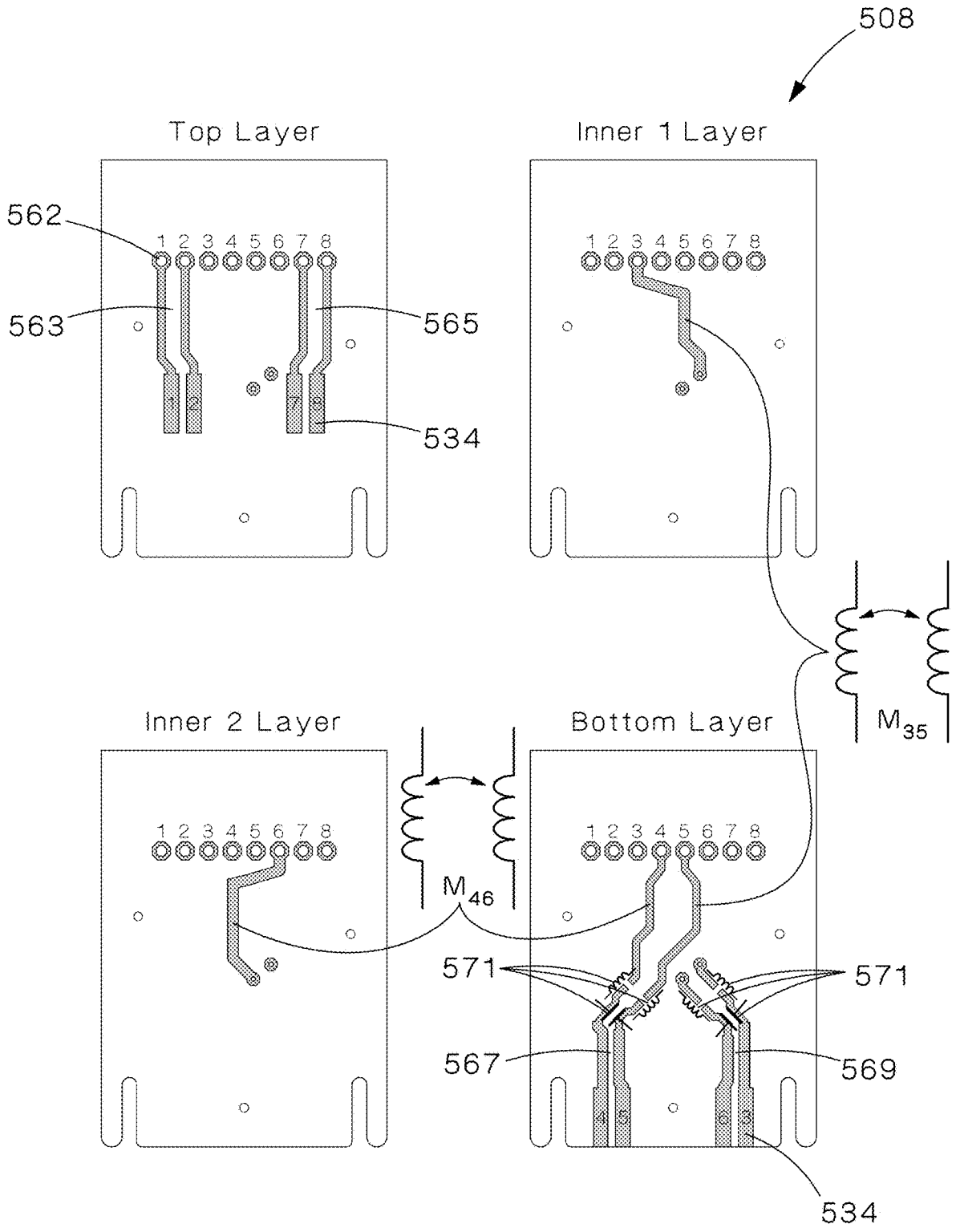
FIGS. 63 and 64 illustrate a rigid PCB in accordance with an embodiment of the present invention.

FIG. 63 illustrates a multi-layer view of the top layer, inner 1 layer, inner 2 layer, and bottom layer artwork of rigid PCB 508 showing thru-hole pads 562 for placement of PICs 560. Copper traces 563 are spaced within pair 1:2 and copper traces 565 are spaced within pair 7:8 to maintain a predetermined impedance so as to not detrimentally affect return loss and also connect thru-hole pads 562 to surface mount pads 534. The arrangement of copper traces 563 and 565 can be adjusted to optimize the mated return loss performance. Similarly, pair 4:5 is formed with copper traces 567 and pair 3:6 is formed with copper traces 569 with the traces being adjusted to maintain a predetermined impedance so as to not detrimentally affect return loss and also connect thru-hole pads 562 to surface mount pads 534. In an embodiment, components 571 form an L-Network.

Figure 64:
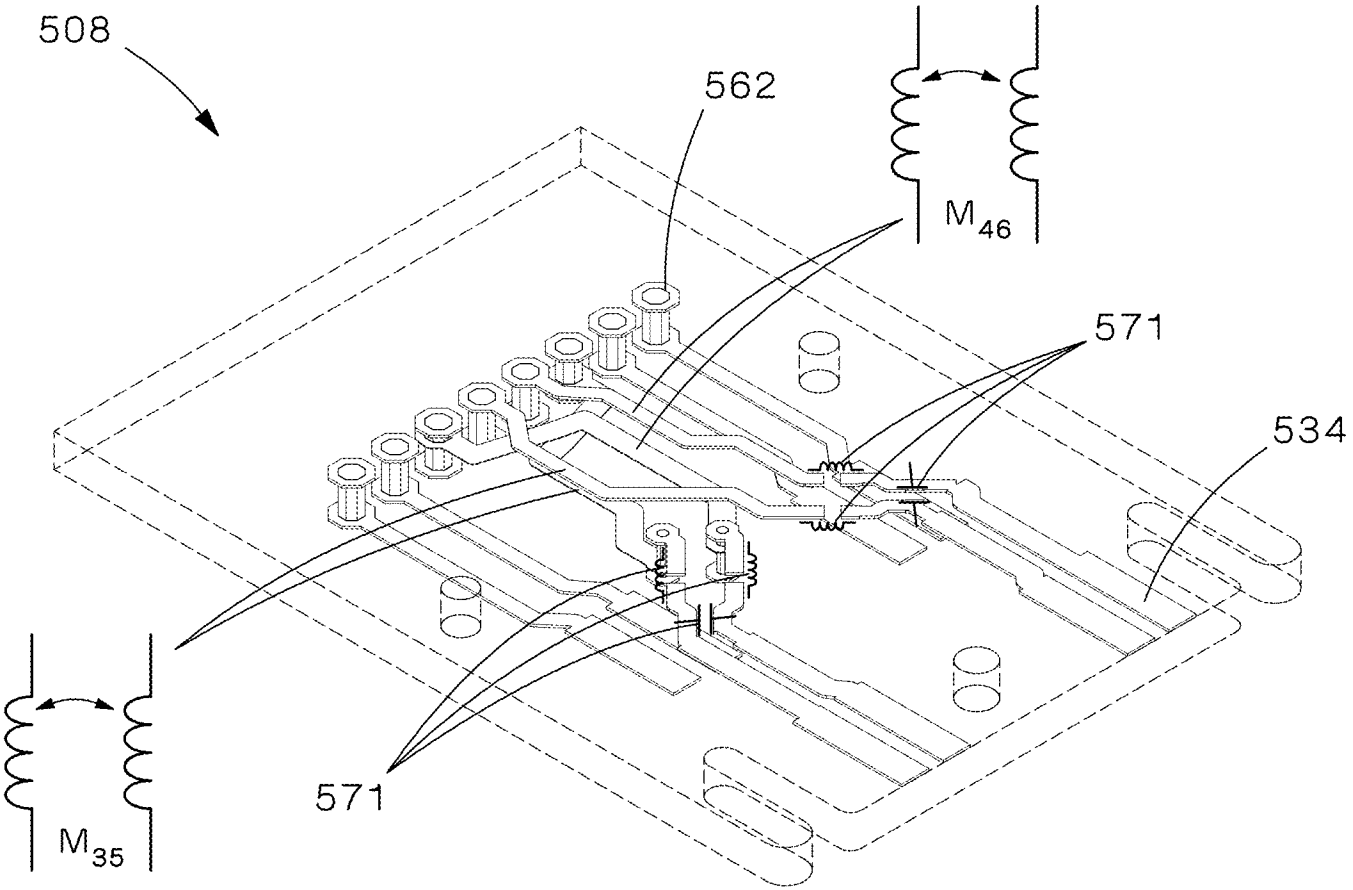

FIG. 64 is a top isometric view of rigid PCB 508 with all layers shown. To meet ANSI/TIA-568-C.2 mated FEXT requirements, there must exist a level of inductive compensation coupling. In FIG. 64, this is shown by M35 and M46. Inductive coupling conductor 6 travels through inner layer 1 and inductive coupling conductor 3 travels through inner layer 2. As a signal propagates along the 3:5 pair and/or the 4:6 pair, a magnetic field is generated proportional to the current flowing in the conductors. Due to the arrangement and proximity of the conductors, the magnetic field created from the current in conductor 3 induces a current in conductor 5 and the current in conductor 6 induces a current in conductor 4. Conversely, the magnetic field created from the current in conductor 4 induces a current in conductor 6 and the current in conductor 5 induces a current in conductor 3. The net result is inductive compensation between the 4:5 and 3:6 differential pairs. FIGS. 62 and 63 show inductive coupling M35 occurring between trace 3 and trace 5, and inductive coupling M46 occurring between trace 4 and trace 6. To maintain a balanced load and reduce mode conversion, inductive coupling M46 occurs is approximately the same magnitude as inductive coupling M35. This inductive coupling is still desired to be close to mating interface in PIC 560 as it also contributes to the mated NEXT performance which is sensitive to the distance between the crosstalk in plug and the compensation in the network jack. The level of inductive coupling can be adjusted to a desired level by a variety of ways, such as trace width, trace spacing, trace length and board thickness. The inductor values can and will vary depending on the target mated NEXT and FEXT performance that is desired. Inductive compensation coupling can be added to any or all six possible pair combinations (example: 3:6-1:2, 3:6-7:8) in an RJ45 mated connection to meet the mated connector ANSI/TIA-568-C.2 NEXT and FEXT requirements.

Figure 65:
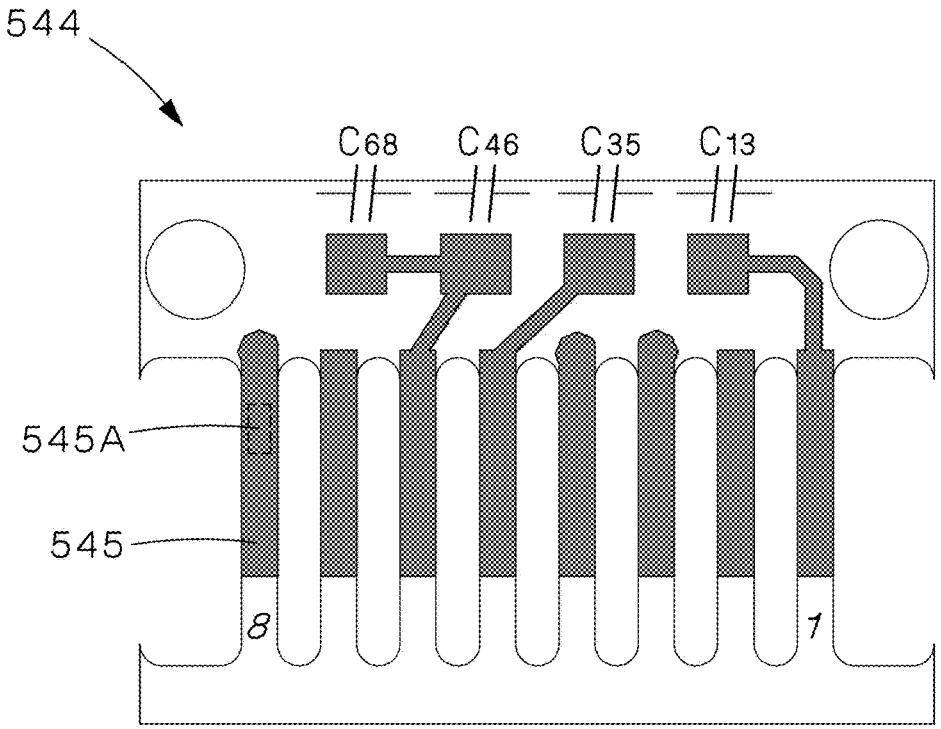
FIGS. 65 and 66 illustrate a front flexible PCB in accordance with an embodiment of the present invention.
Figure 65:
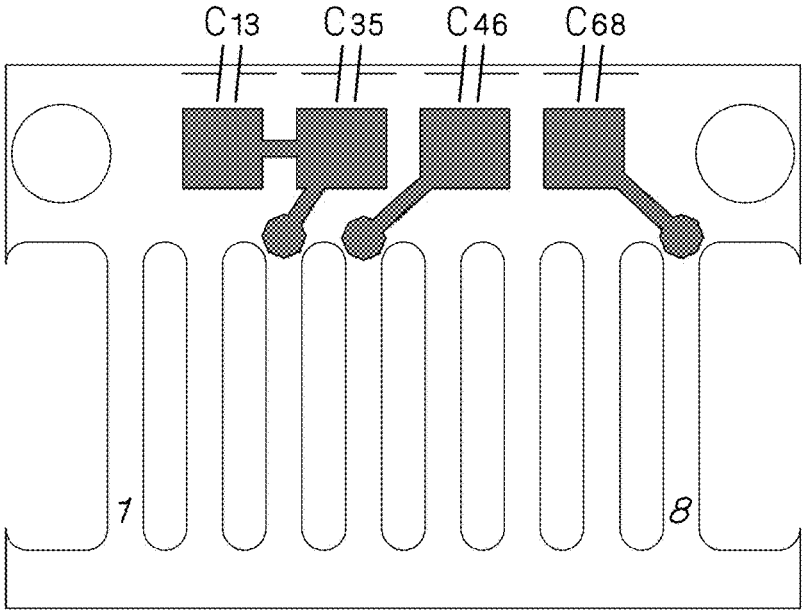
Figure 66:
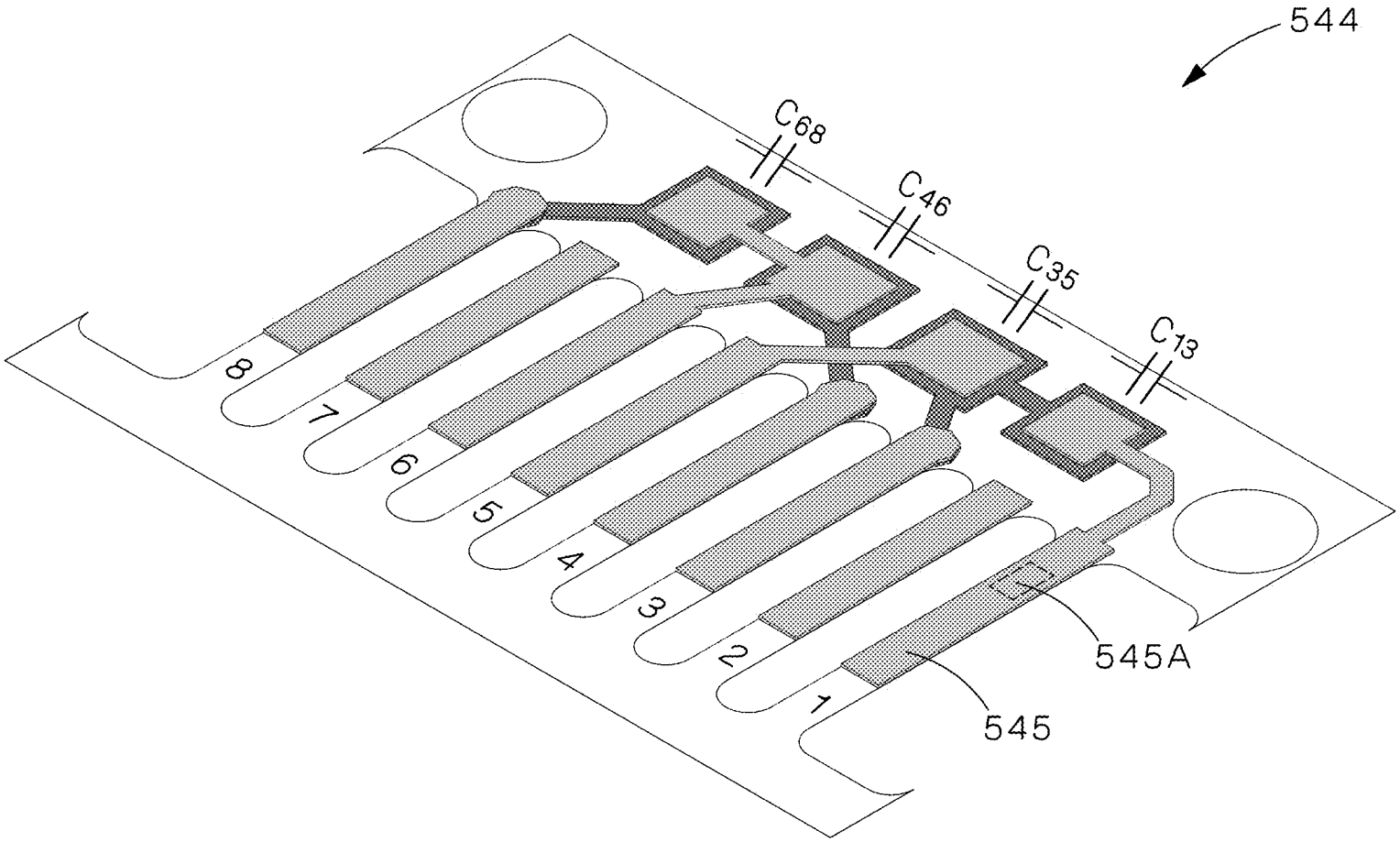

In addition to providing compensation on PCB 508, crosstalk compensation is also provided on PCB 544. FIG. 65 is a multi-layer view of the top layer and bottom layer artwork of front flexible PCB 544 and FIG. 66 is a top isometric view of both artwork layers of front flexible PCB 544. Since PICs 560 are designed to be small in profile so as to reduce electromagnetic coupling between adjacent PICs 560 of neighboring pairs such as pair 1:2 and pair 3:6 and since PICs 560 are also designed to be short in length to keep a short electrical length between additional capacitive compensation on front flexible PCB 544 contact point 545A and mating interface, inherently, there is a need for capacitive compensation between pairs to satisfy crosstalk magnitude requirements of ANSI/TIA-568-C.2. Accordingly, additional compensation coupling is inserted into PCB 544. It is desirable to locate the compensation coupling contact point 545A to mating interface through surface mount pad 545 as close as possible to enable optimal NEXT and FEXT cancellation ability of mating network jack. FIGS. 65 and 66 show additional capacitive compensation coupling on PCB 544 for all 3:6 pair combinations (3:6-4:5, 3:6-1:2, 3:6-7:8). In an embodiment, additional capacitive coupling C13, C35, C46, and C68 is added to PCB 544. The capacitor values can and will vary depending on the target NEXT and FEXT performance that is desired. The capacitive coupling shown can be achieved by way of discrete capacitors, by embedding capacitors into one or more layers on PCB 544, or generated by some other non-limiting means such as distributed capacitance. Capacitor C35 on PCB 544 between position 3 and position 5 is located electrically close to plug/jack mating interface point through contact point 545A. To maintain a balanced load and to minimize mode conversion (differential mode to common mode or common mode to differential mode conversion), capacitor C46 is added to PCB 544 between position 4 and position 6 that is approximately the same magnitude as capacitor C35. Additional capacitors can be incorporated on PCB 544 to create a more balanced crosstalk compensation arrangement between differential pairs 3:6 and 1:2 as well as between pairs 3:6 and 7:8. For example, FIG. 66 shows capacitive coupling C13 between conductor 1 and conductor 3. By distributing this coupling between two capacitors (e.g., C26 and C13), the net compensation is unchanged while mode conversion is reduced. This balanced approach to compensation can also be implemented with respect to other capacitive couplings within the jack, including distributing the capacitive coupling C68 between two capacitors C37 and C68.

Figure 67:
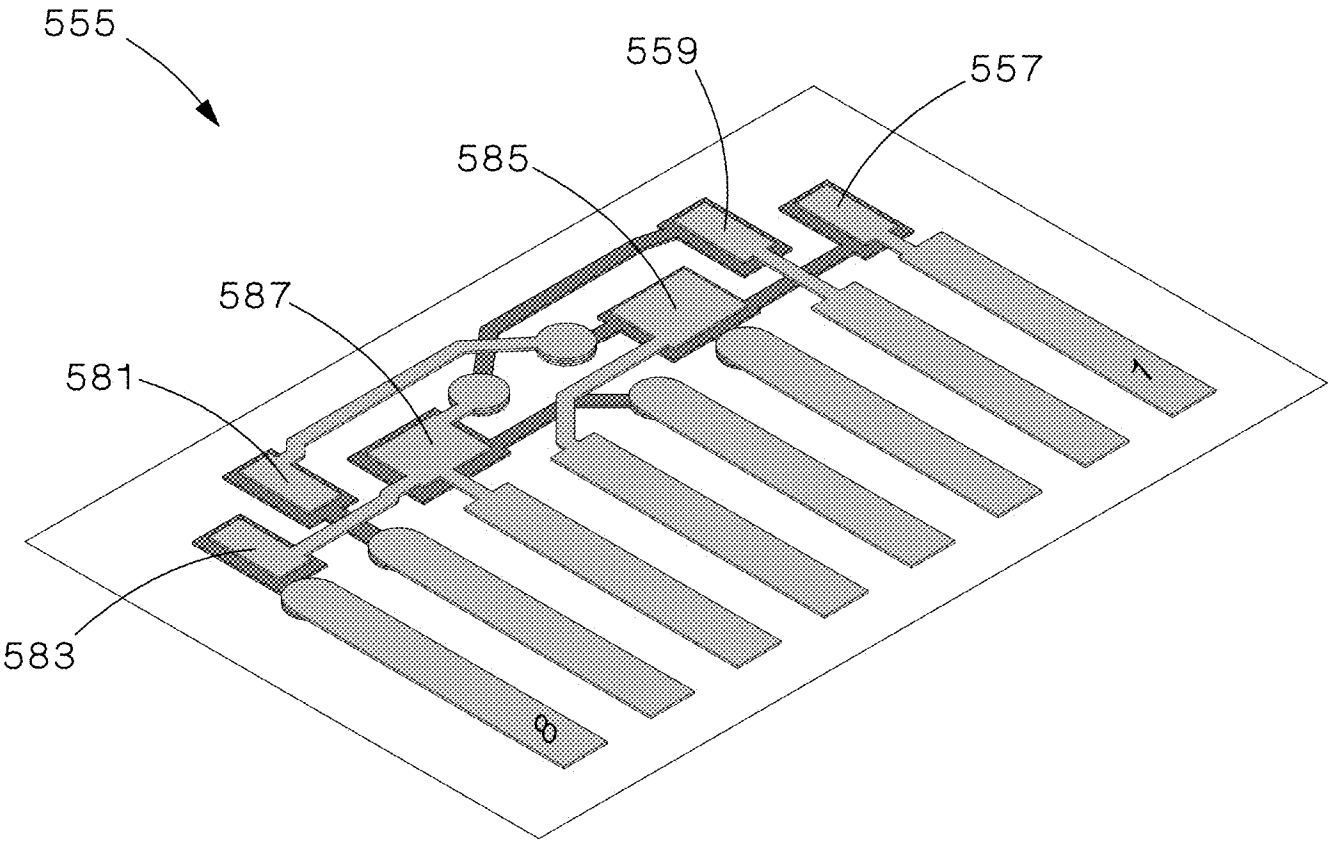
FIG. 67 illustrates a front flexible PCB in accordance with an embodiment of the present invention.

Another embodiment of a front flexible PCB 555 is shown in FIG. 67. In this embodiment, compensation of pair combination 3:6-1:2 is achieved through parallel plate capacitors 557 and 559 which provide capacitance between conductors 1 and 3, and conductors 2 and 6, respectively. Likewise, compensation of pair combination 3:6-7:8 is achieved through parallel plate capacitors 581 and 583 which provide capacitance between conductors 3 and 7, and conductors 6 and 8, respectively. Lastly, compensation of pair combination 3:6-4:5 is achieved through parallel plate capacitors 585 and 587 which provide capacitance between conductors 3 and 5, and conductors 4 and 6, respectively. The size of each of these capacitors is adjusted to achieve the desired amount of compensation to satisfy the mated crosstalk requirements called out in ANSI/TIA-568-C.2 while maintaining balanced coupling between respective pair combination. Note that there is no requirement that compensation circuitry be implemented on both the flexible and rigid PCBs. In other words, jack 500 may be implemented with only a single stage of compensation positioned on, for example, front flexible PCB 555.

Figure 68:
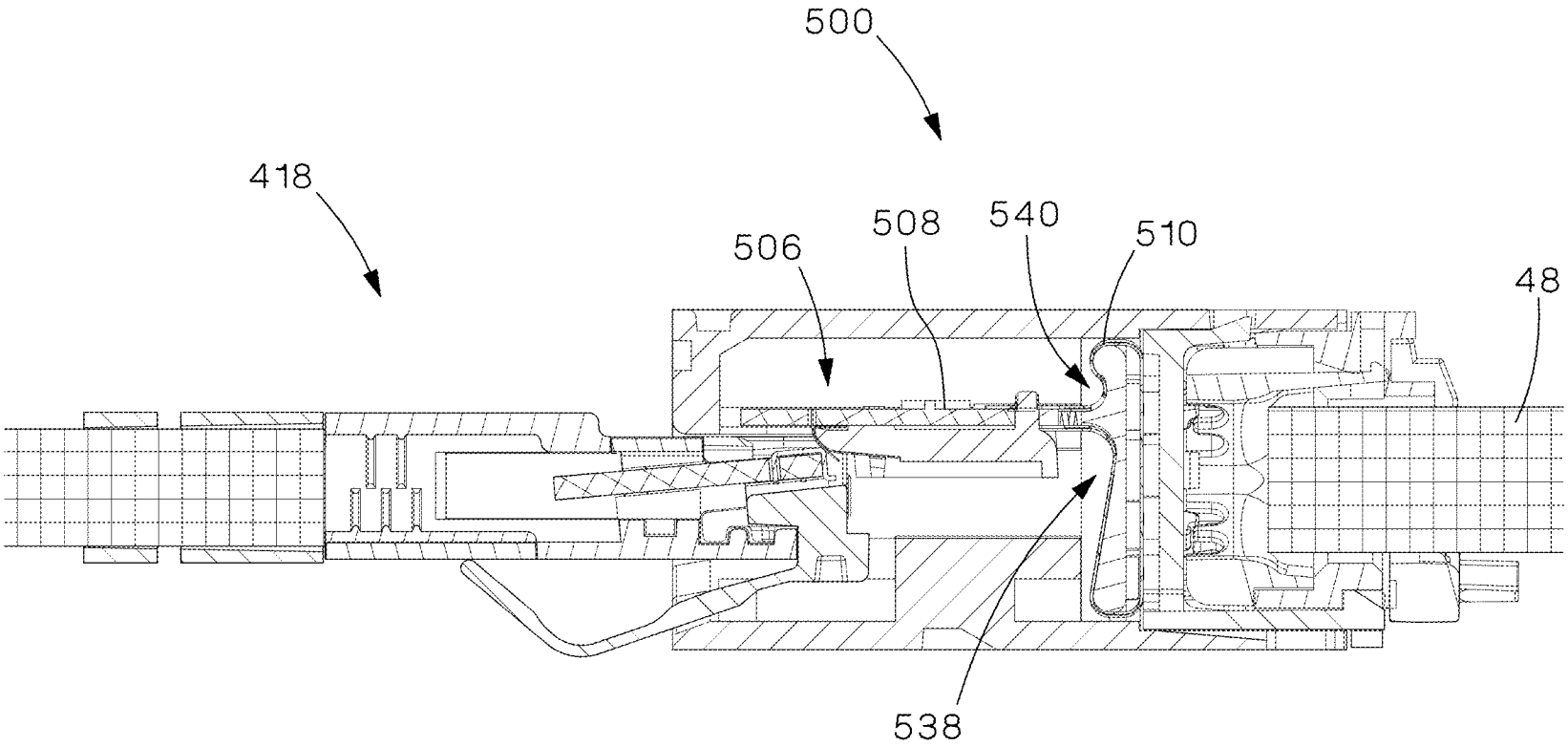
FIG. 68 illustrates a cross-section view taken along section line 68-68 of FIG. 44.
Figure 69:
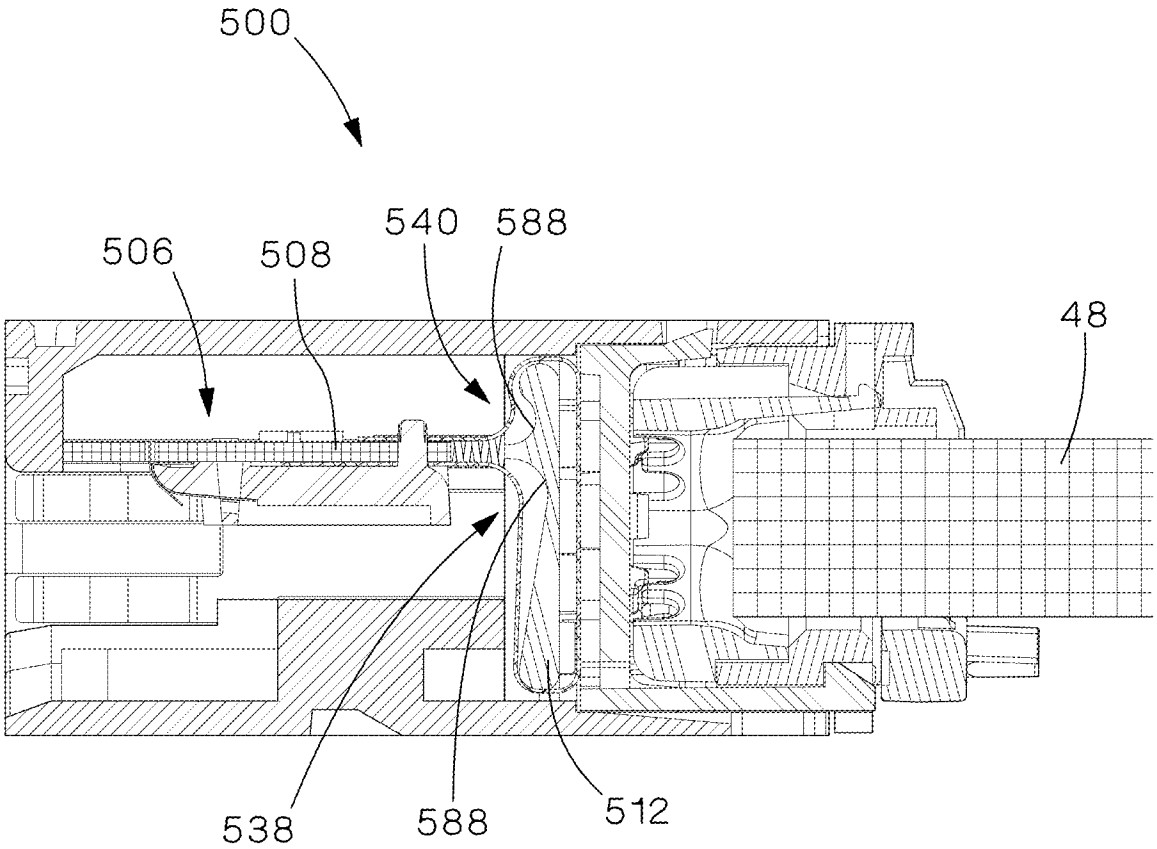
FIG. 69 illustrates a cross-section view taken along section line 69-69 of FIG. 46.

Referring now to FIGS. 68 and 69, shown therein are cross-section views of the jack 500 in a mated state and an unmated state, respectively. As can be seen from these figures, upon mating with a corresponding plug 418, the sled 506 moves in a rearward direction. The slack present in the top 538 and bottom 540 portions of back flexible PCB 510 allows the sled 506 to move with relative ease, maintaining a reliable electrical connection between the rigid PCB 508 and IDCs 514, and minimally distributing stress to solder joints of the back flexible PCB 510. To provide a degree of movement freedom to PCB 510, support 512 includes recesses 588 which provide space for top 538 and bottom 540 portions of PCB 510 to move into when jack 500 is mated with a plug. Recesses 588 can also act to control the bend radius of some of the flexible portions of PCB 510.

Figure 70:
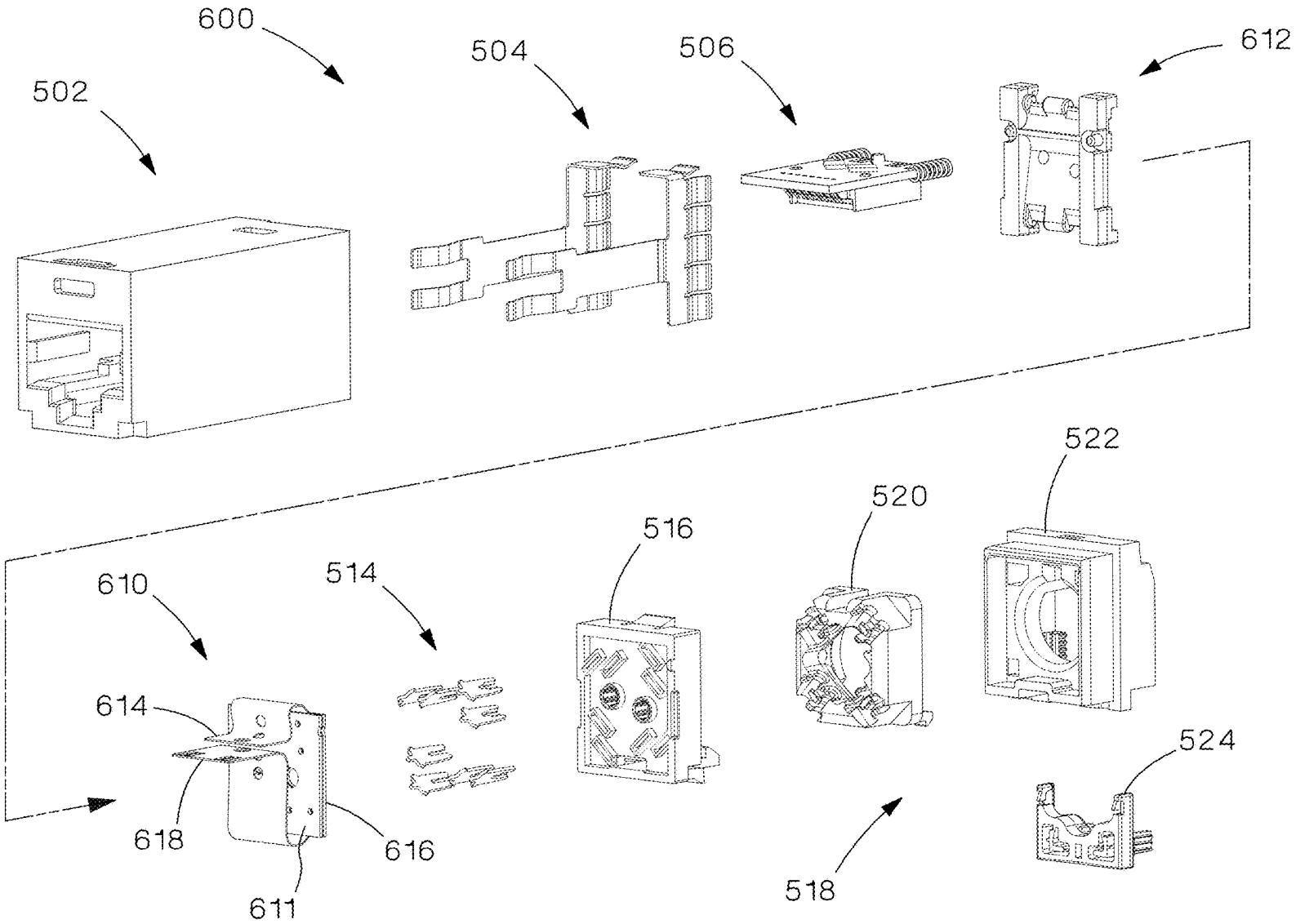
FIG. 70 illustrates an exploded front perspective view of a jack according to an embodiment of the present invention.
Figure 71:
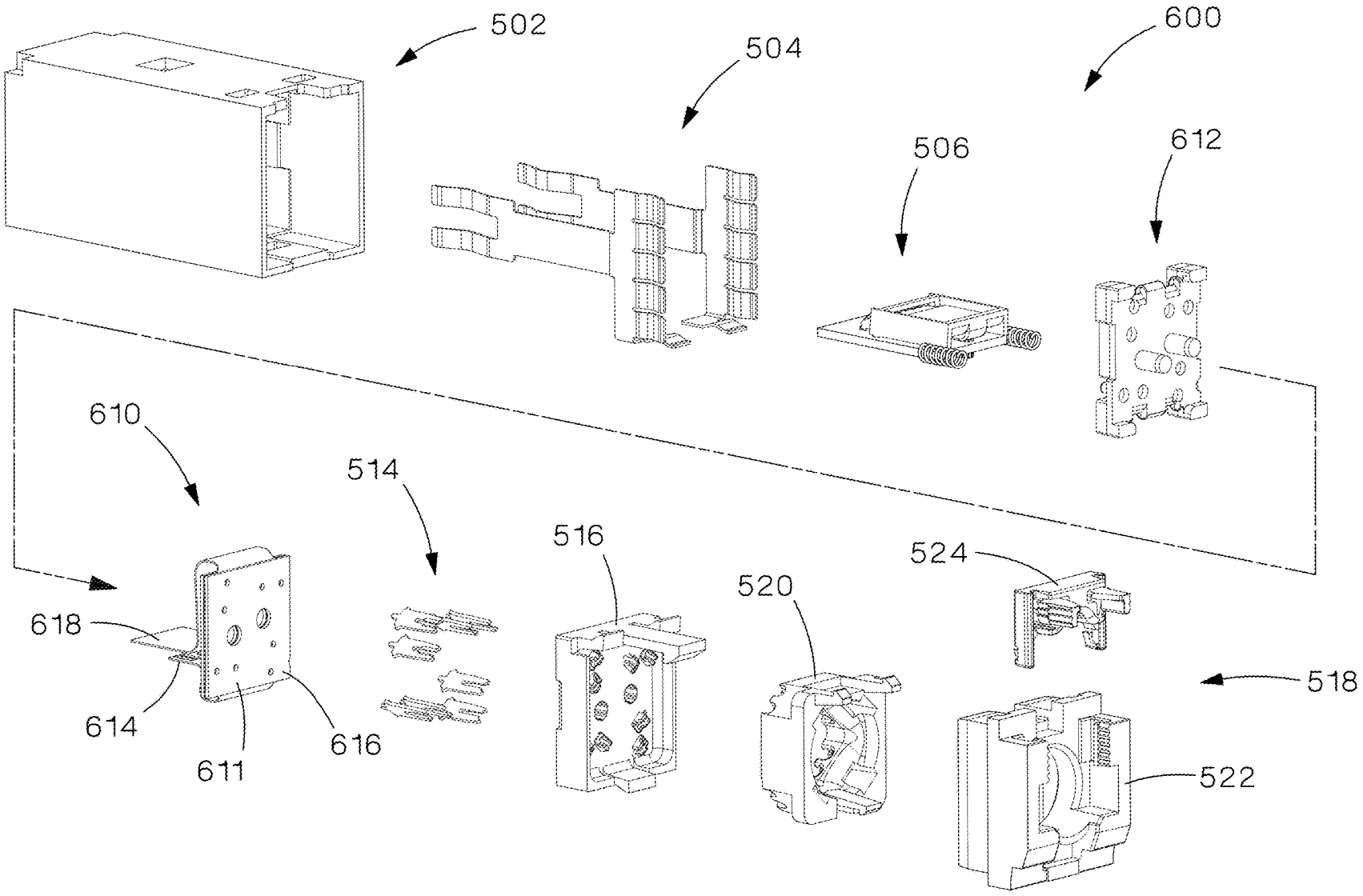
FIG. 71 illustrates an exploded rear perspective view of the jack of FIG. 70.

Another embodiment of a jack 600 according to the present invention is illustrated in FIGS. 70 and 71. The embodiment shown therein replaces the support 512 with support 612 and back flexible PCB 510 with back rigid-flex PCB 610. Back rigid-flex PCB 610 is comprised of a flexible PCB laminated between two (typically thicker) solid laminate layers 611. These solid laminate layers may reduce the possibility of tearing of vias when IDCs 514 are terminated to conductors of a communication cable. As such, rigid-flex PCB 610 includes a bottom flex portion 614, a rigid portion 616, and a top flex portion 618. As a result of the rigid portion 616, support 612 no longer needs to support as much of a load during the termination of cable conductors to IDCs 514. Consequently, the individual IDC supports 513 (see FIG. 51) underneath the IDC vias have been removed from the support 612.

Embodiments of the present invention can be applied to and/or implemented in a variety of shielded communications cables, including any of CAT5E, CAT6, CAT6A, CAT7, CAT5, and other twisted pair Ethernet cables, as well as other types of cables.

Note that while this invention has been described in terms of several embodiments, these embodiments are non-limiting (regardless of whether they have been labeled as exemplary or not), and there are alterations, permutations, and equivalents, which fall within the scope of this invention. Additionally, the described embodiments should not be interpreted as mutually exclusive, and should instead be understood as potentially combinable if such combinations are permissive. It should also be noted that there are many alternative ways of implementing the methods and apparatuses of the present invention. It is therefore intended that claims that may follow be interpreted as including all such alterations, permutations, and equivalents as fall within the true spirit and scope of the present invention.

We claim:

1. A communications connector comprising:

a housing;

a back flexible printed circuit board including a spring post around which a first end of a spring is positioned;

a rigid printed circuit board contained within the housing, the rigid printed circuit board oriented horizontally in the housing, and the rigid printed circuit board including a post around which a second end of the spring is positioned, wherein the rigid printed circuit board is configured to move horizontally relative to the housing according to a compression of the spring between the rigid printed circuit board and the back flexible printed circuit board;

a plurality of plug interface contacts connected to the rigid printed circuit board; and insulation displacement contacts (IDCs) electrically connected to the flexible printed circuit board;

wherein the back flexible printed circuit board is electrically connected to the rigid printed circuit board.

2. The communication connector of claim 1 further comprising a support structure connected to the rigid printed circuit board, the back flexible printed circuit board wrapping around the support structure with the IDCs going through the back flexible printed circuit board and being secured to the support structure.

3. The communication connector of claim 2 further comprising a sled support attached to the rigid printed circuit board.

4. The communication connector of claim 3 further comprising a front flexible printed circuit board secured to the sled support and the plurality of plug interface contacts.

5. The communication connector of claim 3 wherein the plurality of plug interface contacts are positioned over the front flexible printed circuit board; and wherein the plurality of plug interface contacts are configured to deform into contact with the front flexible printed circuit when an applied force is applied to the plurality of plug interface contacts.

6. The communication connector of claim 1 further comprising a rear sled including openings configured to receive the IDCs, wherein the IDCs include shoulder sections for abutting against a perimeter of the openings in the sled support.

* * * * *